US006561643B1

(12) United States Patent
Walker et al.

(10) Patent No.: US 6,561,643 B1
(45) Date of Patent: May 13, 2003

(54) ADVANCED MEDIA DETERMINATION SYSTEM FOR INKJET PRINTING

(75) Inventors: Steven H. Walker, Camas, WA (US); Stuart A. Scofield, Battle Ground, WA (US)

(73) Assignee: Hewlett-Packard Co., Palo Alto, CA (US)

( * ) Notice: Subject to any disclaimer, the term of this patent is extended or adjusted under 35 U.S.C. 154(b) by 99 days.

(21) Appl. No.: 09/607,206

(22) Filed: Jun. 28, 2000

Related U.S. Application Data

(63) Continuation-in-part of application No. 09/430,487, filed on Oct. 29, 1999, now Pat. No. 6,325,505, which is a continuation-in-part of application No. 09/183,086, filed on Oct. 29, 1998, which is a continuation-in-part of application No. 08/885,486, filed on Jun. 30, 1997, now Pat. No. 6,036,298.

(51) Int. Cl.[7] ..... B41J 2/01

(52) U.S. Cl. ..... 347/105; 250/559.01; 250/559.11

(58) Field of Search ..... 250/559.16, 559.01, 250/559.11, 559.4, 559.28, 559.39; 347/105, 19, 14; 400/279; 399/45, 389; 382/317

(56) References Cited

U.S. PATENT DOCUMENTS

| | | | | |
|---|---|---|---|---|
| 4,414,476 | A | 11/1983 | Maddox et al. | |
| 4,467,207 | A | 8/1984 | Lerner et al. | |
| 4,493,993 | A | 1/1985 | Kanamuller et al. | 347/19 |
| 4,540,887 | A | 9/1985 | Minerd et al. | |
| 4,557,597 | A | 12/1985 | Iwama | |
| 4,617,580 | A | 10/1986 | Miyakawa | |
| 4,983,854 | A | 1/1991 | Mizuno et al. | |

(List continued on next page.)

FOREIGN PATENT DOCUMENTS

| | | | |
|---|---|---|---|
| DE | 0154 397 | 3/1982 | |
| EP | 0292 957 | 11/1988 | |
| EP | 0441 965 | 1/1991 | |
| EP | 1 034 937 | 9/2000 | |
| JP | 61-161777 | * 7/1986 | ..... H01L/33/00 |
| JP | 5-338199 | 12/1993 | |
| JP | 7-314859 | 12/1995 | |

OTHER PUBLICATIONS

International Searching Authority, International Search Report dated Mar. 21, 2001.

International Searching Authority, International Search Report dated Mar. 21, 2001.

Von W. S. Ludolf, "Basics of optical transmission techique—A useroriented introduction", 1983, pp. 49–54. No Translation.

Michael R. Feldman, "Diffractive optics move into the commercial arena", Oct. 1994.

Michael R. Feldman and Adam E. Erlich, "Diffractive Optics Improve Product Design", Sep. 1995.

*Primary Examiner*—John Barlow
*Assistant Examiner*—Julian D. Huffman

(57) ABSTRACT

A system of classifying the type of incoming media entering an inkjet or other printing mechanism is provided to identify the media without requiring any special manufacturer markings. The leading edge of the incoming media is optically scanned using a blue-violet light to obtain both diffuse and specular reflectance values. A Fourier transform of these reflectance values generates a spatial frequency signature for the incoming media. The spatial frequency is compared with known values for different types of media to classify the incoming media according to major categories, such as transparencies, glossy photo media, premium paper and plain paper, as well as specific types of media within these categories, such as matte photo premium media and high-gloss photo media. An optimum print mode is selected according to the determined media type to automatically generate outstanding images without unnecessary user intervention. A printing mechanism constructed to implement this method is also provided.

85 Claims, 43 Drawing Sheets

U.S. PATENT DOCUMENTS 4,985,636 A 1/1991 Fukui et al.
5,119,132 A 6/1992 Butler
5,130,531 A 7/1992 Ito et al.
5,132,833 A 7/1992 Diau
5,139,339 A 8/1992 Courtney et al.
5,170,047 A 12/1992 Beauchamp et al.
5,187,360 A 2/1993 Pasco
5,260,584 A * 11/1993 Popson et al. ..... 250/571
5,262,797 A 11/1993 Boeller et al.
5,283,681 A 2/1994 Hoshino et al.
5,329,210 A 7/1994 Peterson et al.
5,336,714 A 8/1994 Krutak et al.
5,359,411 A 10/1994 Marchywka et al.
5,404,020 A 4/1995 Cobbs ..... 404/19
5,463,648 A 10/1995 Gibbs
5,488,223 A 1/1996 Austin et al.
5,526,257 A * 6/1996 Lerner ..... 364/401
5,547,501 A 8/1996 Maruyama et al.
5,606,449 A 2/1997 Nishiyama
5,633,744 A 5/1997 Nakajima
5,671,059 A 9/1997 Vincent
5,686,725 A 11/1997 Maruyama et al.
5,689,757 A * 11/1997 Ferrante et al. ..... 399/45
5,724,259 A 3/1998 Seymour et al.
5,757,393 A 5/1998 Suzuki
5,764,251 A 6/1998 Hashimoto
5,774,146 A 6/1998 Mizutani
5,925,889 A * 7/1999 Guillory et al. ..... 250/559.16
5,929,432 A 7/1999 Yamakawa
5,947,255 A 9/1999 Shimada et al.
5,984,193 A 11/1999 Uhling
6,036,298 A 3/2000 Walker
6,079,807 A 6/2000 Lindstrom et al.
6,125,986 A 10/2000 Nagase

* cited by examiner

FIG. 11 Typical Percent Reflectance/Absorbance by Wavelength for White Media and Cyan, Magenta, Yellow & Black Inks

GENERIC DIFFUSE SPATIAL FREQUENCY

GENERIC SPECULAR SPATIAL FREQUENCY

GENERIC DIFFUSE SPATIAL FREQUENCY

GENERIC SPECULAR SPATIAL FREQUENCY

ADVANCED MEDIA DETERMINATION SYSTEM FOR INKJET PRINTING

RELATED APPLICATIONS

This is a continuation-in-part application Ser. No. 09/430,487 of the U.S. Pat. No. 6,325,505, filed on Oct. 29, 1999, which is a continuation-in-part application Ser. No. 09/183,086, of U.S. Pat. No. 6,322,192, filed on Oct. 29, 1998, which is a continuation-in-part application Ser. No. 08/885,486 filed Jun. 30, 1997 of U.S. Pat. No. No. 6,036,298, issued on Mar. 14, 2000, all having one inventor in common.

FIELD OF THE INVENTION

The present invention relates generally to inkjet printing mechanisms, and more particularly to an optical sensing system for determining information about the type of print media entering the printzone (e.g. transparencies, plain paper, premium paper, photographic paper, etc.), so the printing mechanism can automatically tailor the print mode to generate optimal images on the specific type of incoming media without requiring bothersome user intervention.

BACKGROUND OF THE INVENTION

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in linear arrays usually located side-by-side on the printhead, parallel to one another, and perpendicular to the scanning direction, with the length of the nozzle arrays defining a print swath or band. That is, if all the nozzles of one array were continually fired as the printhead made one complete traverse through the printzone, a band or swath of ink would appear on the sheet. The width of this band is known as the "swath width" of the pen, the maximum pattern of ink which can be laid down in a single pass. The media is moved through the printzone, typically one swath width at a time, although some print schemes move the media incrementally by for instance, halves or quarters of a swath width for each printhead pass to obtain a shingled drop placement which enhances the appearance of the final image.

Inkjet printers designed for the home market often have a variety of conflicting design criteria. For example, the home market dictates that an inkjet printer be designed for high volume manufacture and delivery at the lowest possible cost, with better than average print quality along with maximized ease of use. With continuing increases in printer performance, the challenge of maintaining a balance between these conflicting design criteria also increases. For example, printer performance has progressed to the point where designs are being considered that use four separate monochromatic printheads, resulting in a total of over 1200 nozzles that produce ink drops so small that they approximate a mist.

Such high resolution printing requires very tight manufacturing tolerances on these new pens; however, maintaining such tight tolerances is often difficult when also trying to achieve a satisfactory manufacturing yield of the new pens. Indeed, the attributes which enhance pen performance dictate even tighter process controls, which unfortunately result in a lower pen yield as pens are scrapped out because they do not meet these high quality standards. To compensate for high scrap-out rates, the cost of the pens which are ultimately sold is increased. Thus, it would be desirable to find a way to economically control pens with slight deviations without sacrificing print quality, resulting in higher pen yields (a lower scrap-out rate) and lower prices for consumers.

Moreover, the multiple number of pens in these new printer designs, as well as the microscopic size of their ink droplets, has made it unreasonable to expect consumers to perform any type of pen alignment procedure. In the past, earlier printers having larger drop volumes printed a test pattern for the consumer to review and then select the optimal pen alignment pattern. Unfortunately, the individual small droplets of the new pens are difficult to see, and the fine pitch of the printhead nozzles, that is, the greater number of dots per inch ("dpi" rating) laid down during printing, further increases the difficulty of this task. From this predicament, where advances in print quality have rendered consumer pen alignment to be a nearly impossible task, evolved the concept of closed-loop inkjet printing.

In closed loop inkjet printing, sensors are used to determine a particular attribute of interest, with the printer then using the sensor signal as an input to adjust the particular attribute. For pen alignment, a sensor may be used to measure the position of ink drops produced from each printhead. The printer then uses this information to adjust the timing of energizing the firing resistors to bring the resulting droplets into alignment. In such a closed loop system, user intervention is no longer required, so ease of use is maximized.

Closed loop inkjet printing may also increase pen yield, by allowing the printer to compensate for deviations between individual pens, which otherwise would have been scrapped out as failing to meet tight quality control standards. Drop volume is a good example of this type of trade-off. In the past, to maintain hue control the specifications for drop volume had relatively tight tolerances. In a closed loop system, the actual color balance may be monitored and then compensated with the printer firing control system. Thus, the design tolerances on the drop volume may be loosened, allowing more pens to pass through quality control which increases pen yield. A higher pen yield benefits consumers by allowing manufacturers to produce higher volumes, which results in lower pen costs for consumers.

In the past, closed loop inkjet printing systems have been too costly for the home printer market, although they have proved feasible on higher end products. For example, in the DesignJet® 755 inkjet plotter, and the HP Color Copier 210 machine, both produced by the Hewlett-Packard Company of Palo Alto, Calif., the pens have been aligned using an optical sensor. The DesignJet® 755 plotter used an optical sensor which may be purchased from the Hewlett-Packard Company of Palo Alto, Calif., as part no. C3195-60002, referred to herein as the "HP '002" sensor. The HP Color Copier 210 machine uses an optical sensor which may be purchased from the Hewlett-Packard Company as part no. C5302-60014, referred to herein as the "HP '014" sensor. The HP '014 sensor is similar in function to the HP '002 sensor, but the HP '014 sensor uses an additional green light emitting diode (LED) and a more product-specific packaging to better fit the design of the HP Color Copier 210 machine. Both of these higher end machines have relatively low production volumes, but their higher market costs justify the addition of these relatively expensive sensors.

FIG. 12 is a schematic diagram illustrating the optical construction of the HP '002 sensor, with the HP '014 sensor differing from the HP '002 sensor primarily in signal processing. The HP '014 sensor uses two green LEDs to boost the signal level, so no additional external amplification is needed. Additionally, a variable DC (direct current) offset is incorporated into the HP '014 system to compensate for signal drift. The HP '002 sensor has a blue LED B which generates a blue light B1, and a green LED G which generates a green light G1, whereas the HP '014 sensor (not shown) uses two green LEDs. The blue light stream B1 and the green light stream G1 impact along location D on print media M, and then reflect off the media M as light rays B2 and G2 through a lens L, which focuses this light as rays B3 and G3 for receipt by a photodiode P.

Upon receiving the focused light B3 and G3, the photodiode P generates a sensor signal S which is supplied to the printer controller C. In response to the photodiode sensor signal S, and positional data S1 received from an encoder E on the printhead carriage or on the media advance roller (not shown), the printer controller C adjusts a firing signal F sent to the printhead resistors adjacent nozzles N, to adjust the ink droplet output. Due to the spectral reflectance of the colored inks, the blue LED B is used to detect the presence of yellow ink on the media M, whereas the green LED G is used to detect the presence of cyan and magenta ink, with either diode being used to detect black ink. Thus, the printer controller C, given the input signal S from the photodiode P, in combination with encoder position signal S1 from the encoder E, can determine whether a dot or group of dots landed at a desired location in a test pattern printed on the media M.

Historically, blue LEDs have been weak illuminators. Indeed, the designers of the DesignJet® 755 plotter went to great lengths in signal processing strategies to compensate for this frail blue illumination. The HP Color Copier 210 machine designers faced the same problem and decided to forego directly sensing yellow ink, instead using two green LEDs with color mixing for yellow detection. While brighter blue LEDs have been available in the past, they were prohibitively expensive, even for use in the lower volume, high-end products. For example, the blue LED used in the HP '002 sensor had an intensity of 15 mcd ("milli-candles"). To increase the sensor signal from this dim blue light source, a 100× amplifier was required to boost this signal by 100 times. However, since the amplifier was external to the photodiode portion of the HP '002 sensor, this amplifier configuration was susceptible to propagated noise. Moreover, the offset imposed by this 100× amplifier further complicated the signal processing by requiring that the signal be AC (alternating current) coupled. Additionally, a 10-bit A/D (analog-to-digital) signal converter was needed to obtain adequate resolution with this still relatively low signal.

The HP '014 sensor used in the HP Color Copier 210 machine includes the same optics as the HP '002 sensor used in the DesignJet® 755 plotter, however, the HP '014 sensor is more compact, tailored for ease in assembly, and is roughly 40% the size of the HP '002 sensor. Both the HP '002 and '014 sensors are non-pulsed DC (direct current) sensors, that is, the LEDs are turned on and remain on through the entire scan of the sensor across the media. Signal samples are spatially triggered by the state changes of the encoder strip, which provides feedback to the printer controller about the carriage position across the scan. At the relatively low carriage speed used for the optical scanning, the time required to sample the data is small compared to the total time between each encoder state change. To prevent overheating the LEDs during a scan, the DC forward current through the LED is limited. Since illumination increases with increasing forward current, this current limitation to prevent overheating constrains the brightness of the LED to a value less than the maximum possible.

The HP '014 sensor designers avoided the blue LED problem by using a new way to detect yellow ink with green LEDs. Specifically, yellow ink was detected by placing drops of magenta ink on top of a yellow ink bar when performing a pen alignment routine. The magenta ink migrates through yellow ink to the edges of the yellow bar to change spectral reflectance of the yellow bar so the edges of the bar can be detected when illuminated by the green LEDs. Unfortunately, this yellow ink detection scheme has results which are media dependent. That is, the mixing of the two inks (magenta and yellow) is greatly influenced by the surface properties of media. For use in the home printer market, the media may range from a special photo quality glossy paper, down to a brown lunch sack, fabric, or anything in between. While minimum ink migration may occur on the glossy, photo-type media, a high degree of migration will occur through the paper sack or fabric. Thus, ink mixing to determine drop placement becomes quite risky in the home market, because these earlier printers had no way of knowing which type of media had been used during the pen alignment routine.

To address this media identification problem, a media detect sensor was placed adjacent to the media path through the printer, such as on the media pick pivoting mechanism or on the media input tray. The media detect sensor reads an invisible-ink code pre-printed on the media. This code enables the printer to compensate for the orientation, size and type of media by adjusting print modes for optimum print quality to compensate for these variances in the media supply, without requiring any customer intervention. Both the drop detect and media detect sensors use a light-to-voltage (LVC) converter and one or more light emitting diodes (LED), with each sensor being dependent on a housing to orient the optical elements and shield the LVC from ambient light. In an effort to provide consumers with economical inkjet printing mechanisms that produce high quality images, the costs associated with implementing both sensors were analyzed. Surprisingly, a substantial portion of the cost of both sensors is not related to the sensing unit itself, but instead, is a function of the costs associated with interconnecting the sensors to the printer controller and keeping a greater number of distinct parts in inventory.

Actually, media type detection is not present in the majority of inkjet printers on the commercial market today. Most printers use an open-loop process, relying on an operator to select the type of media through the software driver of their computer. Thus there is no assurance that the media actually in the input tray corresponds to the type selected for a particular print request, and unfortunately, printing with an incorrectly selected media often produces poor quality images. Compounding this problem is the fact that most users never change the media type settings at all, and most are not even aware that these settings even exist. Therefore, the typical user always prints with a default setting of the plain paper-normal mode. This is unfortunate because if a user inserts expensive photo media into the printer, the resulting images are substandard when the normal mode rather than a photo mode is selected, leaving the user effectively wasting the expensive photo media. Besides photo media, transparencies also yield particularly poor image quality when they are printed on in the plain paper-normal mode.

The problem of distinguishing transparencies from paper was addressed in the Hewlett-Packard Company's DeskJet 2000C Professional Series Color Inkjet Printer, which uses an infrared reflective sensor to determine the presence of transparencies. This system uses the fact the light passes through the transparencies to distinguish them from photo media and plain paper. While this identification system is simple and relatively low cost, it offers limited identification of the varying types of media available to users.

One proposed system offered what was thought to be an ultimate solution to media type identification. In this system an invisible ink code was printed on each sheet of the media in a location where it was read by a sensor onboard the printer. This code supplied the printer driver with a wealth of information concerning the media type, manufacturer, orientation and properties. The sensor was low in cost, and the system was very reliable in that it totally unburdened the user from media selection through the driver, and insured that the loaded media was correctly identified. Unfortunately, these pre-printed invisible ink codes became visible when they were printed over. The code was then placed in the media margins to avoid this problem, but market demand is pushing inkjet printers into becoming photo generators. Thus, the margins became undesirable artifacts for photographs with a full bleed printing, that is, being printed to the edge of the paper. Thus, even placing the code in what used to have been a margin when printed over in full-bleed printing mode created a severe print defect.

Another sensor system for media type determination used a combination transmissive/reflective sensor. The reflective portion of the sensor had two receptors at differing angles with respect to the surface of the media. By looking at the transmissive detector, a transparency could be detected due to the passage of light through the transparency. The two reflective sensors were used to measure the specular reflectance of the media and the diffuse reflectance of the media, respectively. By analyzing the ratio of these two reflectance values, specific media types were identified. To implement this system, a database was required comprising a look-up table of the reflective ratios which were correlated with the various types of media. Unfortunately, new, non-characterized media was often misidentified, leading to print quality degradation. Finally, one of the worst shortcomings of this system was that several different types of media could generate the same reflectance ratio, yet have totally different print mode classifications.

Thus, it would be desirable to provide an optical sensing system for determining information about the type of media entering the printing mechanism, so the printing mechanism can automatically adjust printing for optimal images without requiring user intervention.

SUMMARY OF THE INVENTION

According to one aspect of the invention, a method of classifying incoming media entering a printing mechanism is provided. The method includes the steps of optically scanning a portion of the incoming media to generate diffuse reflectance data and specular reflectance data. In a determining step, the spatial frequencies of the diffuse reflectance data and the specular reflectance data are determined. In an analyzing step, the diffuse reflectance data the specular reflectance data and the spatial frequencies thereof are analyzed through comparison with known values for different types of media to classify the incoming media as one of said different types.

According to another aspect of the invention, another method of classifying incoming media entering a printing mechanism is provided. The method includes the steps of optically scanning a portion of the incoming media, collecting raw data during the scanning step, and massaging the raw data. In two determining steps, first a major category corresponding to the incoming media is determined, followed by a second determining step, where a specific type of media within the major category corresponding to the incoming media is determined. In a verifying step, it is verified whether the specific type of media corresponds to the incoming media. In a selecting step, a print mode is selected in response to the verifying step. Finally, in a printing step, an image is printed on the incoming media using the selected print mode.

According to a further aspect of the invention, another method of classifying incoming media entering a printing mechanism is provided. The method includes the steps of optically scanning a portion of the incoming media to generate diffuse reflectance data and specular reflectance data, and determining the spatial frequencies of the diffuse reflectance data and the specular reflectance data. In a sorting step, the incoming media is sorted into one of the plural major media category groups. Finally in a matching step, the incoming media is matched with a specific media type or a default media type both within said one of plural major media category groups.

According to a yet another aspect of the invention, an inkjet printing mechanism is provided as including a carriage that reciprocates an inkjet printhead along a scanning axis across the printzone to selectively deposit ink droplets on the media in response to a print signal generated to print a selected image on incoming media entering the printzone. The printing mechanism also includes a media sensor supported by the carriage for scanning across the printzone. The media sensor includes (1) a single illuminating element directed to illuminate the incoming media, (2) a diffuse sensor which receives diffuse light reflected from the illuminated media and generates a diffuse signal having an amplitude proportional to the diffuse reflectance of the media, and (3) a specular sensor which receives specular light reflected from the illuminated media and generates a specular signal having an amplitude proportional to the specular reflectance of the media. The printing mechanism also has a controller which compares the diffuse signal and the specular signal to a set of reference values to generate a print signal having a print mode selected to match the type of media entering the printzone.

According to an additional aspect of the invention, an inkjet printing mechanism which prints on incoming media is provided, the printing mechanism includes a bending member which bows the incoming media and a carriage which traverses across the incoming media. A media sensor is supported by the carriage to scan across the incoming media opposite the bending member. The media sensor includes an illuminating element which illuminates the incoming media, and a sensor which receives light reflected from the illuminated media, and in response thereto, generates a reflectance signal. A controller compares the reflectance signal with known reference values to select a print mode corresponding to the incoming media.

According to still another aspect of the invention, an additional method of classifying incoming media entering a printing mechanism is provided. The method includes the steps of imparting a bow to the incoming media, and optically scanning the bowed portion of the incoming media to generate reflectance data. In an analyzing step, the reflectance data is analyzed through comparison with known values for different types of media to classify the incoming media as one of said different types.

An overall goal of present invention is to provide an optical sensing system for an inkjet printing mechanism, along with a method for optically distinguishing the type of media so future droplets may be adjusted by the printing mechanism to produce high quality images on the particular type of media in use without user intervention.

A further goal of present invention is to provide an easy-to-use inkjet printing mechanism capable of compensating for media type to produce optimal images for consumers.

Another goal of the present invention is to provide an optical sensing system for identifying the major types of media, such as plain paper, premium paper, photo media, and transparencies, without requiring any special markings on the media which may otherwise create undesirable print artifacts, and which does not require a user's intervention or recalibration.

An additional goal of the present invention is to provide an optical sensing system for an inkjet printing mechanism that is lightweight, compact and produced with minimal components to provide consumers with a more economical inkjet printing product.

BRIEF DESCRIPTION OF THE DRAWINGS

FIGS. 29–32 together form a flow chart which illustrates the "major category determination" and "specific type determination" portions of the method of FIG. 20, specifically with:

FIG. 29 showing transparency determnination;

FIG. 30 showing glossy photo determination;

FIG. 31 showing matte photo determination; and

FIG. 32 showing plain paper and premium paper determination.

FIGS. 39–44 are graphs of the raw data accumulated during the "collect raw data" portion of the method of FIG. 20, specifically with:

FIG. 39 showing data for a very glossy photo media;

FIG. 40 showing data for a glossy photo media;

FIG. 41 showing data for a matte photo media;

FIG. 42 showing data for a plain paper media, specifically, a Gilbert® Bond;

FIG. 43 showing data for a premium media

FIG. 44 showing data for HP transparency media with a tape header; and

FIGS. 46–51 are graphs of the Fourier spectrum components, up to component 100, specifically with:

FIG. 46 showing the matte photo media diffuse reflection;

FIG. 47 showing the matte photo media specular reflection;

FIG. 48 showing the very glossy photo media diffuse reflection;

FIG. 49 showing the very glossy photo media specular reflection;

FIG. 50 showing the plain paper media diffuse reflection; and

FIG. 51 showing the plain paper media specular reflection.

DETAILED DESCRIPTION OF A PREFERRED EMBODIMENT

Figure 1:
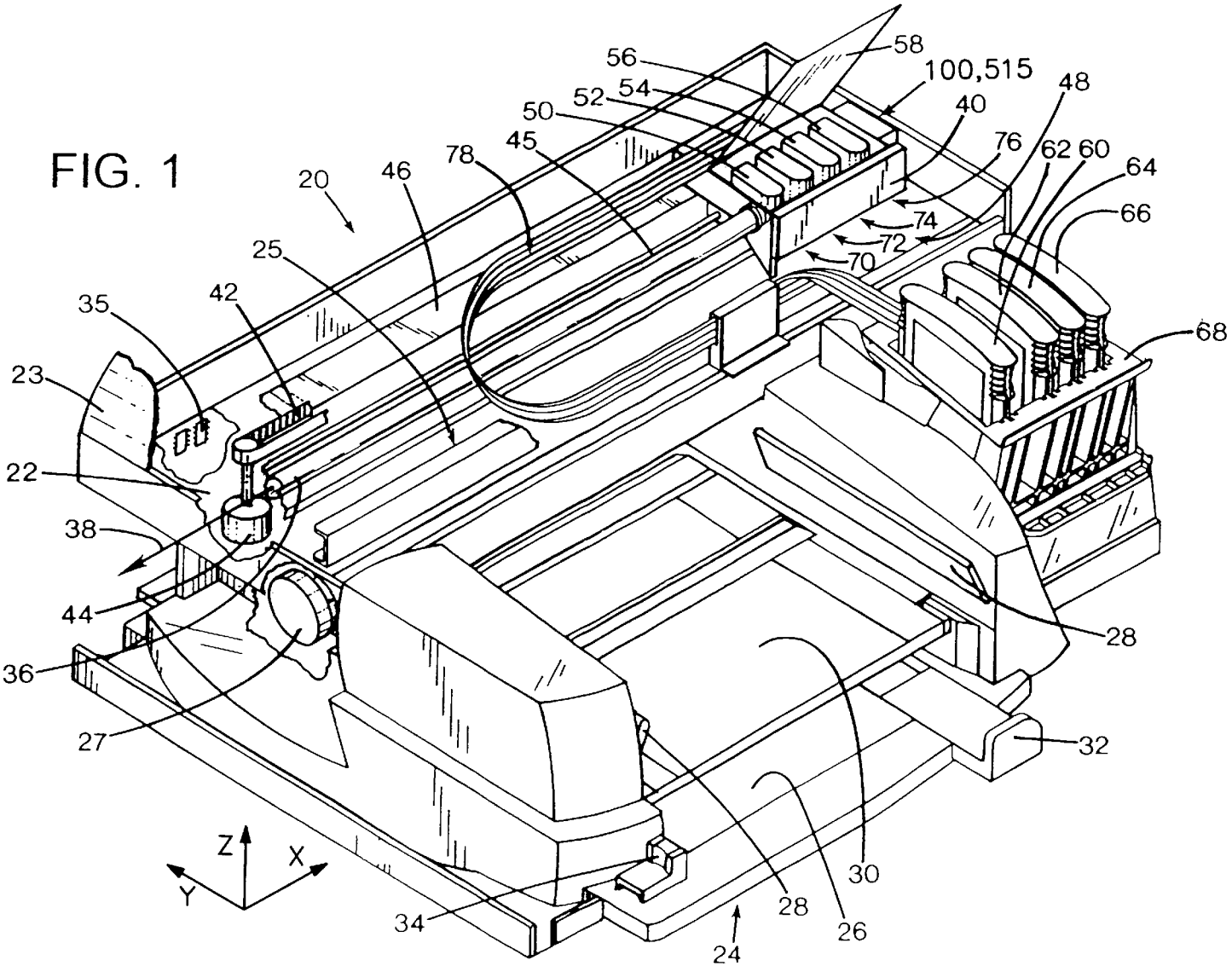
FIG. 1 is a fragmented perspective view of one form of an inkjet printing mechanism, here an inkjet printer, including one form of an optical sensing system of the present invention for gathering information about an incoming sheet of media entering a printzone portion of the printing mechanism.

FIG. 1 illustrates an embodiment of an inkjet printing mechanism, here shown as an inkjet printer 20, constructed in accordance with the present invention, which may be used for printing for business reports, correspondence, desktop publishing, artwork, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20 which may find particular usefulness in the home environment.

While it is apparent that the printer components may vary from model to model, the typical inkjet printer 20 includes a chassis 22 surrounded by a housing or casing enclosure 23, the majority of which has been omitted for clarity in viewing the internal components. A print media handling system 24 feeds sheets of print media through a printzone 25. The print media may be any type of suitable sheet material, such as paper, card-stock, envelopes, fabric, transparencies, mylar, and the like, but for convenience, the illustrated embodiment is described using paper as the print medium. The print media handling system 24 has a media input, such as a supply or feed tray 26 into which a supply of media is loaded and stored before printing. A series of conventional media advance or drive rollers (not shown) powered by a motor and gear assembly 27 may be used to move the print media from the supply tray 26 into the printzone 25 for printing. After printing, the media sheet then lands on a pair of retractable output drying wing members 28, shown extended to receive the printed sheet. The wings 28 momentarily hold the newly printed sheet above any previously printed sheets still drying in an output tray portion 30 before retracting to the sides to drop the newly printed sheet into the output tray 30. The media handling system 24 may include a series of adjustment mechanisms for accommodating different sizes of print media, including letter, legal, A-4, envelopes, etc. To secure the generally rectangular media sheet in a lengthwise direction along the media length, the handling system 24 may include a sliding length adjustment lever 32, and a sliding width adjustment lever 34 to secure the media sheet in a width direction across the media width.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

The chassis 22 supports a guide rod 36 that defines a scan axis 38 and slideably supports an inkjet printhead carriage 40 for reciprocal movement along the scan axis 38, back and forth across the printzone 25. The carriage 40 is driven by a carriage propulsion system, here shown as including an endless belt 42 coupled to a carriage drive DC motor 44. The carriage propulsion system also has a position feedback system, such as a conventional optical encoder system, which communicates carriage position signals to the controller 35. An optical encoder reader may be mounted to carriage 40 to read an encoder strip 45 extending along the path of carriage travel. The carriage drive motor 44 then operates in response to control signals received from the printer controller 35. A conventional flexible, multi-conductor strip 46 may be used to deliver enabling or firing command control signals from the controller 35 to the printhead carriage 40 for printing, as described further below.

The carriage 40 is propelled along guide rod 36 into a servicing region 48, which may house a service station unit (not shown) that provides various conventional printhead servicing functions, as described in the Background section above. A variety of different mechanisms may be used to selectively bring printhead caps, wipers and primers (if used) into contact with the printheads, such as translating or rotary devices, which may be motor driven, or operated through engagement with the carriage 40. For instance, suitable translating or floating sled types of service station operating mechanisms are shown in U.S. Pat. Nos. 4,853,717 and 5,155,497, both assigned to the present assignee, Hewlett-Packard Company. A rotary type of servicing mechanism is commercially available in the DeskJet® 850C, 855C, 820C, 870C and 895C models of color inkjet printers (also see U.S. Pat. No. 5,614,930, assigned to the Hewlett-Packard Company), while other types of translational servicing mechanisms are commercially available in the DeskJet® 690C, 693C, 720C and 722C models of color inkjet printers, all sold by the Hewlett-Packard Company.

In the print zone 25, the media receives ink from an inkjet cartridge, such as a black ink cartridge 50 and three monochrome color ink cartridges 52, 54 and 56, secured in the carriage 40 by a latching mechanism 58, shown open in FIG. 1. The cartridges 50–56 are also commonly called "pens" by those in the art. The inks dispensed by the pens 50–56 may be pigment-based inks, dye-based inks, or combinations thereof, as well as paraffin-based inks, hybrid or composite inks having both dye and pigment characteristics.

The illustrated pens 50–56 each include reservoirs for storing a supply of ink therein. The reservoirs for each pen 50–56 may contain the entire ink supply on board the printer for each color, which is typical of a replaceable cartridge, or they may store only a small supply of ink in what is known as an "off-axis" ink delivery system. The replaceable cartridge systems carry the entire ink supply as the pen reciprocates over the printzone 25 along the scanning axis 38. Hence, the replaceable cartridge system may be considered as an "on-axis" system, whereas systems which store the main ink supply at a stationary location remote from the printzone scanning axis are called "off-axis" systems. In an off-axis system, the main ink supply for each color is stored at a stationary location in the printer, such as four refillable or replaceable main reservoirs 60, 62, 64 and 66, which are received in a stationary ink supply receptacle 68 supported by the chassis 22. The pens 50, 52, 54 and 56 have printheads 70, 72, 74 and 76, respectively, which eject ink delivered via a conduit or tubing system 2478 from the stationary reservoirs 60–66 to the on-board reservoirs adjacent the printheads 70–76.

The printheads 70–76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 38, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals received via the multi-conductor strip 46 from the controller 35.

Monochromatic Optical Sensing System

Figure 2:
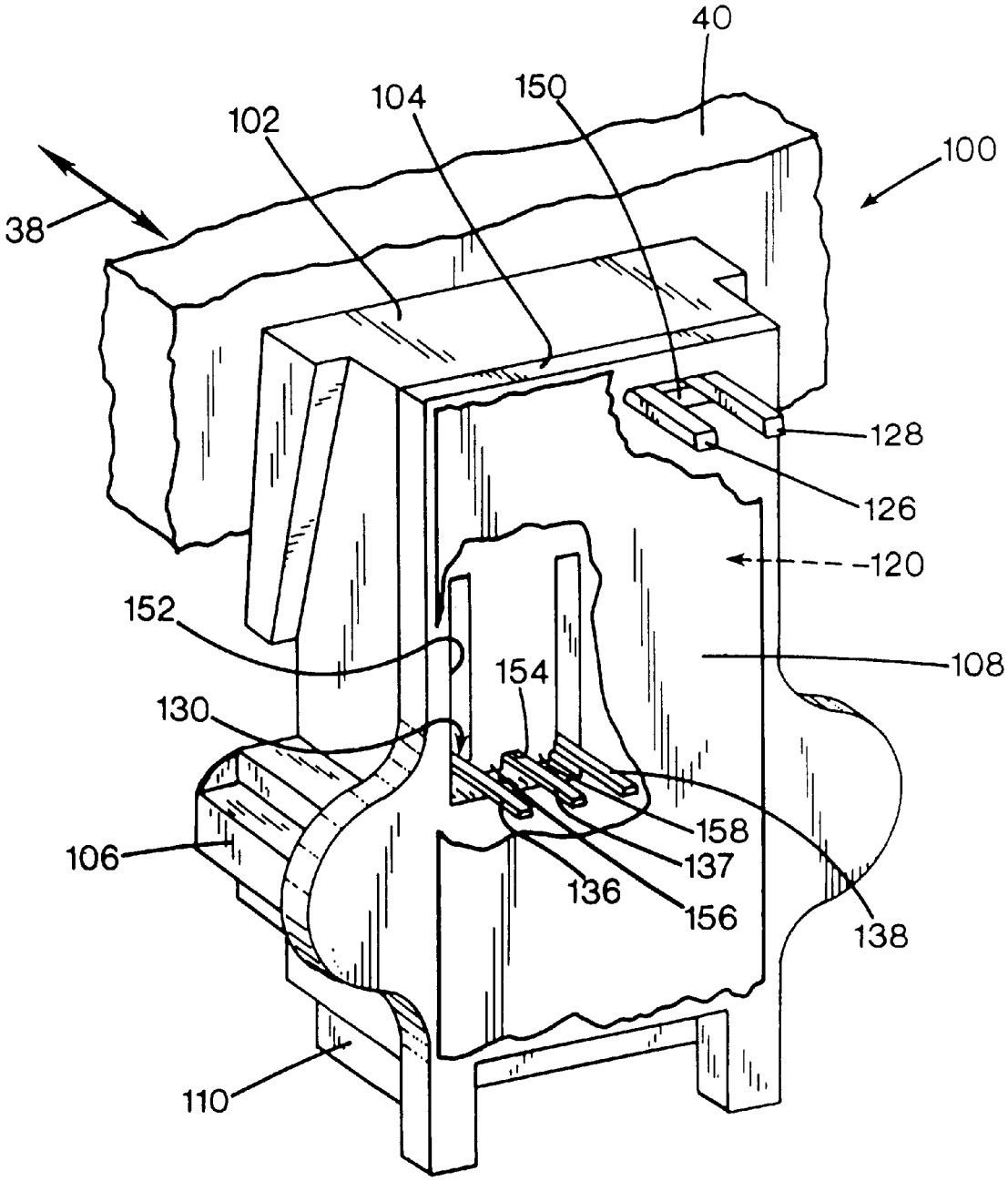
FIG. 2 is an enlarged, fragmented perspective view of a monochromatic optical sensor of the sensing system of FIG. 1, shown mounted to a portion of the printhead carriage.
Figure 3:
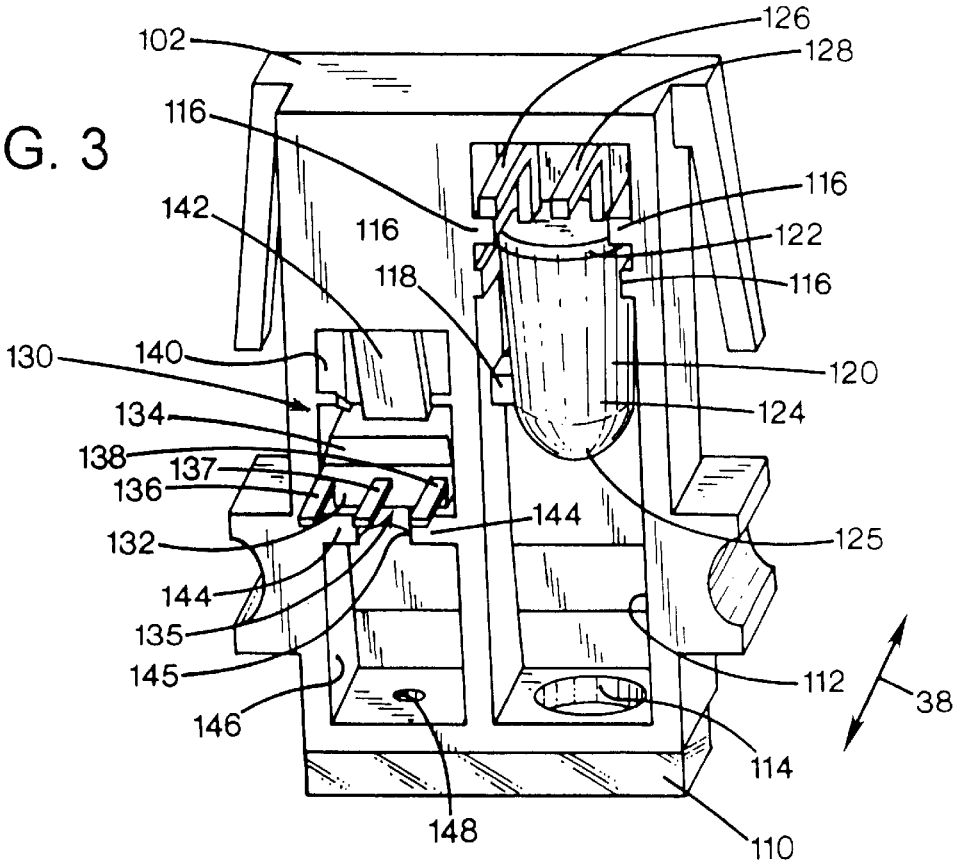
FIG. 3 is a perspective view of the interior of the monochromatic optical sensor of FIG. 2.

FIGS. 2 and 3 illustrate one form of a monochromatic optical sensor 100 constructed in accordance with the present invention. The sensor 100 includes a casing or base unit 102 which is supported by the printhead carriage 40, for instance using a screw attachment, slide and snap fittings, by bonding with an adhesive or constructed integrally therewith, or in a variety of other equivalent ways which are known to those skilled in the art. A cover 104 is attached to the case 102, for instance by a pair of snap fit fingers, such as finger 106 in FIG. 2. Preferably, the casing 102 and the cover 104 are both constructed of an injection molded rigid plastic, although it is apparent other materials may also be suitably employed. Overlying the cover 104 is a flex circuit assembly 108, which may be used to provide power to the sensor, and to deliver sensor signals back to the printer controller 35. The flex circuit 108 may couple the sensor 100 to an electronics portion (not shown) of the carriage 40, with the sensor signals then passing from the carriage 40 through the multi-conductor strip 46, which carries communication signals between the controller 35 and the carriage 40 to fire the printheads 70–76. A lens assembly 110 is gripped between lower portions of the casing 102 and the cover 104, with the lens assembly 100 being described in greater detail below with respect to FIGS. 4–6. Preferably, the rear portion, and/or the side portions of casing 102 define one or more slots (not shown) which receive the lens 110, with the cover 104 then securing the lens 110 within these slots. Alternatively, the lens assembly 110 may be bonded to the casing 102 or otherwise secured thereto in a variety of different ways known to those skilled in the art.

FIG. 3 shows the monochromatic sensor 100 with the cover 104 removed to expose the interior of the casing 102, and the internal components of the sensor. The casing 102 defines an LED (light emitting diode) receiving chamber 112 and an LED output aperture 114 which couples the interior of chamber 112 to a portion of the lens assembly 110. The casing 102 also defines two pair of alignment members 116, and an alignment cradle or trough defining member 118 which cooperate to receive a blue LED 120. A rear flange portion 122 of the blue LED 120 preferably rests against a lower side of each of the alignment members 116, with the trough portion of the support 118 being contoured to receive a front portion 124, adjacent an output lens 125, of the LED 120. Extending from the LED rear flange 122 are two input leads 126 and 128 which are electrically coupled to conductors in the flex circuit 108, for instance by soldering, crimping, or other electrical connection techniques known in the art. One suitable blue LED 120 may be obtained from Panasonic (Matsushita Electronics) of Kyoto, Japan, as part no. LNG992CF9, which is a T-1¾ GaN LED.

The optical sensor 100 also includes a photodiode 130 that includes a light sensitive photocell 132 which is electrically coupled to an amplifier portion 134 of the photodiode 130. The photodiode 130 also includes input lens 135, which emits light to the light sensitive photocell 132. The photocell 132 is preferably encapsulated as a package fabricated to include the curved lens 135 which concentrates incoming light onto the photocell 132. The photodiode 130 also has three output leads 136, 137 and 138 which couple the output from amplifier 134 to electrical conductors on the flex circuit 108 to supply photodiode sensor signals to the controller 35, via electronics on the carriage 40 and the multi-conductor flex strip 46. Preferably, the photodiode 130 is received within a diode mounting chamber 140 defined by the casing 102. While a variety of different photodiodes may be used, one preferred photodiode is a light-to-voltage converter, which may be obtained as part no. TSL255, from Texas Instruments of Dallas, Tex.

Preferably, the casing 102 is formed with a spring tab 142 extending downwardly into chamber 140. The spring tab 142 contacts the external casing of the photodiode amplifier 134 to push the photodiode 130 against a pair of alignment walls 144, which define a passageway 145 therethrough. The passageway 145 couples the diode receiving chamber 140 with a focusing chamber 146. The lower portion of casing 102 defines a photodiode input aperture 148 therethrough which couples chamber 146 to a portion of the lens assembly 110. Thus, light from the lens assembly 110 passes on an inbound path through aperture 148, chamber 146, passageway 145, into the photodiode lens 135 to land on the photocell 132. Preferably, the casing 102 is constructed so that the LED chamber 112 is optically isolated from the photodiode chambers 140, 146 to prevent light emitted directly from the blue LED 120 from being perceived by the photocell 132. Thus, the outbound light path of the LED 120 is optically isolated from the inbound light path of the photodiode 130.

As shown in FIG. 2, to couple the LED leads 126, 128 and the photodiode leads 136–137 to the conductors of the flex circuit 108, the cover 104 preferably defines a slot 150 therethrough for the LED leads 128–126 and another slot 152 for the photodiode leads 136–138. To separate the photodiode leads 136, 137 and 138 from one another, preferably the cover 104 defines a recess 154 for receiving lead 137, with the recess being bounded by two notches, with one notch 156 separating leads 136 and 137, and another notch 158 separating leads 137 and 138. It is apparent that the LED lead slot 150 may also be configured with similar notches and recesses if desired to separate lead 126 from lead 128. The sizing and placement of the LED lead slot 150 and the photodiode lead slot 152, as well as their attachment to conductors of flex circuit 108, assist in accurately aligning both the LED 120 and the photodiode 130 for accurate relative alignment and orientation of the optical components, specifically, the LED output lens 125 and the photodiode input lens 135.

Figure 4:
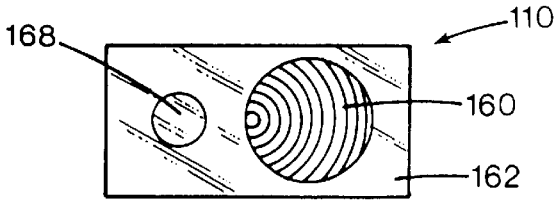
FIG. 4 is top plan view of one form of a lens assembly of the monochromatic optical sensor of FIG. 2.
Figure 5:
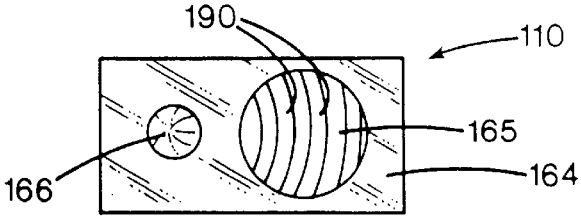
FIG. 5 is bottom plan view of the lens assembly of FIG. 4.
Figure 6:
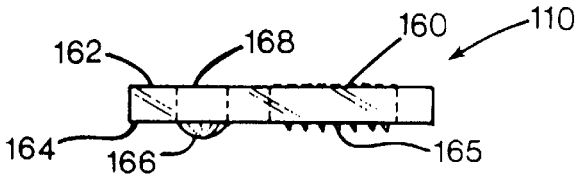
FIG. 6 is side elevational view of the lens assembly of FIG. 4.

FIGS. 4–6 illustrate the construction of the lens assembly 110 which may be made of an optical plastic material molded with lens elements formed therein. FIG. 4 shows a diffractive lens element 160 formed along a top surface 162 of the lens 110. The diffractive lens 160 is located directly beneath the LED output aperture 114 which extends through the casing 102. FIG. 4 illustrates a bottom view of the lens assembly 110 which has a bottom surface 164 facing down toward the printed media. Opposite the diffractive lens 160, the lower surface 164 has a Fresnel lens element 165. FIG. 6 best shows a photodiode lens element 166 projecting outwardly from the lower surface 164. Preferably, the lens 166 is a convex aspheric condenser lens. FIG. 4 illustrates an upper or output lens element 168 of the photodiode lens, which is directly opposite the input portion 166. While the output element 168 may be a flat extension of the upper surface 162 of the lens 110, in some embodiments, contouring of the upper surface 168 may be desired to improve the optical input to the photodiode lens 135. Preferably, the photodiode output element 168 is also a diffractive lens, which may be constructed as described above for the upper diode lens element 160 to provide correction of chromatic aberrations of the primary input lens element 166.

Figure 7:
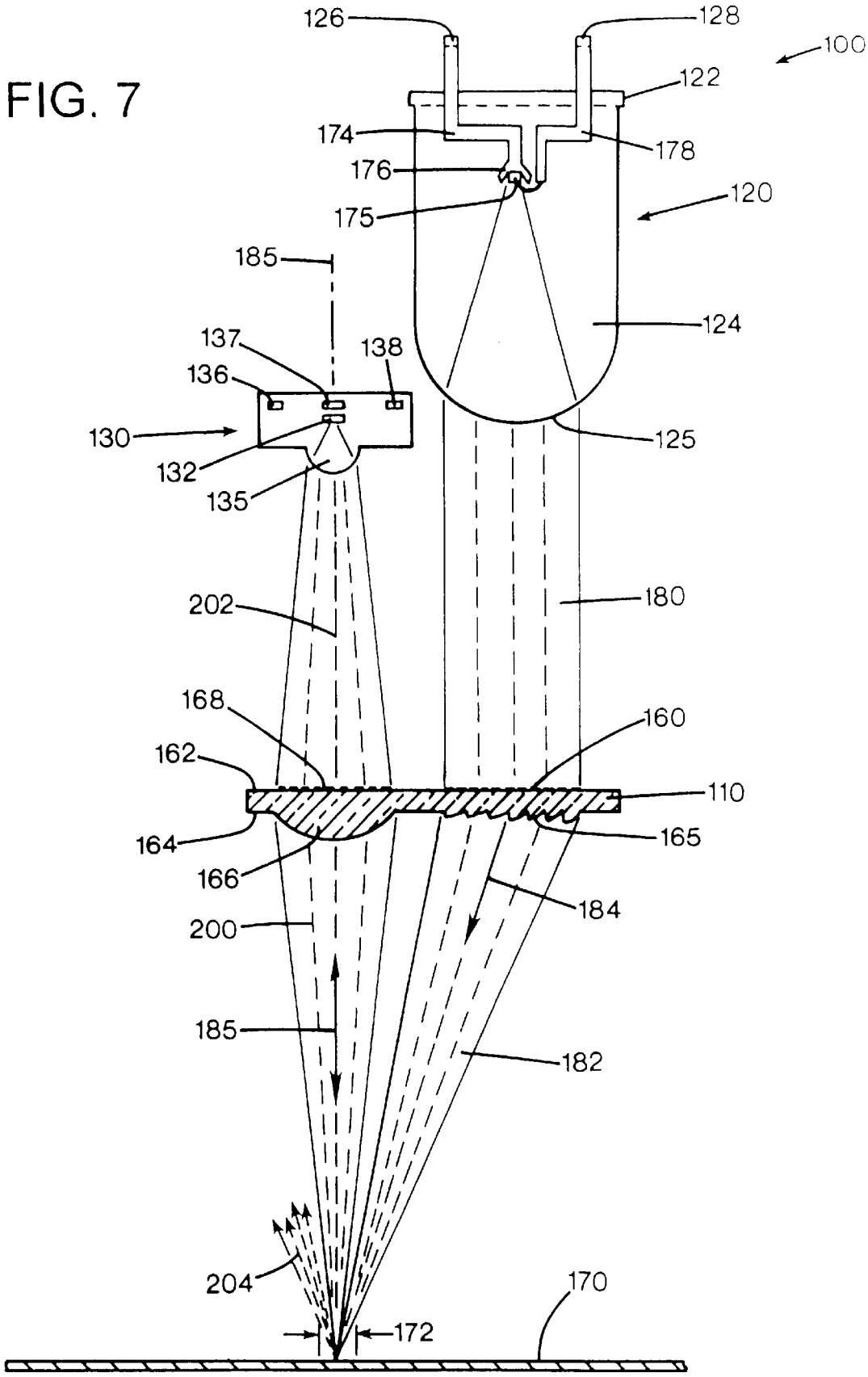
FIG. 7 is a schematic side elevational view illustrating the operation of the monochromatic optical sensor of FIG. 2.

FIG. 7 illustrates the operation of the blue LED 120 and the photodiode 130 when illuminating a sheet of media 170 at a selected region 172. The internal components of the blue LED 120 are also illustrated in FIG. 7. The LED 120 includes a negative lead frame 174 which is electrically coupled to the conductor 126. The LED 120 also has a die 175 mounted within a reflector cup 176, which is supported by the negative lead frame 174. The die 175 is used to produce the blue wavelength light emitted by the LED when energized. A positive lead frame 178 is electrically coupled to conductor 128, and serves to carry current therethrough when the blue LED 120 is turned on. Preferably, the negative lead frame 174, the die 175, cup 176, and the positive lead frame 178 are all encapsulated in a transparent epoxy resin body which is conformed to define the output lens 125 as an integral dome lens that directs light from the die 175 into rays which form an illuminating beam 180.

The LED portion of the lens assembly 110, including elements 160 and 165, serves to deflect, focus and diffuse the LED output beam 180, and to direct a resulting modified LED beam 182 toward the illuminated region 172 on media 170. To accomplish this action, the Fresnel lens 165 along the lower surface 164, is an off-axis element having an optical axis 184 that is coincident with a central axis 185 of the photodiode 130, with this coincidence between axes 184 and 185 occurring in the illuminated region 172. Additionally, the Fresnel lens 165 also has a focal length which is approximately equal to half the distance between the Fresnel lens 165 and the printing plane of the media 170. The diffractive lens element 160 diffuses the LED output beam 180, while the Fresnel element 165 redirects the diffused beam to arrive at the modified beam 182. Specifically, the Fresnel lens 165 laterally deflects the incoming beam 180 through a prismatic action, which permits the LED lamp 120 to be closely mounted to the photodiode 130 to provide a compact package for the monochromatic optical sensor 100. Furthermore, the prismatic function of the Fresnel lens 165 also partially focuses the modified beam 182 to a small selected region 172, while the diffractive lens 160 diffuses the light beam 180 in a controllable fashion to provide the desired illumination at region 172.

The diffractive lens 160 preferably has a multitude of closely spaced ridges that are each spaced apart to provide an interference effect so that a passing beam is effectively steered to a selected direction. By steering different portions of the incoming beam 180 by different amounts, this steering has a focusing effect for the modified beam 182. By introducing a slightly angular offset in random or selected regions of the diffractive lens 160, a focused image may be slightly jumbled or scrambled without loss of efficiency to diffuse the output beam 182. The cooperation of the diffractive lens 160 and the Fresnel 165 is shown in detail in FIG.8.

Figure 8:
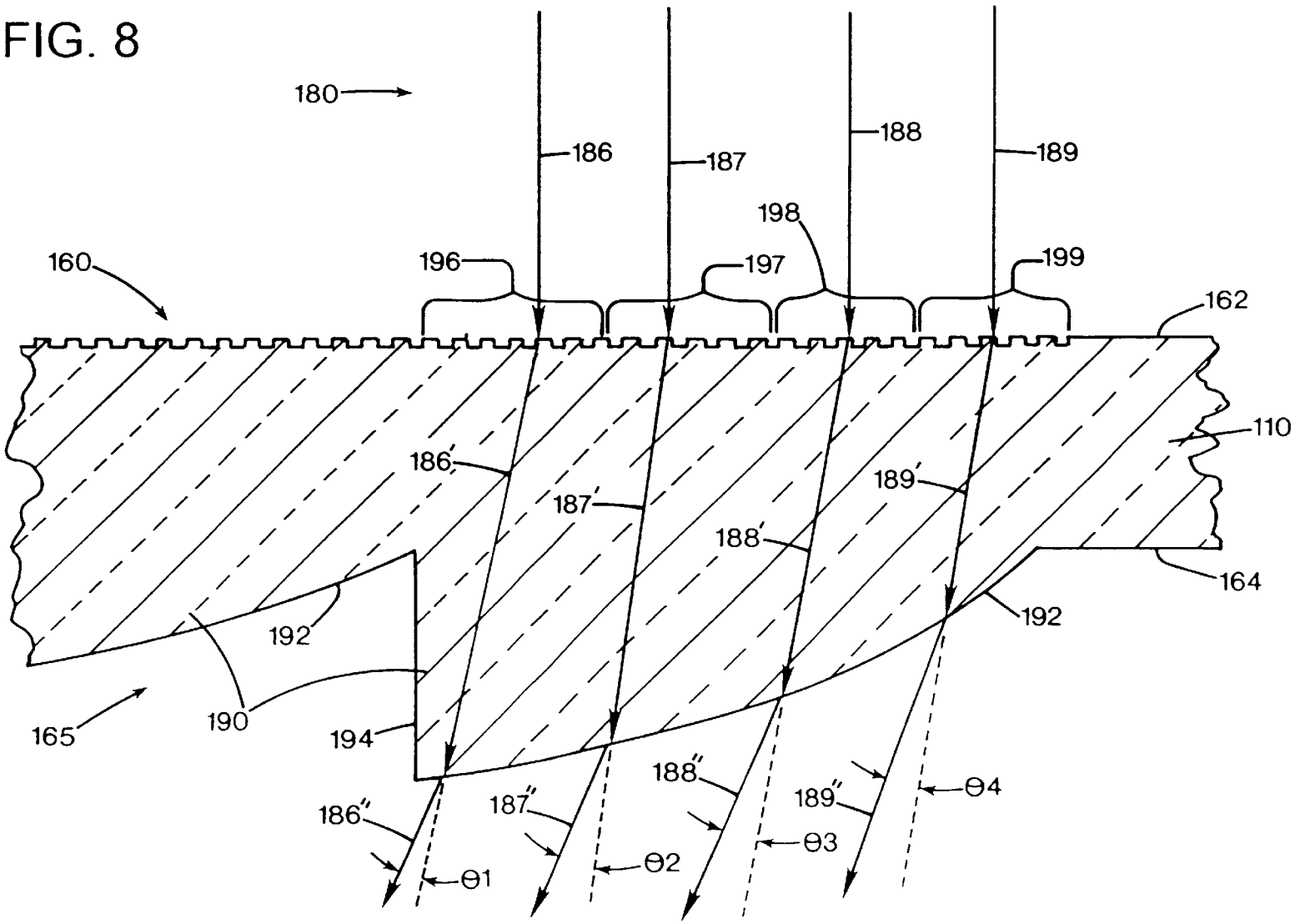
FIG. 8 is an enlarged, sectional view of a portion of the lens assembly of FIG. 4, illustrating the operation thereof.

FIG. 8 illustrates four incoming substantially parallel beams 186, 187, 188, and 189 of the LED output beam 180, which travel through the lens assembly 110 as beams 186', 187', 188', 189', then exit assembly 110 as beams 186", 187", 188", 189", respectively. The beam segments illustrated were selected to intercept one of plural crests 120 (see FIG. 5) upon exiting the Fresnel lens element 165. Each crest 120 has an downward arced surface 122 which terminates at a vertical wall 124, which is substantially parallel with the incoming beam segments 186–189.

The illustrated diffractive lens 160 comprises a group of diffractive cells 126, 127, 128 and 129, each shown redirecting one of the incoming beams 186–189 into beams 186'–189' which travel through the body of the lens 110. The curved arrangement of the cells 126–128 is shown in the top plan view of FIG. 4, with the curved aspect of these cells serving to begin directing the light beams toward the location of interest 172 on media 170 (FIG. 7), to the left in the view of FIG. 8. Besides this redirecting function, the diffractive lens element 160 also diffuses the beams to hide any irregularities in the lens element.

Preferably, each cell 126–129 comprises a group of finely ruled grooves that each have a slightly different pitch and orientation. By varying the pitch and orientation of the grooves, each cell 126–128 defracts the light rays 186–189 by a selected offset angle so the resulting rays 186"–189" exiting the lens are scrambled. This scrambling or diffusion of the rays is shown slightly exaggerated in FIG. 8, where the substantially parallel incoming beams 186–189 are no longer substantially mutually parallel as they travel through the lens as beams 186'–189'. While a simple offset using a controlled angle of about 0.5° in random directions may have an acceptable diffusing effect, preferably each cell 126–129 is carefully "programmed" that is, configured, to steer some of the rays 186'–189' more than others. This programmed diffusing effect tends to cancel out non-uniformities in the illumination pattern of the LED 120.

When passing through the Fresnel lens element 165, the arced portion 122 of each crest 120 serves to deflect the beams 186'–189' at different angles, depending upon which portion of the arc 122 the beams intersect. For example, the exiting beams 186"–189" have angles of deflection shown as θ1, θ2, θ3, θ4, respectively, with θ1 being the least deflection, and then widening through θ2 and θ3, to the greatest deflection, θ4. Thus, the crests 120 of the Fresnel lens 165, shown in the bottom plan view of FIG. 5, also serve to further condense and redirect the incoming LED beam 180 to the left in the view of FIGS. 7 and 8.

Returning to FIG. 7, the modified light beam 182 is shown impacting the region of interest 172, and thereafter it is reflected off the media 170 as a diffuse reflectance light beam 200. The diffuse reflected light beam 200 has a flame-like scattering of rays arranged in a Lambertian distribution. Another portion of the incident light beam 182 is reflected off of the illuminated region 172 as a specular reflectance light beam 204. The specular beam 204 leaves the sheet 170 at the same angle at which the incident light beam impacts the sheet 170 according to a well known principle of optics: "The angle of incidence equals the angle of reflection."

The diffuse reflected light beam 200 enters the convex lens 166 of the photodiode portion of lens 110. The illustrated convex aspheric condenser lens 166 is selected to focus essentially all of the diffuse reflected light 200 from region 172 into the photodetector 130, which is done in the illustrated embodiment with a focal length of approximately 5 mm (millimeters). It is apparent that in other implementations having different packaging and placements for sensor 100, that other focal lengths may be selected to achieve these goals. Preferably, the photodiode upper output lens 168 is molded with a diffractive surface, which advantageously corrects any chromatic aberrations of the primary convex input lens 166. Thus, the diffuse reflected light wave 200 is modified by the convex and diffractive portions 166, 168 of the photodiode portion of the lens assembly 110, to provide a modified input beam 202 to photodiode lens 135, which then focuses this input beam 202 for reception by the photocell 132.

Preferably, the blue LED 120 emits light 180 at a peak wavelength of 430–500 nm (nanometers). In the illustrated embodiment, the casing 102 with cover 104 attached together form a monochromatic optical sensor module, which has external dimensions comprising a height of about 23 mm, a thickness about 10 mm, and a width of about 14 mm. In the illustrated embodiment, the lower surface of lens 110 is spaced apart from the upper print surface of the media 170 by about 10 mm, so the selected area of interest 172 is about 1 mm in diameter. While the entire area of the selected region 172 is viewed by the photodetector 130, the area illuminated by the LED 120 is slightly larger, usually about two millimeters in diameter, assuring that the entire portion of the selected region 172 is illuminated by the blue light from LED 120.

Figure 9:
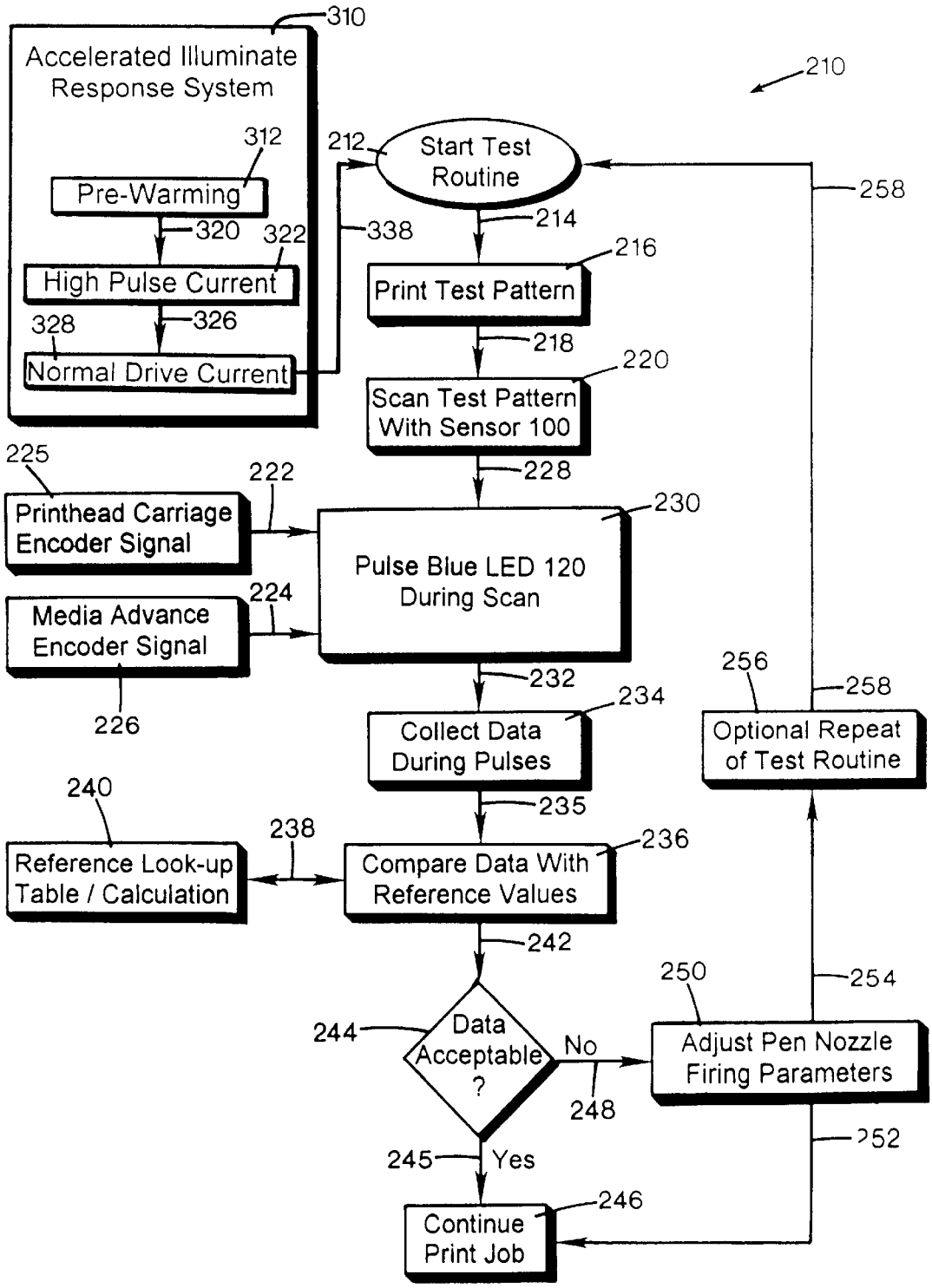
FIG. 9 is a flow chart of one manner of operating the monochromatic optical sensing system of FIG. 2.

In operation, FIG. 9 shows a flow chart illustrating one manner of operating a monochromatic optical sensing system 210 constructed in accordance with the present invention as including the monochromatic sensor 100 installed in printer 20. After an operator initiates a start test routine step 212, perhaps in response to prompting by the printer driver portion of controller 35, a start test signal 214 is sent to a print test pattern portion 216 of the system 210. The test pattern portion 216 then fires the nozzles to eject ink from one or more of the printheads 70–74 to print a test pattern on the media 170. For example, the printer controller 35 sends firing signals to the pens 50–56, causing the pens to print two patterns of parallel bars of each color, with one set of parallel bars being Parallel with the scan axis 38, and of the other group of parallel bars being perpendicular to the scan axis 38. Upon completion of printing the test pattern, the test pattern portion 216 delivers a completion signal 218 to a scan test pattern with sensor portion 220 of system 210. After printing this test pattern, the carriage 40 again moves across the printzone 25, and the media sheet 170 is fed through the printzone by operation of the media advance motor 27 so the monochromatic sensor 100 passes over each pattern.

During this test pattern scan, the printer controller 35 uses inputs signals 222 and 224 from the printhead carriage position encoder 225 and the media advance encoder 226, respectively. To initiate the scan, the scan test pattern portion 220 sends a permission to pulse signal 228 to a pulse blue LED during scan portion 230 of the system 210. The encoder signals 222 and 224 are used to determine the timing of the LED pulses, as described below with respect to FIG. 10. It is apparent that other timing mechanisms may be used to pulse the LED 120, for instance, by pulsing on a temporal basis such as at a 1000 Hertz frequency during carriage or media movement, without using the carriage and/or media encoder signals 222 and 224. The pulses of portion 230 are used to generate a data acquisition signal 232 for a collect data during pulses portion 234 of system 210, which then transfers a scanned data signal 235 to compare data with reference values portion 236. In reviewing each pattern, the sensor 100 sends a variable voltage signal comprising signal 235 to the controller 35 to indicate the presence of ink printed within the field of view, such as region 172 in FIG. 7.

The printer controller 35 tracks locations of the test markings, and using portion 236 compares a desired location or parameter signal 238, stored in a reference look-up table or calculation portion 240, with the actual location or parameter monitored by the sensor 100, as represented by the data signal 235. Using the input sensor data of signal 235, the controller 35 calculates the actual position of each test pattern relative to the ideal desired position, and when required, the controller 35 enacts a compensating correction in the nozzle firing sequence for subsequent printing operations. The comparison portion 236 generates a resultant signal 242 which is delivered to a data acceptance portion 244. If the data is acceptable, then the acceptance portion 244 sends a YES signal 245 to a continue print job portion 246 which allows printing to commence using the current nozzle firing parameters.

When a test mark on the media 172 is found at a location other than the desired location, or when a parameter is beyond desired limits, the acceptance portion 244 delivers a NO signal 248 to an adjust pen nozzle firing parameters portion 250 of the printer controller 35, which then determines that a pen alignment or correction of the nozzle firing sequence is required. Following this correction by portion 250, a continue signal 252 may be sent to the continue print job portion 246. Optionally, following completion of the nozzle firing adjustment, portion 250 may send a repeat signal 254 to an optional repeat of test routine portion 256 of the monitoring system 210. Upon receiving signals 254, the repeat test portion 256 generates a new start signal 258 which is delivered to the start test routine portion 212 to reinitiate the monitoring system 210.

This scanning process involves activation of the blue LED 120 to emit the light beam 180, which is defracted or scrambled, i.e., diffused, by the diffractive lens element 160, and then refracted and focused through the Fresnel lens 165. The diffraction occurs at different amounts so the majority of the modified rays 182 fall within the selected region of interest 172. Light impinging upon the selected region 172 has a specular reflection, illustrated as beam 204 in FIG. 7, that is reflected away from the optical axis of the aspheric element 166, due to the off-axis position of the LED lens elements 160, 165 of assembly 110. The highly modulated diffuse reflection from the selected region 172 is captured by the photodiode lens 166, which, in cooperation with the optional diffractive portion 168, concentrates the reflective beam 200 into an input beam 202 supplied to the photodiode 130. As mentioned above, the photodiode 130 includes an amplifier portion 134, which amplifies the output of the photocell 132 and then sends this amplified output signal via conductors 136–138 to the controller 35 for analysis.

Figure 10:
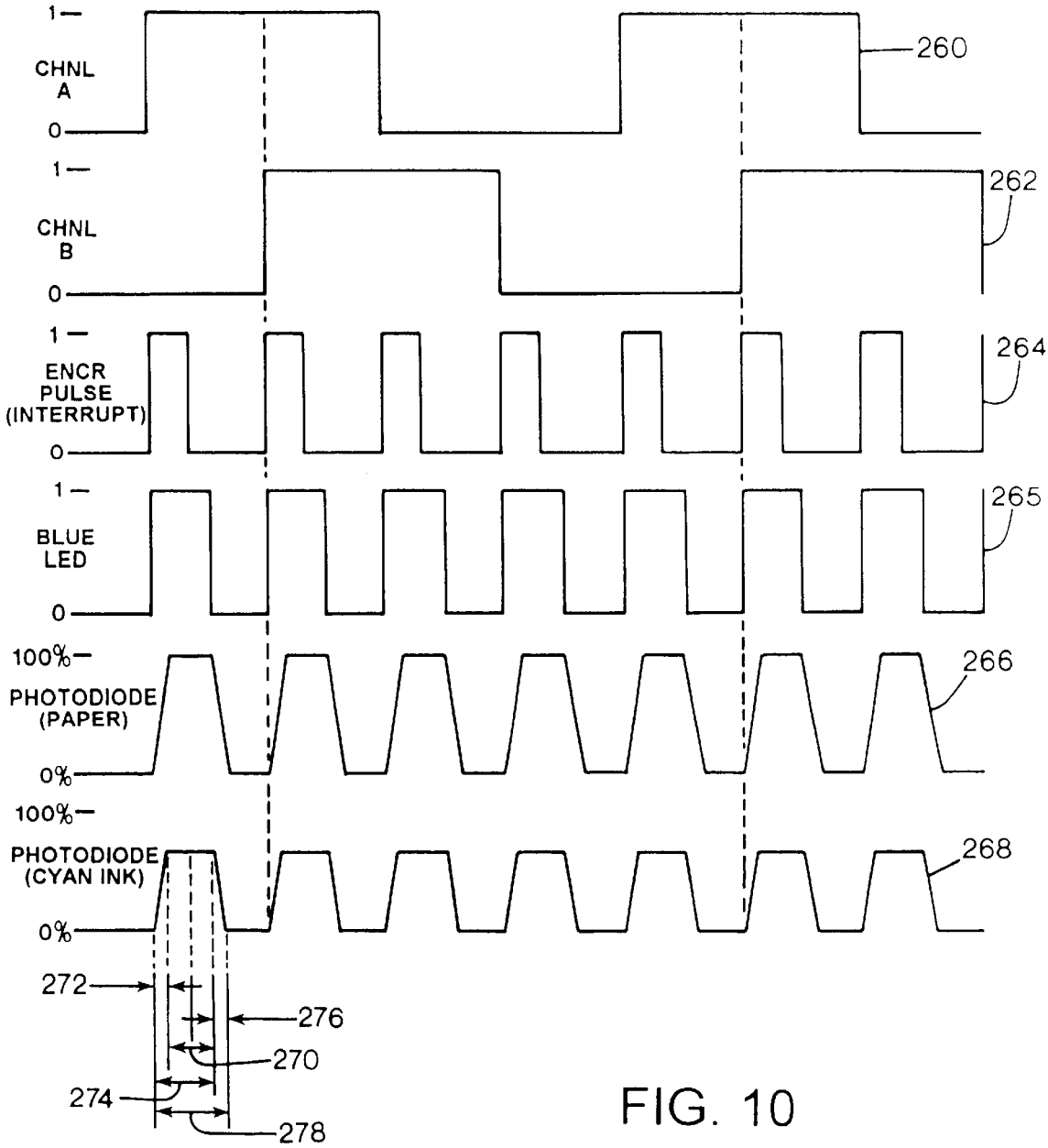
FIG. 10 is a signal timing diagram graphing the timing and relative amplitudes of several signals used in the monochromatic optical sensing system of FIG. 2.

As illustrated in FIG. 10, the controller 35 then accumulates each data point during a data window, which is preferably provided by energizing the blue LED 120 in a pulsed sequence. In FIG. 10, curves 260 and 262 show channel A ("CHNL A") and channel B ("CHNL B") as representing the transition of the positioning encoder on carriage 40, which may detect positional changes by monitoring the encoder strip 45 in a conventional manner. The channel A and B square waves 260, 262 then comprise the input signal 222 in the FIG. 9 flow chart. If the media advance is being scanned, then the channel A and B square waves 260, 262 represent the transition of the rotary position encoder for the media drive roller during media advancement through printzone 25 by operation of the media drive motor 27. Alternatively, this input may be supplied as a stepped output from motor 27, provided motor 27 is a stepper-type motor. Preferably, a rotary position encoder determines the angular rotation of the media drive component, with a rotary encoder reader providing the input shown as the channel A and B waves 260, 262, which together then comprise signal 224 in FIG. 9. When either the carriage or the media advance encoder changes state, these transitions, which are the vertical portions of curves 260 and 262, may be combined to generate an encoder pulse or interrupt signal, shown in FIG. 10 as curve 264. Each transition of curve 264 between zero and one may serve as an initiation signal for beginning a data acquisition sequence for the sensor 100.

The timing of the illumination of the blue LED 120 is shown in FIG. 10 as curve 265, with the numeral zero indicating an off-state of the LED, and numeral one indicating on-state. For convenience, curves 260–265 have been drawn to illustrate illumination with a 50% duty cycle on the LED 120, that is, the blue LED 120 is on for half of the time and off for the remaining half. It is apparent that other duty cycles may be employed, such as from 10–50% depending upon the scanning of carriage 40 and the advance of media sheet 170 through the printzone 25. Advantageously, pulsing the blue LED 120 with the illustrated 50% duty cycle obtains nearly twice the luminate intensity obtained using the HP '002 and '014 LEDs which were left on full time, as described in the Background section above.

In FIG. 10, curve 266 indicates the output of the photodiode 130 when the illuminated region 172 has no ink printed, so curve 266 indicates sensor 100 being focused on plain white paper. Thus, the maximum amplitude of signal 266 is shown as 100%, which provides a reflective luminosity reference for bare media to the controller 35 for the particular type of media 170 being used in the test process. For instance, brown paper would have less luminosity than white paper leading to a lower magnitude of light reaching the photodiode 130, yet, curve 266 still would be considered as a 100% no-ink reference by controller 35. Curve 268 illustrates the reflectance of cyan ink, when a cyan droplet appears in the illuminated region 172. Cyan ink has a reflectance of approximately 60% that of plain white paper, as illustrated by the lower magnitude of curve 268 when compared to the no-ink media curve 266.

The monitoring cycle during which controller 35 collects data is illustrated near the bottom of FIG. 10. Here, a data acquisition window 270 during which controller 35 monitors input from sensor 100 begins after a rise time 272. This rise time 272 begins at the initiation of a pulse of the LED 120, and ends after a known rise time of the photodiode 130, which may be obtained from the manufacturer specifications for the particular photodiode used. The LED 120 remains illuminated for a pulse 274 (at a value of "1") for the duration of the desired pulse width, as also illustrated by the curve 265, after which the LED is turned off (value of "0"). The time between the end of the rise time 272 and when the blue LED 120 is turned off, defines a data acquisition window 270. At the end of data acquisition window 270, the monitoring cycle is not yet complete because after turning off the LED 120, the photodiode 130 needs a stabilizing fall time 276. Thus, a total cycle time 278 of the sensor 100 starts at the beginning of the pulse to the LED 120, and then concludes at the end of the photodiode fall time 276, that is, the total cycle time equals the duration of the data acquisition window 270 plus the rise and fall times 272, 276 for response of the photodiode 130. Upon completion of this monitoring cycle 278, the sensor 100 remains dormant until the next encoder state change, as indicated by curve 264. During the data acquisition window 270, an A/D converter within the controller 35 is enabled and allowed to acquire the output signal of photodiode 130, as supplied via conductors 136–138.

The duty cycle of the blue LED 120, illustrated by curve 265 in FIG. 10, is dependent upon the desired forward current, that is the illumination level, and the speed at which the carriage 40 is scanned, or the speed at which the media 170 is advanced while the carriage is scanning across printzone 25. The speed of the media advance and the carriage dictates the allowable pulse width duration given the desired forward current. The relationship between the pulse width and the diode current is dependent upon thermal characteristics of the particular diode used, which are specified by the LED manufacturer. To maintain the spatial sampling and thermal control constraints of the blue LED 120, all scanning is preferably done at a constant specified velocity of the carriage 40 or the media drive motor 27, although it is apparent that other monitoring implementations may use variable or accelerating velocities while scanning.

Other print parameters may also be monitored by the monochromatic optical sensor 100 and adjusted by the controller 35 using method 210 illustrated in FIG. 9. For example, using the same sampling methodology, the monochromatic sensor 100 may also determine the color balance and be used to optimize the turn-on energy for each of the printheads 70–76. For example, to adjust color balance, regions of each primary ink may be printed, or a composite of overlapping droplets may be printed. A gray printed region, using all three color inks may also be suitable for such a color balance test pattern. By using the expected reflectance of the LED wavelength from the printed color as stored look-up table 240 of FIG. 9, and then comparing this expected reflectance with a measured reflectance in the comparison portion 236, the intensity of printing of a particular color may be determined and then adjusted by controller 35 to a desired level in step 250 of FIG. 9.

To measure the turn-on energy of the nozzles of printheads 70–76, swaths of printing test patterns may be made in step 216 of FIG. 9 using different amounts of energy applied to the firing resistors of each printhead 70–76. As the firing energy drops below a particular threshold, some of the printhead nozzles will cease to function, leaving no image on the media. By monitoring the energies at which drops were printed, and the locations at which the drops no longer appear on media 170, then in step 250, the controller 35 adjusts the turn-on energy for each nozzle by a limited amount above this threshold, so that only the minimal amount of energy required to print is applied to each resistor. By not overdriving the resistors with excessive power, resistor life is maximized without suffering any sacrifice in print quality.

Implementation of the monochromatic optical sensor 100 has recently become feasible for the more competitively priced home inkjet printer market. As mentioned in the Background section above, historically blue LEDs have been weak illuminators, and while brighter blue LEDs were available, they were prohibitively expensive for use in inkjet printers designed for home use. Recently, this pricing situation changed, and the bright blue LEDs have become available from several manufacturers. With this increased availability, competition in the market place has driven the price of these brighter blue LEDs down so quickly that at one point, a price decrease of 50% occurred over a two-month period of time. Thus, use of these brighter blue LEDs is now within the realm of consideration for the low volume, higher end products using the earlier HP '002 and '014 sensors. The advent of the monochromatic optical sensor 100, which eliminates the green LED of the HP '002 sensor, makes the use of optical sensors in home inkjet printers now feasible. Additionally, by employing the pulsed operation of the blue LED, as described above with respect to FIG. 10, this unique manner of driving the single blue LED 120 has further increased the light output of the sensor 100 by two to three times that possible using the earlier HP '002 and '014 sensors, where the LEDs always remained on during scanning.

Figure 11:
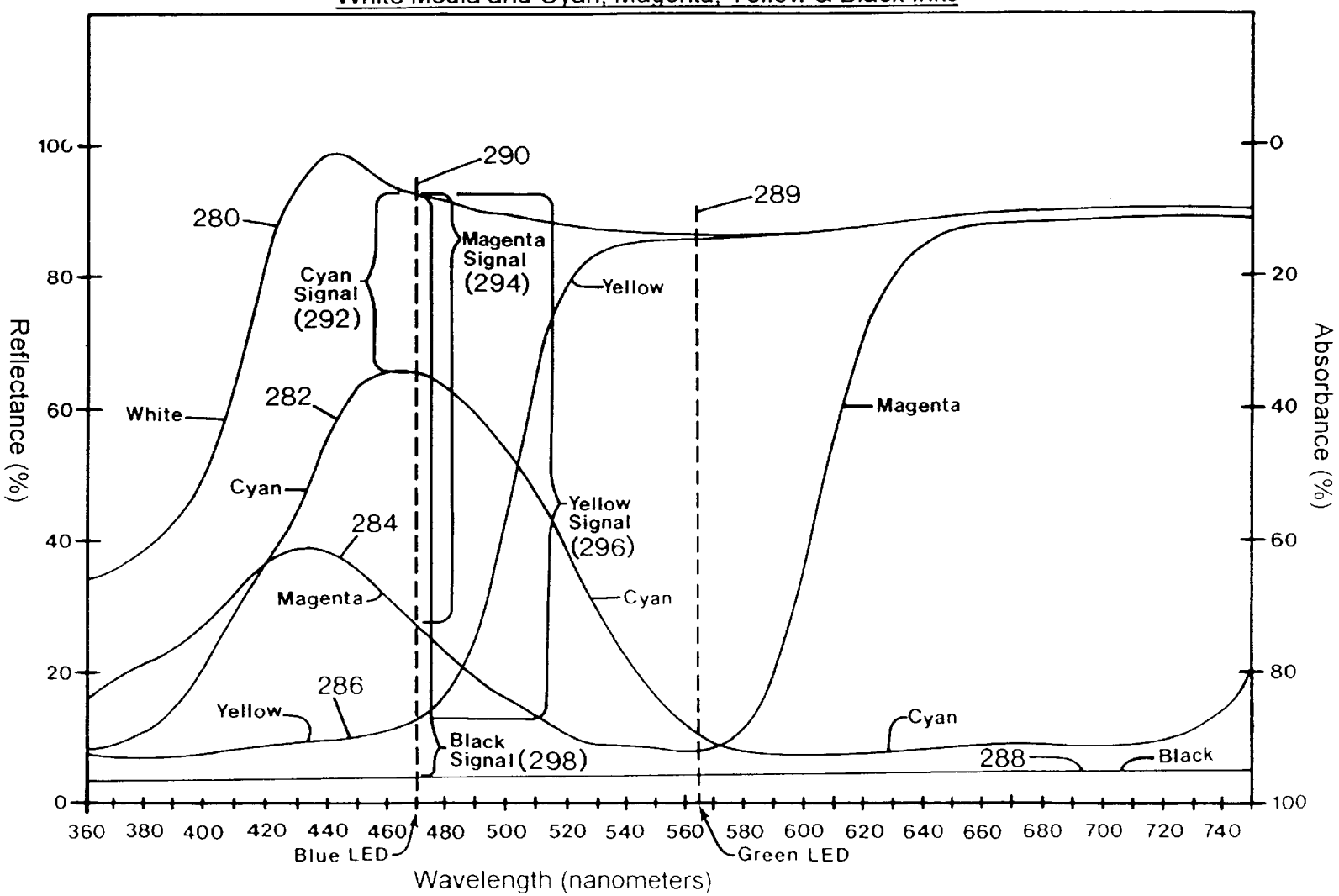
FIG. 11 is a graph showing the relative spectral reflectances and spectral absorbances versus illumination wavelength for white media, and cyan, yellow, magenta, and black inks, as well as the relative signal magnitudes delivered by the monochromatic optical sensing system of FIG. 2 when monitoring images printed on the media.

FIG. 11 is a graph of the spectral reflectance and absorbance by wavelength of the various primary colors of ink, black, cyan, magenta and yellow as well as that of white paper media 170. In FIG. 11, these reflectance and absorbance traces are shown as a white media curve 280, a cyan curve 282, a magenta curve 284, a yellow curve 286, and a black curve 288. In the past, the green LEDs emitted light at a wavelength of around 565 nm (nanometers), as illustrated at line 289 in FIG. 11. The blue LED 120 emits light at a peak wavelength of approximately 470 nm, as illustrated by a vertical line 290 in FIG. 11. By measuring at the illustrated 470 nm location, a separation between each of the ink traces 282–288 and media trace 280 is available. Indeed, monitoring anywhere between the 430 nm and 500 nm peak wavelengths provides quite suitable curve separations for ease of monitoring using the monochromatic sensor 100.

A few definitions may be helpful at this point, before discussing FIG. 11 in depth:

"Radiance" is the measure of the power emitted by a light source of finite size expressed in W/sr-cm$^2$ (watts per steradian—centimeters squared).

"Transmission" is measure of the power that passes through a lens in terms of the ratio of the radiance of the lens image to the radiance of the original object, expressed in percent.

"Transmittance" is a spectrally weighted transmission, here, the ratio of the transmitted spectral reflectance going through the lens, e.g. beam 182, to the incident spectral reflectance, e.g. beam 180 (FIG. 7).

"Specular reflection" is that portion of the incident light that reflects off the media at an angle equal to the angle at which the light struck the media, the angle of incidence.

"Reflectance" is the ratio of the specular reflection to the incident light, expressed in percent.

"Absorbance" is the converse of reflectance, that is, the amount of light which is not reflected but instead absorbed by the object, expressed in percent as a ratio of the difference of the incident light minus the specular reflection, with respect to the incident light.

"Diffuse reflection" is that portion of the incident light that is scattered off the surface of the media 170 at a more or less equal intensity with respect to the viewing angle, as opposed to the specular reflectance which has the greatest intensity only at the angle of reflectance.

"Refraction" is the deflection of a propagating wave accomplished by modulating the speed of portions of the wave by passing them through different materials.

"Index of refraction" is the ratio of the speed of light in air versus the speed of light in a particular media, such as glass, quartz, water, etc.

"Dispersion" is the change in the index of refraction with changes in the wavelength of light.

One important realization in developing the sensing system 210, using the monochromatic optical sensor 100, was that with a subtractive primary color system, cyan ink will never achieve the spectral reflectance of the paper upon which it is printed. Printing with the colors of cyan, yellow and magenta is considered to be a "subtractive" primary color system, as opposed to the combination of red, green, and blue which is considered to be an "additive" system, such as used to produce color images on television and computer screens. As seen in FIG. 11, the yellow curve 286 approaches the reflectance of the media curve 280 just to the right of line 289, whereas the magenta curve 284 approaches the media curve 280 around the 650 nm wavelength intersection point. The cyan curve 282 peaks at around 460 nm at a level of about 60% reflectance, which is far less than the reflectance of the media curve 280 at that point. Cyan ink will not reach the spectral reflectance of the media 170 for two reasons.

First, most paper is coated with ultraviolet fluorescing compounds which make the paper appear whiter by absorbing ultraviolet (uV) ambient light and then fluorescing this light back off the paper at slightly longer blue wavelengths. Since paper does not fluoresce from exposure to the blue spectrum of ambient or room light, the apparent reflectance of the ink, even if cyan ink had perfect transmittance, would never reach 100%. This difference, due to the fluorescing nature of the paper media 170, comprises a detection signal used by the controller 35, as discussed further below.

Second, the peak transmittance of cyan dyes is typically lower than ink with yellow or magenta dyes, and this transmittance never exceeds 80%, as seen from the curve 282 in FIG. 11. The currently available dye compounds which readily absorb longer wave length light, down to the green range of this desired spectrum, tend to continue to absorb light even within this blue transmissive range. Thus, adjusting the dye compounds in an effort to increase blue transmittance results in a corresponding decrease in the long wavelength absorption, for instance, as indicated at the 560–750 nm portion of the cyan curve 282 in the FIG. 11 graph. Therefore, inherent to the dye chemistry, a difference between the bare media reflectance and the cyan ink reflectance always exists. This difference in reflectance is what is exploited by the monochromatic optical sensor 100.

In the past, use of the green LED emitting light at a 565 nm wavelength allowed detection of cyan and magenta at their minimal reflectance (left scale of FIG. 11, which is also their maximum absorbance, as indicated by the scale to the right of FIG. 11.) Unfortunately, detection of yellow at the 565 nm wavelength proved to be a problem because the yellow reflectance approximated that of the white paper at this green LED wavelength. This problem was addressed by printing magenta ink over a previously printed yellow test band, with differing results depending upon the type of media being used, as discussed in the Background section above.

This yellow ink detection problem is avoided by monitoring the media and ink droplets when illuminated at the 470 nm peak wavelength of the blue LED 120, because the signals used by the controller 35 are the absorbance of these inks relative to the absorbance of the media 170. Indeed, yellow ink may be easily detected between the 430 nm and the 500 nm peak wavelengths. As seen in FIG. 11, at the 470 nm wavelength of the blue LED 120, the ink curves 282–288 are each separated in magnitude from one another. While the illustrated blue LED emits a 470 nm wavelength, this value is discussed by way of illustration only, and it is apparent that other wavelengths of monochromatic illumination may also be used to exploit any other points on the graph where there is adequate separation of the ink curves 282–288 to allow detection and differentiation between the colors, including ultraviolet or infrared wavelengths. In the illustrated embodiment, the absorbance of the cyan ink produces a cyan signal 292, which is the difference between the absorbance of the cyan ink and the media when illuminated at a 470 nm wavelength. Similarly, a magenta signal 292, a yellow signal 296, and a black signal 298 are each produced as the difference between the absorbance of each of these inks and the absorbance of media 170 when illuminated at 470 nanometers by the blue LED 120. Thus, the cyan signal 292 is a difference of approximately 30%, the magenta signal 294 is approximately 70%, the yellow signal 296 is approximately 80%, and the black ink signal is approximately 90%.

As another advantage, there is a mutual relationship between the intensity of the illumination at location 172 (FIG. 7) and the source of noise in the resulting signals sent to the controller 35. With all other factors being equal, the noise produced by the photodiode 130 is a function only of the pulsing frequency of the blue LED, which then increases by the square root of the signal frequency. Increased intensity, however, does not increase the noise. Thus, pulsing of the LED 120 is an efficient way to increase the intensity of beam 180 and the signal-to-noise ratio. While the noise will increase with increases in the pulsing frequency, the level of the signal increases at an even greater rate. At moderate pulsing frequencies, such as those around one to four Kilo-Hertz, the benefits of the larger signal greatly outweigh the disadvantages of the increased noise. Thus, this pulsed driving scheme for illuminating the media with LED 120, and the data sampling routine illustrated above with respect to FIGS. 9 and 10, efficiently and economically allows monitoring of drop placement on the media in an automatic fashion by the printer 20 without user intervention.

Figure 12:
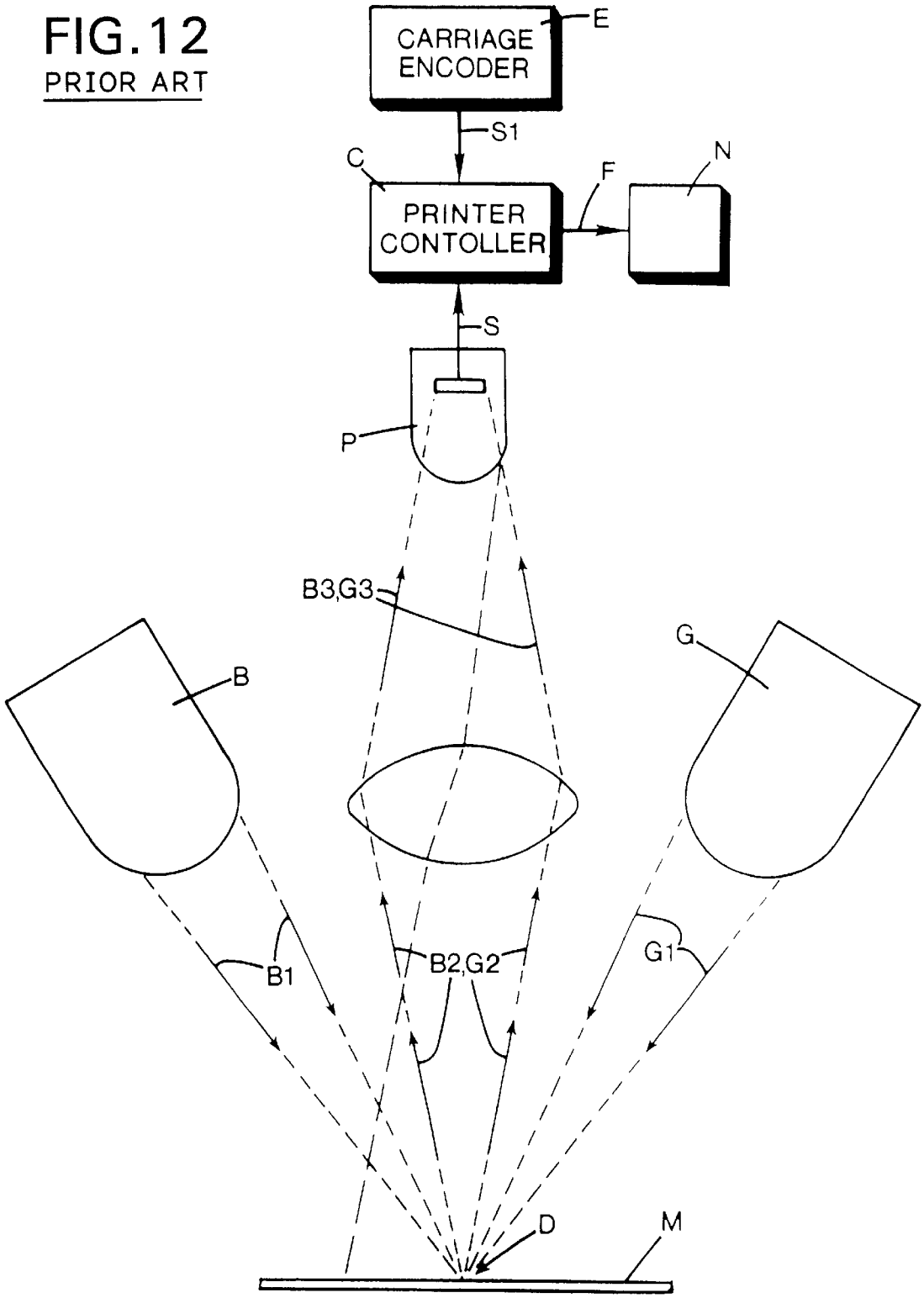
FIG. 12 PRIOR ART
FIG. 12 is a schematic diagram illustrating the prior art monitoring system using the HP '002 optical sensor, discussed in the Background section above.

Advantageously, elimination of the green LED(s) required in earlier HP '002 and '014 sensors (see FIG. 12)

reduces the direct material cost of the sensor by 46–65 cents per unit for the monochromatic optical sensor 100. Moreover, by eliminating the green LED, the sensor package is advantageously reduced in size by approximately 30% compared to the HP '002 sensor. The reduced size and weight of the monochromatic sensor 100 advantageously lightens the load carried by carriage 40 during scanning and printing. Furthermore, elimination of the green LED used in the earlier HP '002 and '014 sensors requires less cable routing between the controller 35 and the sensor 100. Additionally, by pulsing the blue LED 120 rather than leaving it on for the full scanning pass, advantageously provides a greater input signal level to the photodiode 130, which then allows simpler signal processing at a greater design margin than was possible with the earlier HP '002 and '014 sensors. Finally, assembly of the monochromatic optical sensor 100 is simpler than the earlier HP '002 and '014 sensors because fewer parts are required, and elimination of the green LED also eliminates the possibility of mis-assembly, where the blue and green LEDs could inadvertently be mounted in the wrong locations within the sensor packaging.

With the increased intensity provided by pulsing the blue LED, an intensity of up to approximately 3600 mcd is obtained using the blue LED 120, as compared to an intensity of 15 mcd produced by the earlier blue LEDs used in the HP '002 sensor. With this increased intensity of the monochromatic sensor 100, none of the signal enhancing techniques used in the earlier HP '002 and '014 sensors, such as a 100× amplifier, AC coupling of the output signal, and a ten-bit A/D converter, are all eliminated with monochromatic sensor 100. Indeed, the sensor 100 may be coupled directly to an A/D converter, which preferably occupies a portion of the application specific integrated circuit (ASIC) provided within the printer controller 35. Furthermore, by implementing a multiplexing signal transfer strategy between the sensor 100 and the controller 35, the cost of the A/D converter and the ASIC is further reduced.

Use of the diffractive lens technology in constructing element 160, and optionally in element 168 of the lens assembly 110, advantageously decreases the overall size of the optical package of sensor 100. Further reductions in package size of the casing 102 and cover 104 are gained by eliminating the green LED, so the monochromatic sensor 100 is roughly 30% of the size of the HP '002 sensor (see FIG. 12), and approximately 70% the size of the of the HP '014 sensor, both described in the Background section above.

Furthermore, use of the monochromatic optical sensor 100 avoids the use of ink mixing to determine the location of some inks, as was practiced using the HP '014 sensor described in the Background section above. Now sensing of dot placement is no longer dependent upon the type of media used, because the monochromatic sensor 100 accurately registers the location of a droplet, whether placed on a high-gloss photographic quality paper, or a brown lunch sack, or any type of media in between. This is possible because the monochromatic sensor 100 detects the fundamental spectral properties of each of the primary colors, black, cyan, magenta and yellow.

Additionally, by pulsing LED 100 during the duty cycle, the blue LED may be driven at a higher current level during the LED on-time 274 in FIG. 10, and then allowed to cool during the remainder of the time between pulses of curve 266. Thus, the average current over time for the entire period is the same as the DC value, but the peak current during the on-segment 274 leads to a higher peak illumination when LED 120 is pulsed. Thus, pulsed operation of the blue LED 120 obtains greater illumination using a more economical LED, resulting in an energy savings as well as a material cost savings without sacrificing print quality, all of which benefit consumers.

Basic Media Type Determination System

Figure 13:
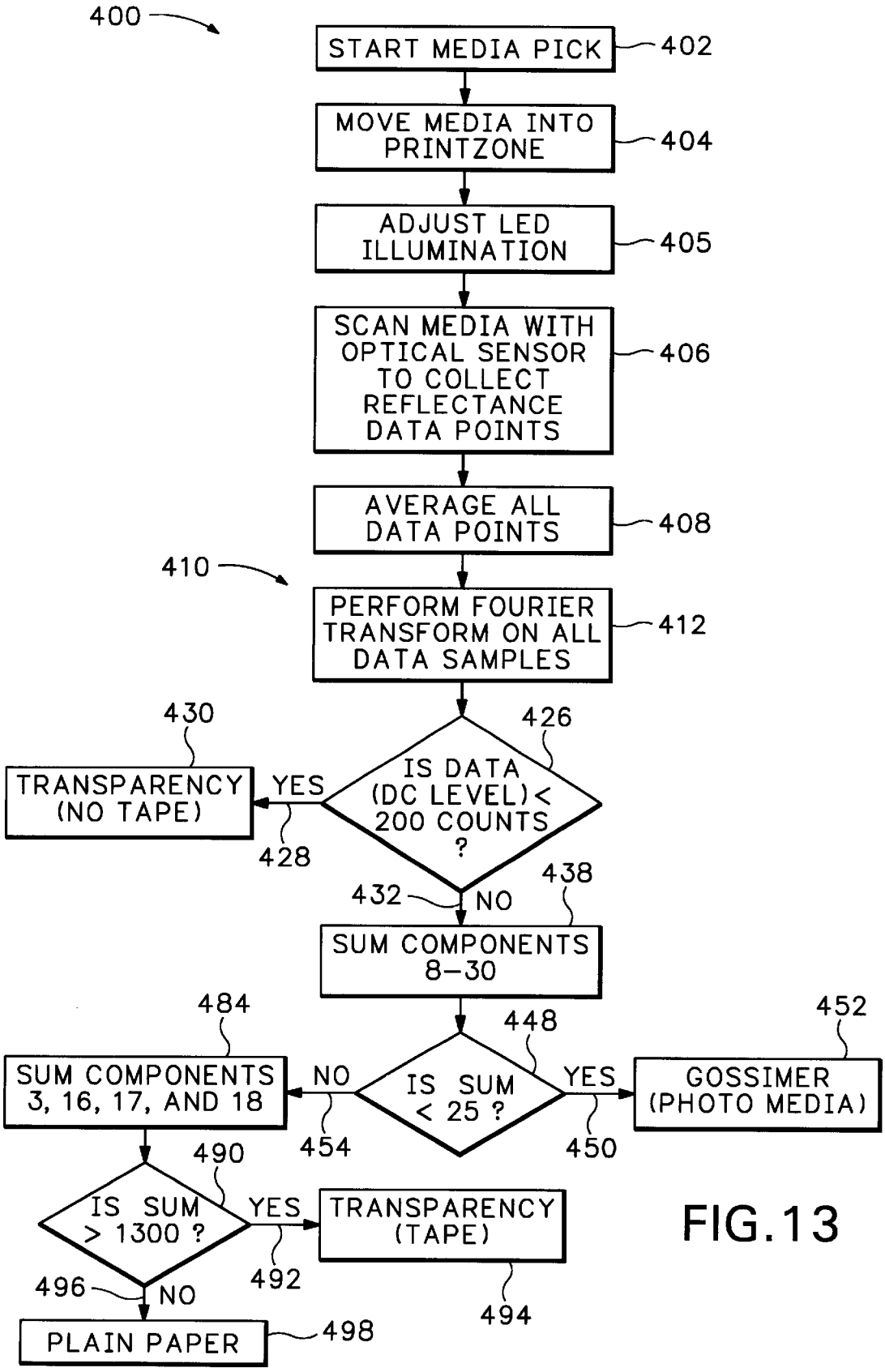
FIG. 13 is a flow chart illustrating the manner in which the monochromatic optical sensor of FIGS. 1–10 may be used to distinguish transparency media without tape, GOSSIMER photo media, transparency media with a tape header, and plain paper from each other.

FIG. 13 illustrates one form of a preferred basic media type determination system 400 as a flow chart, constructed in accordance with the present invention, which may be used in conjunction with either the monochromatic optical sensor 100 of FIGS. 2–9. The first step of this media-type determination method 400 consists of starting the media pick routine 402 where a fresh sheet of media is picked by the media handling system from the input tray 26. This fresh sheet of media is then moved into the print zone in step 404. After the media pick routine is completed, the blue LED 120 of the optical sensor 100 is illuminated, and in step 405 this illumination is adjusted to bring the signal received from an unprinted portion of the media up to a near-saturation level of the analog to digital (A/D) converter, which is on the order of 5 volts.

Figure 14:
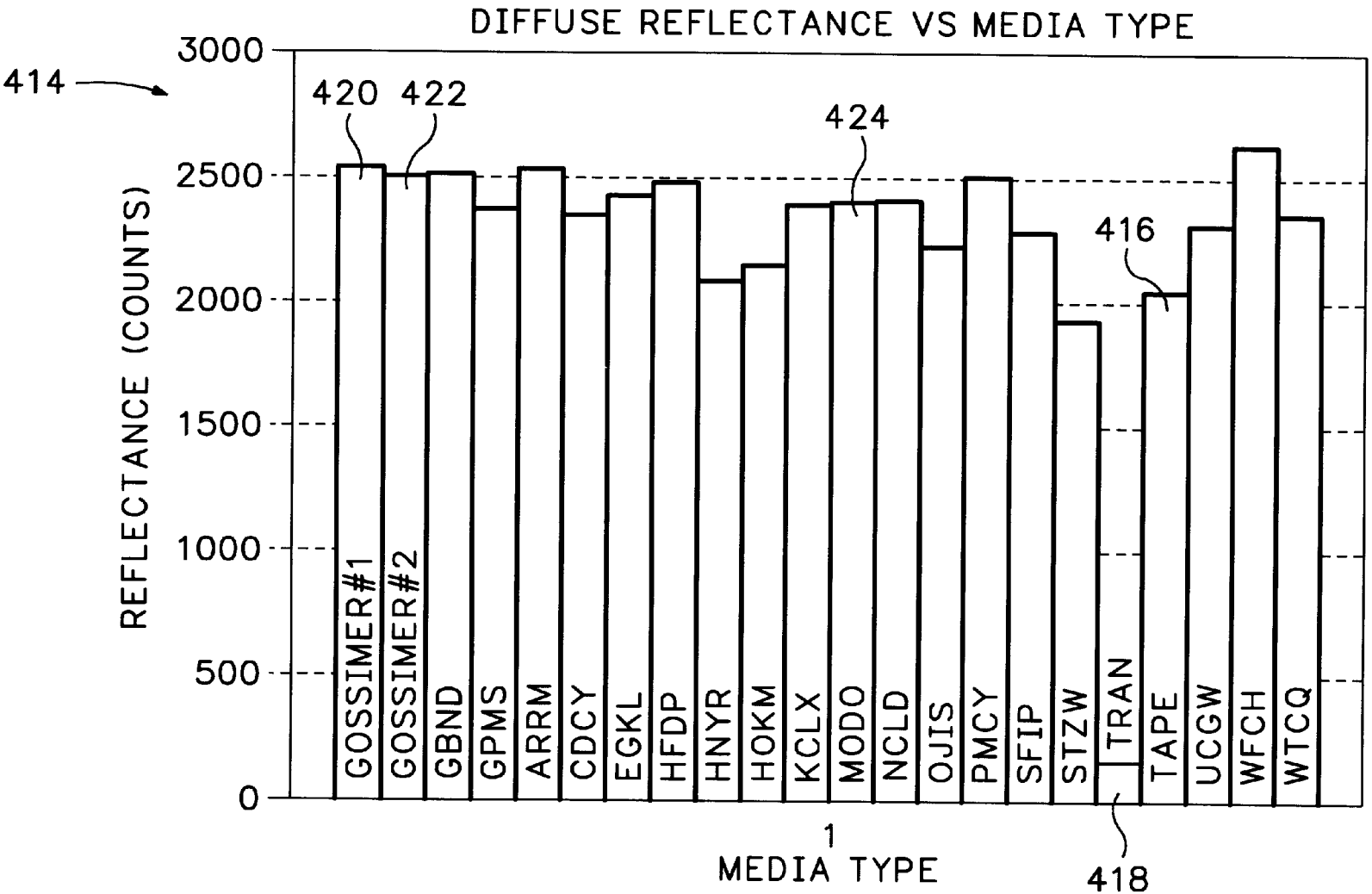
FIG. 14 is a graph of the high-level diffuse reflectance versus media type for all plain papers, including an entry for transparencies ("TRAN") and one without the tape header, labeled "TAPE," as well as GOSSIMER photo papers, labeled "GOSSIMER#1 and GOSSIMER#2.

As described above, this A/D converter is within the controller 35, and during the data acquisition window 270 (FIG. 10) this A/D converter is enabled and allowed to acquire the output signal of the photodiode 130. Once the illumination of the LED 120 has been adjusted in a scanning step 406, the optical sensor 100 is scanned across the media by carriage 40 to collect reflectance data points and preferably, to record these data points at every positional encoder transition along the way, with this positional information being obtained through use of the optical encoder strip 45 (FIG. 14). Thus, the data generated in the scanning and collecting step 406 consists of both positional data and the corresponding reflectance data, with the reflectance and position being in counts. For instance, for the reflectance, twelve bits, or $2_{12}$ which equals 4096 counts, are equally distributed over a 0–5 Volt range of the A/D converter. Thus, each count is equal to 5/4096, or 1.2 mV (millivolts). The light (reflectance from the media is captured by the LVC (light-to-voltage converter) and provides as an output an analog voltage signal which is translated by the analog-to-digital converter into a digital signal expressed in counts. The position on the media (e.g., paper) is also expressed in counts derived from the 600 quadrature transitions per inch of the encoder in the illustrated embodiment, although it is apparent to those skilled in the art that other transitions per inch, or per some other linear measurement, such as centimeters, may also be used. Thus, a position count of 1200 in the illustrated embodiment translates to a location on the paper or other media of 1200/600 position counts, or 2.0 inches (5.08 centimeters) from the start of the scan. Preferably, the media may be scanned several times and then the data averaged for all points in step 408. Typically, 1–3 scans across the media are sufficient to generate a reliable set of average data points. During the scanning and collecting step 406, the field of view of the optical sensor 100 is placed over the media with the media resting at the top of form position. In this top of form position, for a transparency supplied by the Hewlett-Packard Company, which has a tape header across the top of the transparency, this implies that the tape header is being scanned by the sensor 100.

Since the A–D conversions used during the scanning and collecting step 406 is triggered at each state transition of the encoder strip 45, the sampling rate has spatial characteristics, and occurs typically at 600 samples per inch in the illustrated printer 20. During the scan, the carriage speed is preferably between 2 and 30 inches per second. The data collected during step 406 is then stored in the printer controller 35, and is typically in the range of a 0–5 volt input, with 9-bit resolution. At the conclusion of the scanning, the data acquisition hardware signals the controller 35 that the data collection is complete and that the step of averaging the data points 408 may then be performed.

The media type determination system 400 then performs a spatial frequency media identification routine 410 to distinguish whether the media sheet that has been scanned is either a transparency without a header tape, photo quality media, a transparency with a header tape, or plain paper. The first step in the spatial frequency media identification routine 410 is step 412, where a Fourier transform is performed on all of the data to determine both the magnitude and phase of each of the discrete spatial frequency components of the data recorded in step 406. In the illustrated embodiment for printer 20, the data record consists of 4000 samples, so the Fourier components range from 0–4000. The magnitude of the first sorted component is the direct current (DC) level of the data.

If a transparency without a tape header is being examined, this DC level of the data will be low. FIG. 14 is a graph 414 of the DC level of reflectance for a group of plain papers which were studied, with the abbreviation key being shown in Table 1 below. Also shown in FIG. 14 are the DC levels of reflectance for transparencies with a header tape, labeled "TAPE," as shown by bar 416 and for that without the tape header, labeled as "TRAN", as shown by bar 418 in graph 414.

TABLE 1

Graph Abbreviations

| Label | Media Type Archive |
|---|---|
| GOSSIMER | Gossimer (HP Photo Glossy) |
| GBND | Gilbert Bond |
| GPMS | Georgia-Pacific Multi-System |
| ARRM | Aussedat-Rey-Reymat |
| CDCY | Champion DataCopy |
| EGKL | Enso-Gutzeit Berga Laser |
| HFDP | Hammermill Fore DP |
| HNYR | Honshu New Yamayuri |
| HOKM | Hokuestsu kin-Mari |
| KCLX | KymCopy Lux |
| MODO | MoDo DataCopy |
| NCLD | Neenah Classic Laid |
| OJIS | Oji Sunace PPC |
| PMCY | Stora Papyrus MultiCopy |
| SFIP | SFI-PPC |
| STZW | Steinbeis/Zweckform |
| TAPE | HP transparency (Scotty) WITH paper tape |
| TRAN | HP transparency (Scotty) NO Tape |
| UCGW | Union Camp Great White |
| WFCH | Weyerhauser First Choice |
| WTCQ | Wiggens Teape Conqueror |

Also included in the DC level reflectance graph of FIG. 14 are two types of Gossimer photo paper, labeled GOSSIMER#1 and GOSSIMER#2, as shown by bars 420 and 422, respectively in graph 414. The remainder of the bars in graph 414 indicate varying types of plain paper, as shown in Table 1 below, of which bar 424 is used for MoDo DataCopy plain paper media, labeled as "MODO". From a review of graph 414, it is seen that the low level of light passing through the transparency without a tape header at bar 414 is readily distinguishable from the remainder of the reflectance values for the other types of media, which is because rather than the light being reflected back to the photo sensor 130, it passes through the transparency. Thus, in step 426, a determination is made based on the DC level of the reflectance data which, if it is under a reflectance of 200 counts then a YES signal 428 is generated to provide a transparency without tape signal 430 to the controller 35, which then adjusts the printing routine accordingly for a transparency. If instead, the DC level of the data collected is greater than 200 counts, then a NO signal 432 is generated and further investigation takes place to determine which of the other types of media may be present in the print zone. Note that step 426 of comparing the reflectance data may also be performed before the Fourier transform step 412, since the Fourier spectrum values are not needed to determine whether or not the media is a regular transparency without tape.

Figure 15:
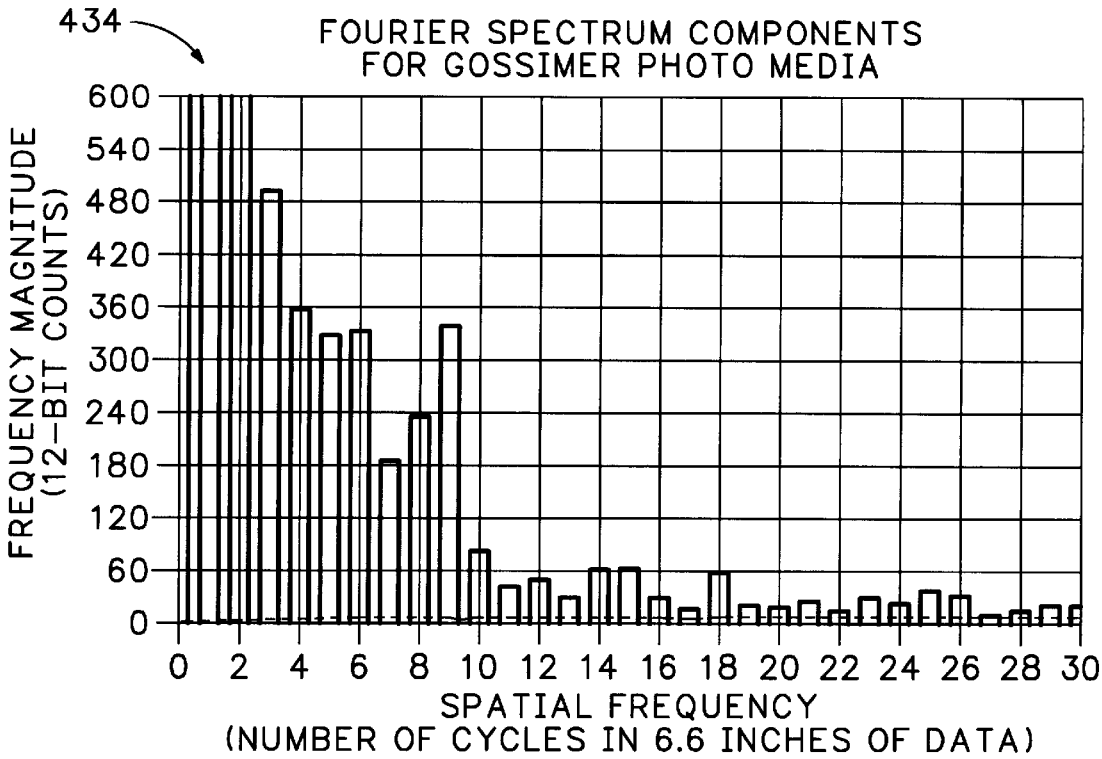
FIG. 15 is a graph of the Fourier spectrum components, up to component 30 for the GOSSIMER photo media.
Figure 16:
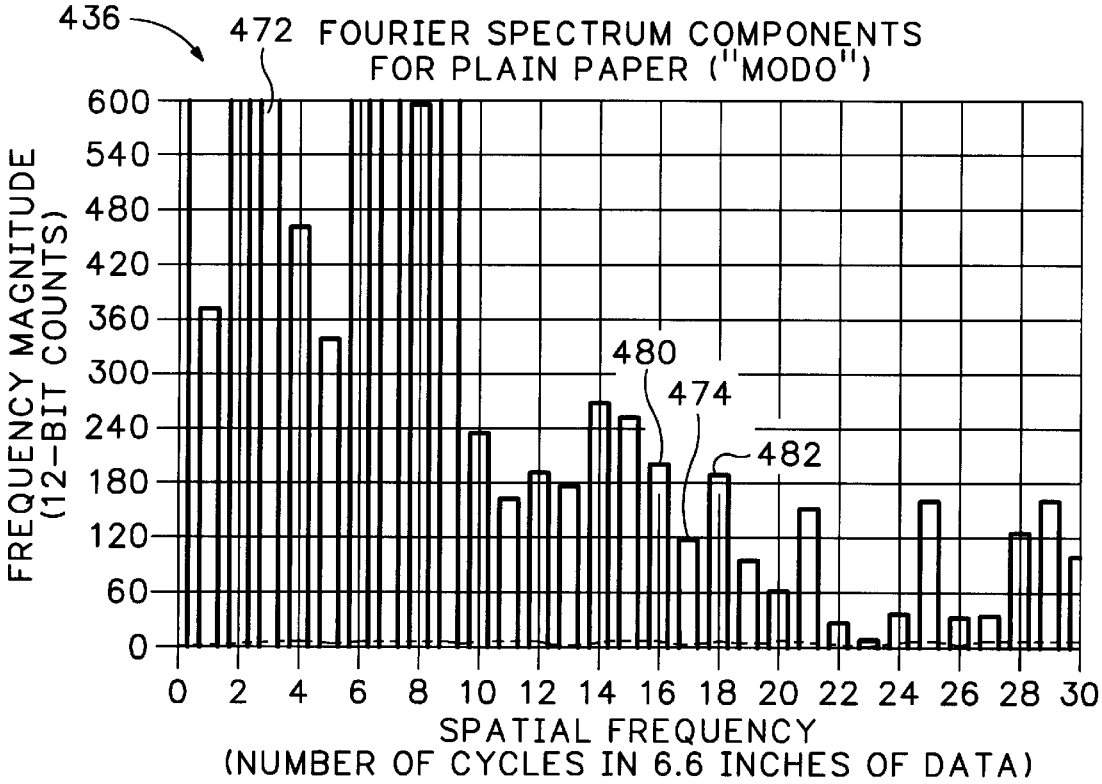
FIG. 16 is a graph of the Fourier spectrum components, up to component 30 for the representative plain paper provided by MoDo Datacopy, labeled "MODO" in FIG. 14.

So if the media is not a transparency without a tape header, a determination is then made whether the media is a photo quality media. To do this, a Fourier spectrum component graph 434 is used, as shown in FIG. 15, along with a Fourier spectrum component graph 436 for plain paper, here the MoDo Datacopy brand of plain paper shown in FIG. 16. Before delving into an explanation of this analysis, an explanation of the units for the spatial frequency label along the horizontal axis of these graphs (as well as for the graph in FIG. 18) is in order. The spatial frequency components are the number of cycles that occur within the scan data collected in the scan media step 406 of FIG. 13. For the examples illustrated herein, the length of the data sample was selected to be 4000 samples. As discussed above, in the illustrated embodiment, the data is sampled at 600 samples per inch of movement of the sensor 100. A spatial frequency that completes 30 cycles within the length of the scan data would therefore have an equivalent spatial frequency found according to the equation:

$$\frac{(30\text{ cycles})\times(600\text{ samples/inch})}{(4000\text{ samples})} = 4.5\text{ cycles/inch}$$

In the illustrated embodiment, a data scan of 4000 samples is equivalent to a traverse of 6.6 inches across the media which is the scan distance used herein, from the equation:

$$\frac{(4000\text{ samples})}{(600\text{ samples/inch})} = 6.6\text{ inches}$$

From the comparison of graphs 434 and 436, it is seen that the magnitudes of the spectrum components above the count n equals eight (n=8) are much greater in the plain paper spectrum of graph 436 then for the photo media in graph 434. Thus, in step 438 the spectral components from 8–30 are summed and in a comparison step 448, it is determined that if the sum of the components 8–30 is less than a value, here a value of 25, a YES signal 450 is generated. In response to the YES signal, step 452 generates a signal which is provided to the controller 35 so the printing routines may be adjusted to accommodate for the photo media. Note that in FIGS. 15 and 16, several of the components having a count of less than eight (n<8) have frequency magnitudes which are greater than the maximum value shown oh graphs 434 and 436, but they are not of interest in this particular study, so their exact values are immaterial to our discussion here.

Figure 17:
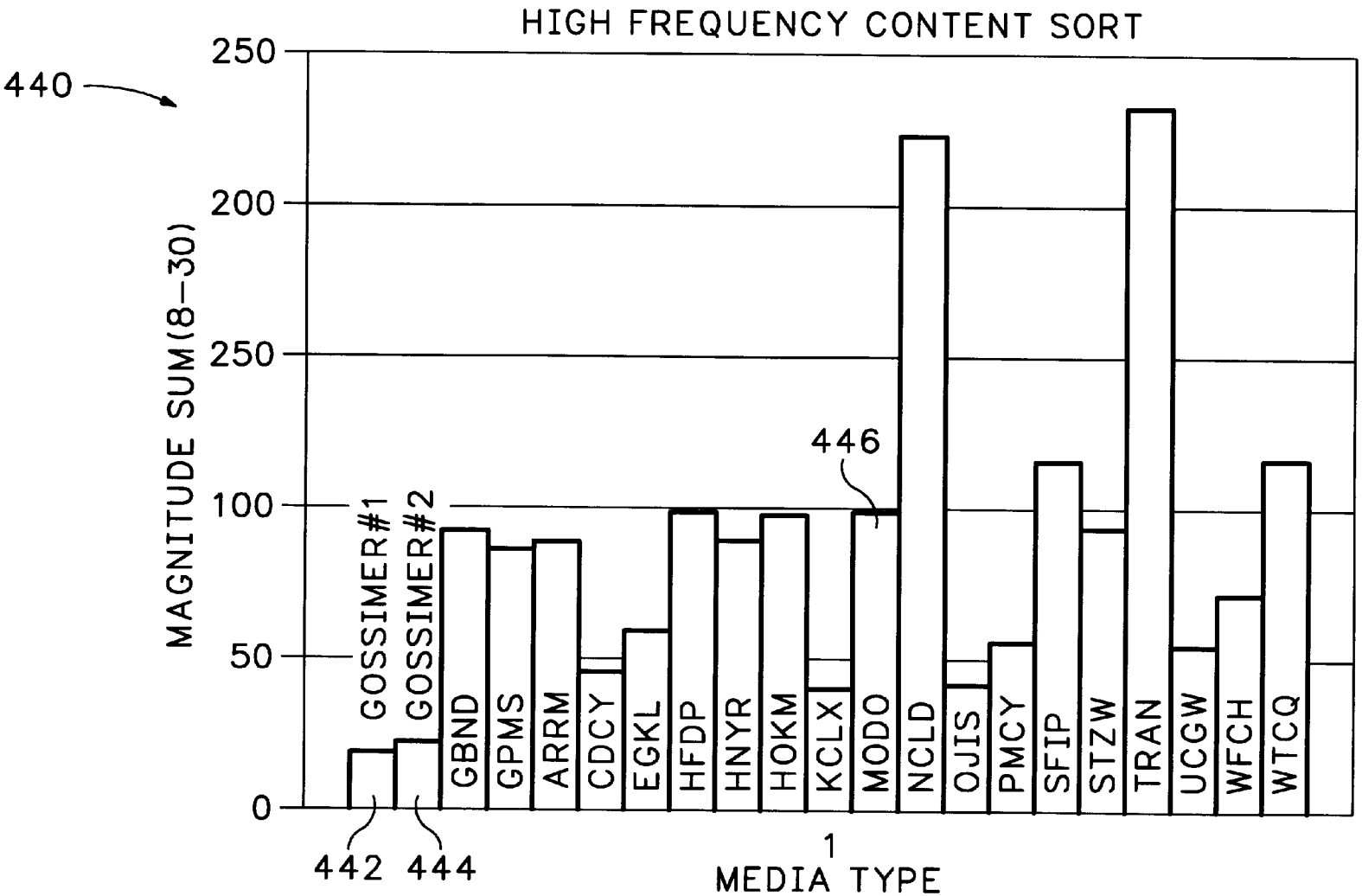
FIG. 17 is a graph of the sum of the Fourier spectrum components for all of the media shown in FIG. 14.

Fourier spectrum component graphs such as 434 and 436 may be constructed for all of the different types of media under study. FIG. 17 shows a graph 440 of the sum of the magnitude of components 8–30 for each of the different types of plain paper and photo media. Here we see the GOSSIMER#1 and GOSSIMER#2 photo medias having their summed components shown by bars 442 and 444. It is apparent that the magnitude of the photo media summed components 442 and 444 is much less than that for any of the remaining plain paper medias, including the bar 446 for the MoDo Datacopy media. Thus, returning to the flow chart of FIG. 13, in response to the sum components step 438 in a comparison step 448 the magnitude of the sum of components 8–30 is compared, and if less than the value of 25 a YES signal 450 is generated.

Figure 18:
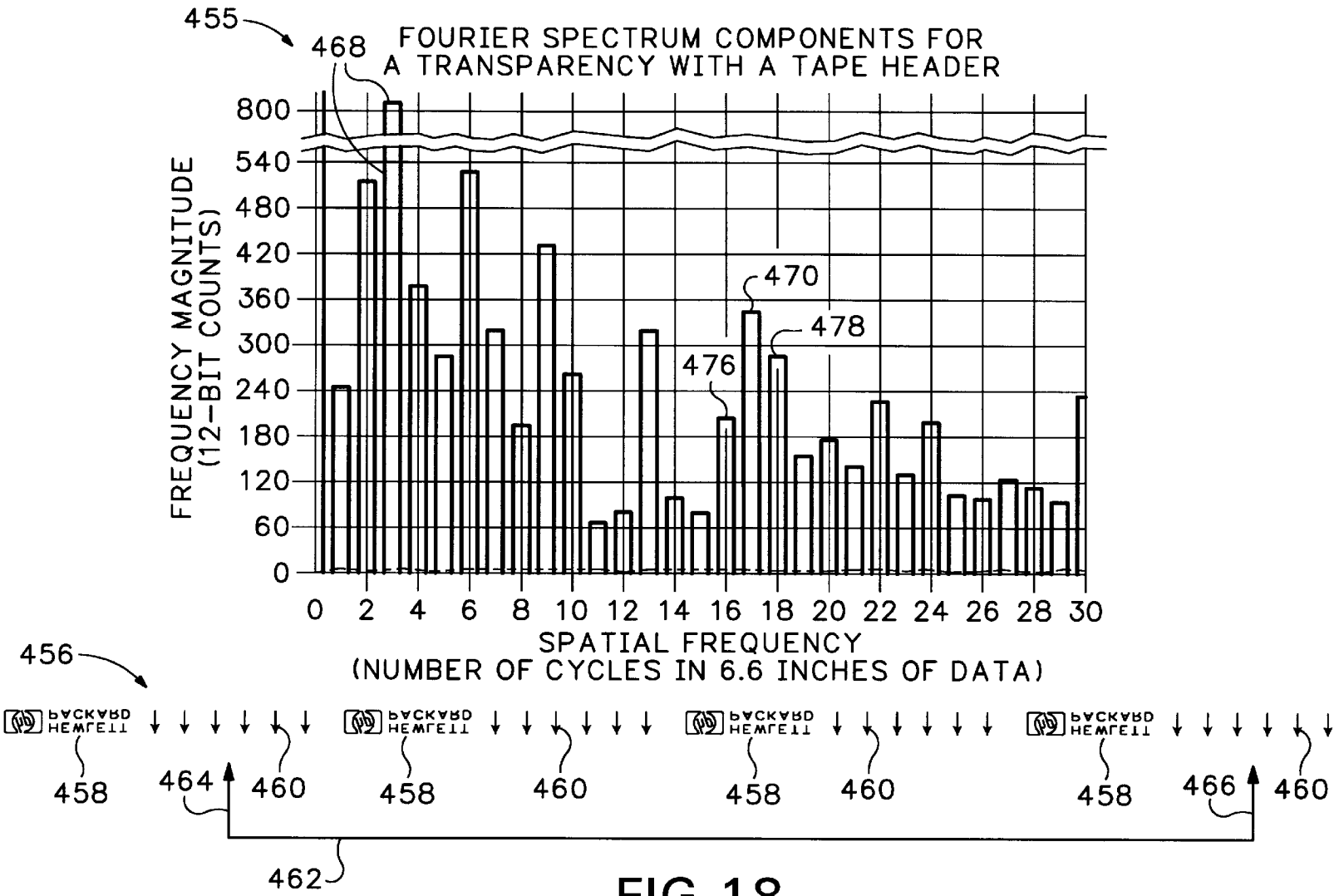
FIG. 18 is a graph of the Fourier spectrum components, up to component 30 for a transparency with a tape header, indicated as "TAPE" in FIG. 14.

However, if the media in print zone 25 is not photo media, the decision step 448 generates a NO signal 454 having determined that the media is not a transparency without a header tape and not photo media it then remains to be determined whether the media is either a transparency with a header tape or plain paper. FIG. 18 is a graph 455 Fourier spectrum components for a transparency with a tape header, with the tape header 456 being shown below the graph and the starting and ending points 464 and 466 also being indicated. Over the duration of the scan, there are three HP logos 458 encountered and roughly seventeen directional arrows 460, indicating which way a user should insert the media into the printer. These logos and arrows create a media signature in the spectrum as can be seen from an analysis of graph 455. As can be seen from a review of the graph 455, the third component 468 and the seventeenth component 470 are much larger than those in the plain paper spectrum of the respective third and seventeenth components 472 and 474 in graph 436 of FIG. 16 (note that the vertical scale on graph 455 in FIG. 18 is fragmented, and the magnitude of the third component 468 is at a value above 800.). Due to positioning errors at the beginning of the scan, which are compensated in step 408 where the data points are averaged, the sixteenth and eighteenth components 476 and 478, respectively, of graph 455 are much larger than the sixteenth and eighteenth components 480 and 482, for the plain paper in graph 436. Consequently, the sixteenth and eighteenth components are also contained within this unique frequency signature.

Figure 19:
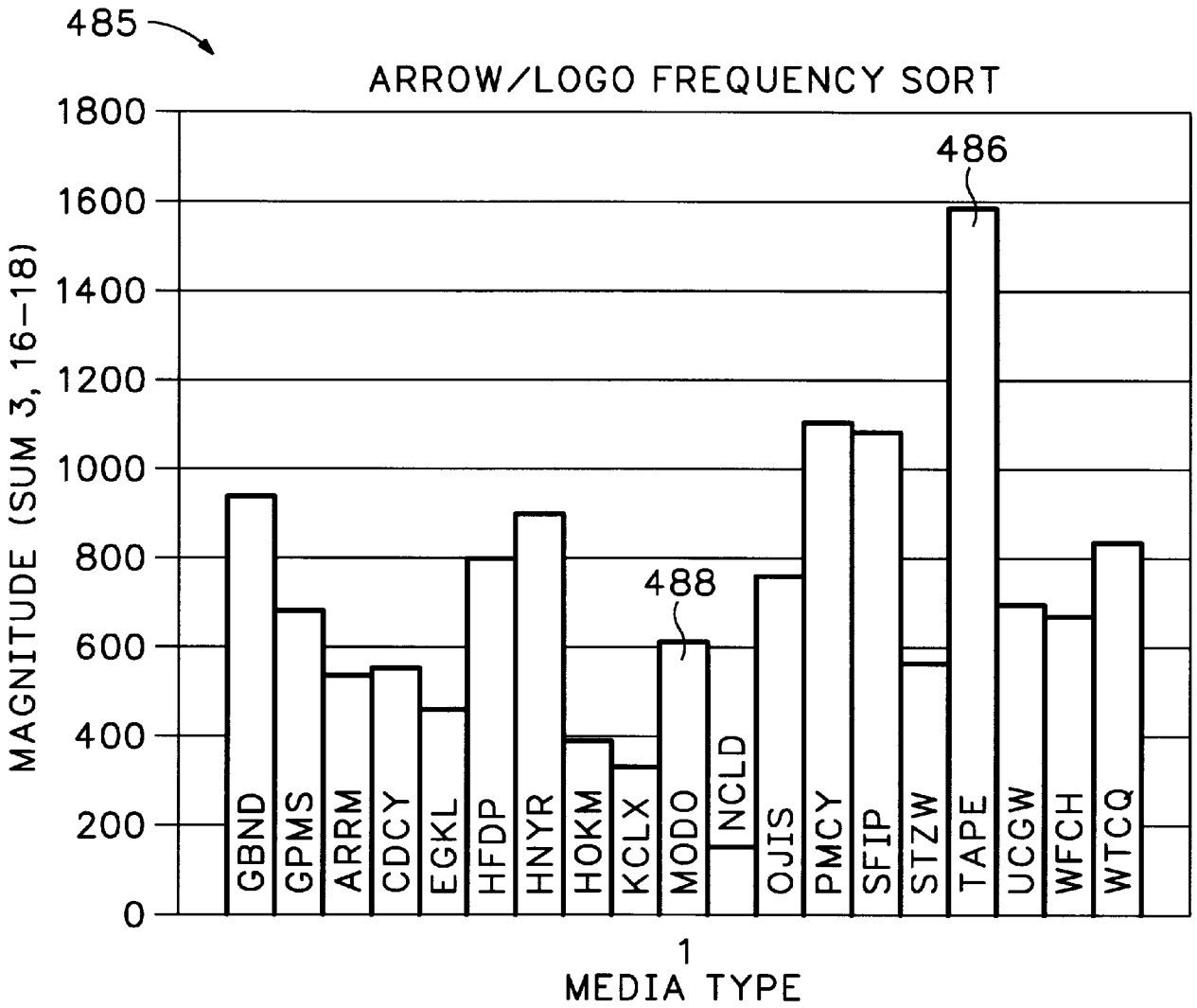
FIG. 19 is a graph of the summed third, sixteenth, seventeenth and eighteenth Fourier spectrum components for the plain paper media shown in FIG. 14, in addition to that of the TAPE header across a transparency indicated as "TRAN."

Returning to flow chart 400 of FIG. 13, in step 484 the magnitude of the components of the third, sixteenth, seventeenth and eighteenth spectrums are summed, with these resulting sums being shown in graph 485 of FIG. 19. The sum for the tape is shown as bar 486, which clearly of a much greater magnitude than the various plain papers, such as bar 488 for the MoDo Datacopy plain paper. Thus, a decision may then be made in step 490, to determine whether the sum of the frequency sub-components 3, 16, 17 and 18 performed by step 484 is greater than 1300 if so, a YES signal 492 is delivered to indicate that the media is a transparency with a tape header, and this information is then transferred by step 494 to the printer controller 35 for subsequent processing and adjustment of the printing routines. However, if the decision by step 490 is that the sum is less than 1300, then a NO signal 496 is generated which is then sent to a decision block 498 indicating plain paper is in the printer, and the default plain paper print mode may be used by the controller 35.

Advanced Media Determination System

Figure 20:
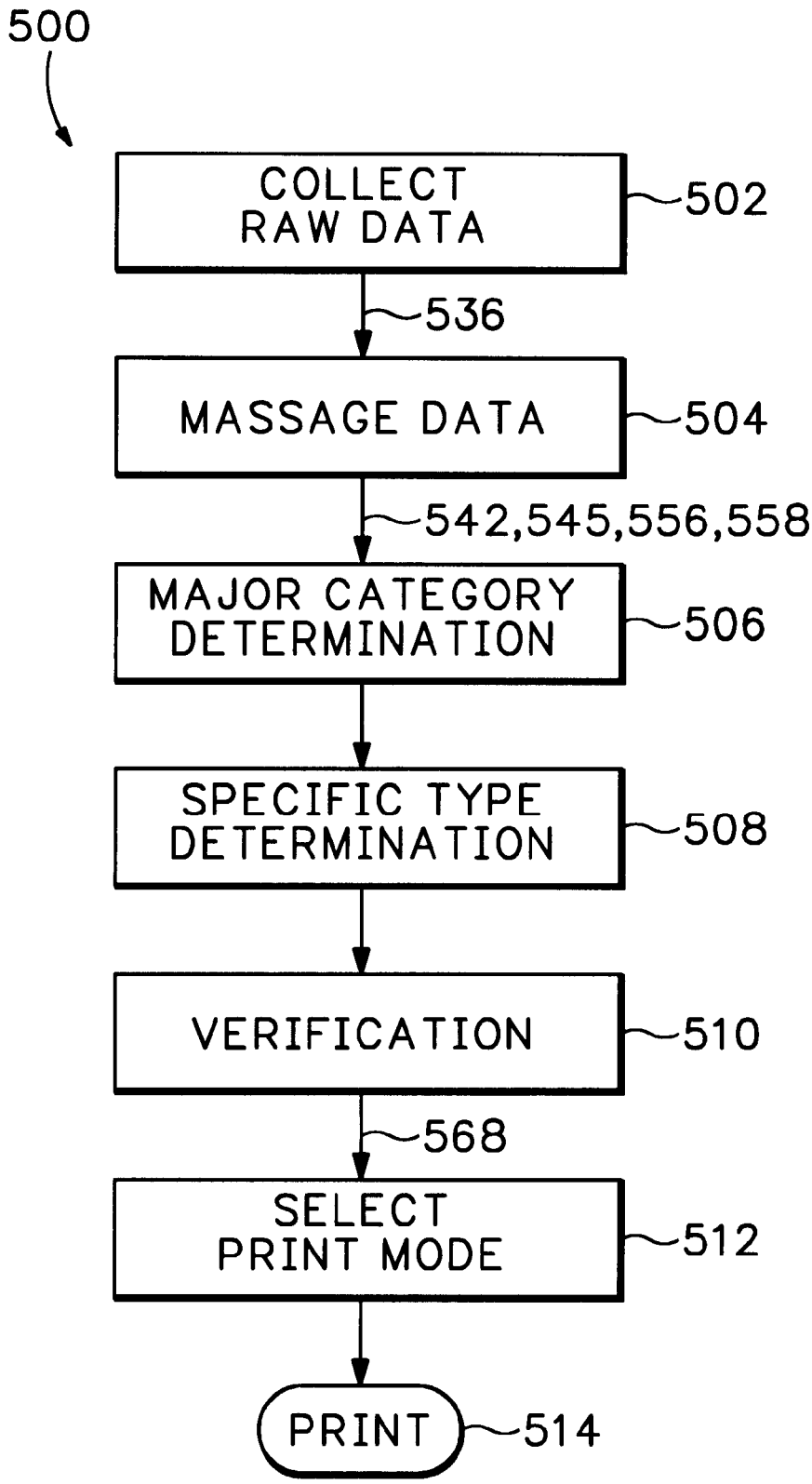
FIG. 20 is a flow chart of one form of a method for determining which major category of media, e.g., plain paper, premium paper, photo paper or transparency, is entering the printzone of the printer of FIG. 1, as well as determining specific types of media within major media categories, such as distinguishing between generic premium paper, matte photo premium paper, and prescored heavy greeting card stock.
Figure 21:
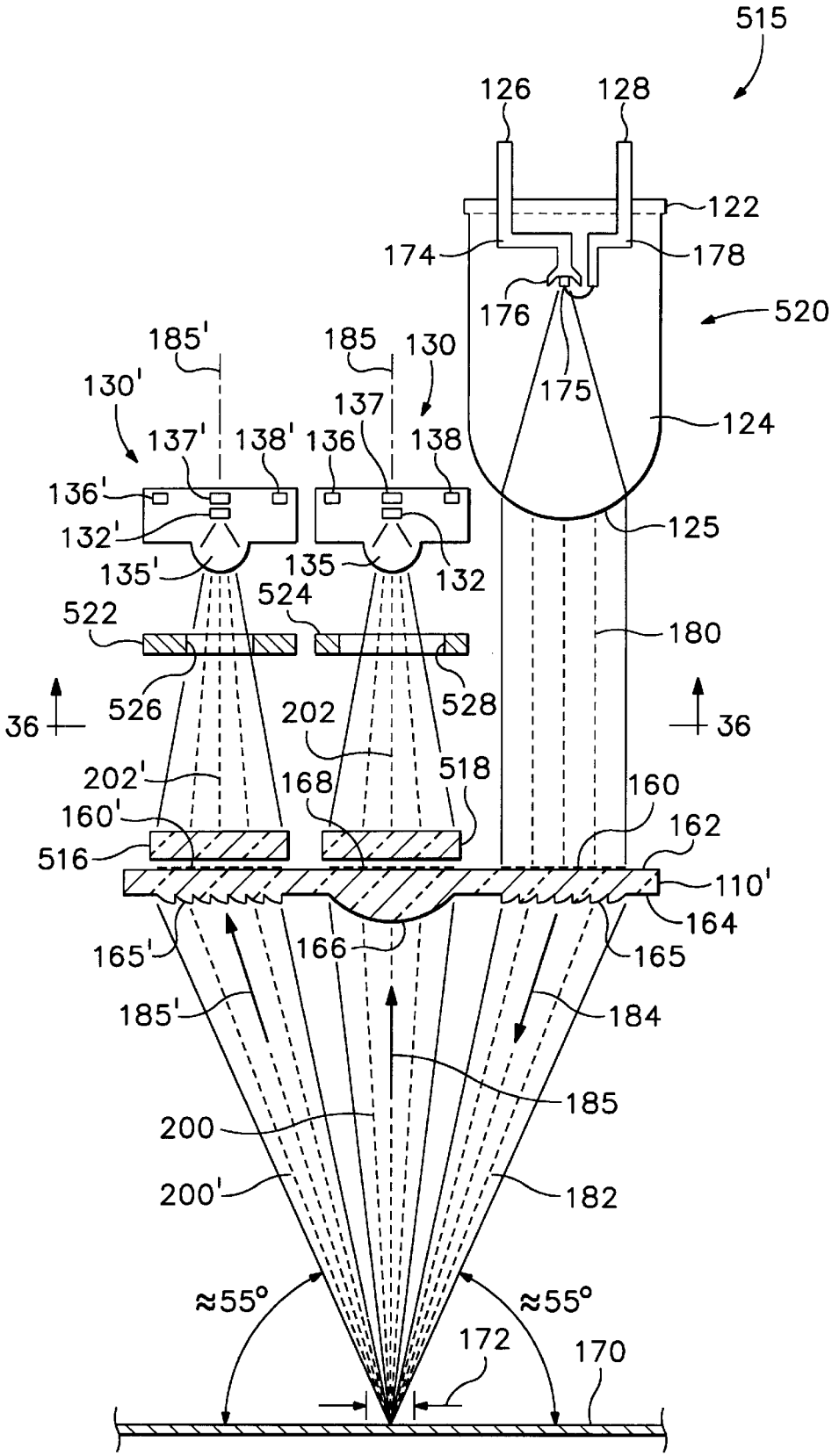
FIG. 21 is a schematic side elevational view of one form of an advanced media type determination optical sensor which may be used with the method of FIG. 20.

FIG. 20 illustrates one form of a preferred advanced media type determination system 500 as a flow chart, constructed in accordance with the present invention. In describing this advanced media determination system 500, first an overview of the system operation will begin with respect to FIG. 20, followed by a description of a preferred optical media type detection sensor with respect to FIGS. 21–24, which may be installed in printer 20. Next will be a description of several more general portions of the determination system 500 with respect to FIGS. 25–28, followed by a detailed description of the heart of the determination method with respect to FIGS. 29–32. Following a description of the method, FIGS. 33–38 will be used to explain how the media sensor of FIG. 21 is used in the determination routines of FIGS. 29–32, followed by graphical examples of several different types of media studied, with respect to FIGS. 39–51. Finally, in FIGS. 52 through 55, the spatial frequencies of light collected by the media type determination sensor are studied to show how system 500 determines which type of media is entering the printzone 25 of printer 20.

1. System Overview

Returning to FIG. 20, the advanced media determination system 500 is shown in overview as having a first collect raw data step 502. Following collection of the raw data, a massage data routine 504 is performed to place the data collected in step 502 into a suitable format for further analysis. Following the massaging data step, comes a major category determination step 506 and a specific type determination step 508. The major and specific determination steps 506 and 508 are interlaced, as will be seen with respect to FIGS. 29–32. For instance, once a major category determination is made, such as for premium paper media, then a further determination may be made as to which specific type of premium media is used. However, to arrive at the major determination step for premium media, the routine must first have discarded the possibilities that the media might be a transparency, a glossy photo, a matte photo, or a plain paper media. After the method has made a specific type determination in step 508, a verification step 510 is performed to assure that the correct specific determination has been made. Following the verification step 510, the determination system 500 then has a select print mode step 512, which correlates the print mode to the specific type of media which is entering the printzone 25. In response to the selection of print mode step 512, the system then concludes with a print step 514, where printing instructions are sent to the printheads 70–76 to print an image in accordance with the print modes selected in step 512.

2. Media Sensor Construction

Figure 22:
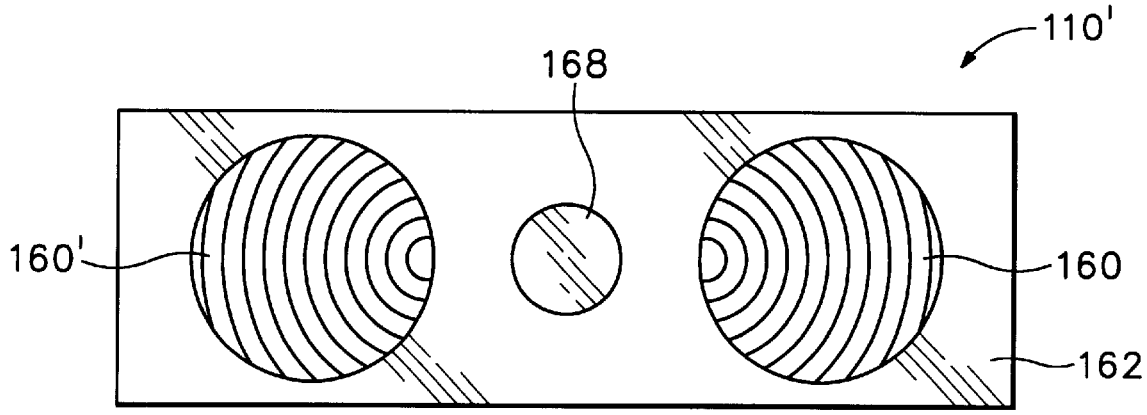
FIG. 22 is a top plan view of one form of a lens assembly of the media optical sensor of FIG. 21.
Figure 23:
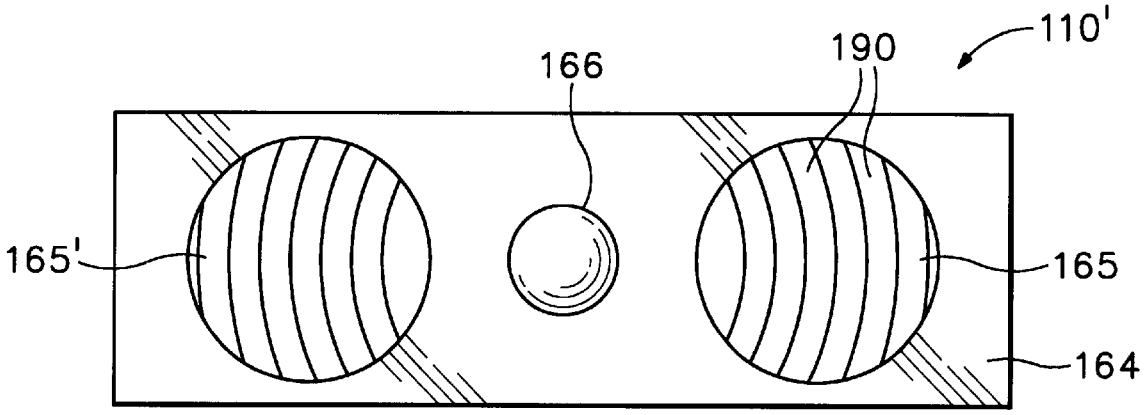
FIG. 23 is a bottom plan view of the lens assembly of FIG. 21.
Figure 24:
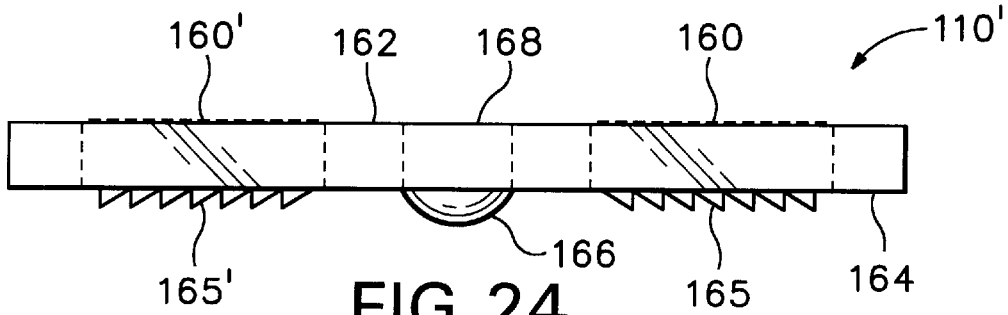
FIG. 24 is a side elevational view of the lens assembly of FIG. 21.

FIG. 21 illustrates one form of an optical media type determination sensor or "media sensor" 515 constructed in accordance with the present invention. Many of the components of the media sensor 515 may be constructed as described above with respect to the monochromatic optical sensor 100 of FIG. 7, and thus the same identifying numerals have been used. One of the major differences between the media sensor 515 and the monochromatic optical sensor 100 is the addition of a second photodiode 130', which receives a specular reflectance light beam 200'. As mentioned above with respect to the specular reflectance light beam 204 of FIG. 7 for the monochromatic sensor 100, the specular beam 200', as well as beam 204, are reflected off the media 170 at the same angle that the incoming light beam 182 impacts the media, according to the well known principle of optics: "angle of incidence equals angle of reflection." In the illustrated embodiment, the angle of incidence and the angle reflection are selected to be around 55°. To accommodate this incoming specular reflectance beam 185', a modified lens assembly 110' is used. Referring to FIGS. 22–24 the illustrated modified lens assembly 110' has a third lens element, including an incoming Fresnel lens 165', and an outgoing diffractive lens element 160', which may be constructed as described above for lens elements 165 and 160, respectively (see FIG. 8). It is apparent to those skilled in the art that other types of lens assemblies may be used to provide the same operation as assembly 110' and assembly 110. For instance, the third lens element of assembly 110' may be constructed with an aspheric refractive incoming lens, and an outgoing aspheric refractive lens or an outgoing micro-Fresnel lens.

A further addition to the media sensor 515, beyond the components of the monochromatic optical sensor 100, are two filter elements 516 and 518, which lay over the diffractive lens elements 160' and 168, respectively. These filters 516 and 518 may be constructed as a singular piece, although in the illustrated embodiment two separate filters are shown. The filters 516 and 518 have a blue pass region where the low wavelength blue-violet LED light, with a wavelength of 360–510 nm, passes freely through the filters 516 and 158, but light of other wavelengths from other sources are blocked out. Preferably, the filter elements 516 and 518 are constructed of a 1 mm (one millimeter) thick sheet of silicon dioxide (glass) using conventional thin film deposition techniques, as known to those skilled in the art.

Another major difference between sensors 100 and 515 is that the media sensor 515 has a blue-violet LED 520 which emits a blue light with more of a violet tint than the blue LED 120 of the monochromatic optical sensor. The blue-violet LED 520 has a peak wave length of around 428 nanometers, and a dominant wave length of 464 nanometers, yielding a more violet output than the blue LED 120, which has a peak wave length of around 470 nanometers. Several reasons for this change in the illumination component of the media sensor 515 will be described near the end of the Detailed Description section, where the details of the mechanics of the detection system 500 are discussed.

Another addition to the media sensor 515 over the monochromatic optical sensor 100 is the addition of two field of view controlling elements, such as field stops 522 and 524. The field stops 522 and 524, as well as the filters 516 and 518, are held in place by various portions of a base portion 102' of the sensor 515, and preferably, the field stops 522 and 524 are molded integrally with a portion of the base 102'. The field stops 522 and 524 are preferably located approximately tangent to the apex of the input lenses 135', 135 of the photodiodes 130', 130, respectively. In the illustrated embodiment, the field stops 522, 524 define field of view openings or windows 526 and 528, respectively. The details of the sizes and orientations of the field stop windows 526 and 528 are described with respect to FIG. 36 below.

3. Collect Raw Data Routine

Figure 25:
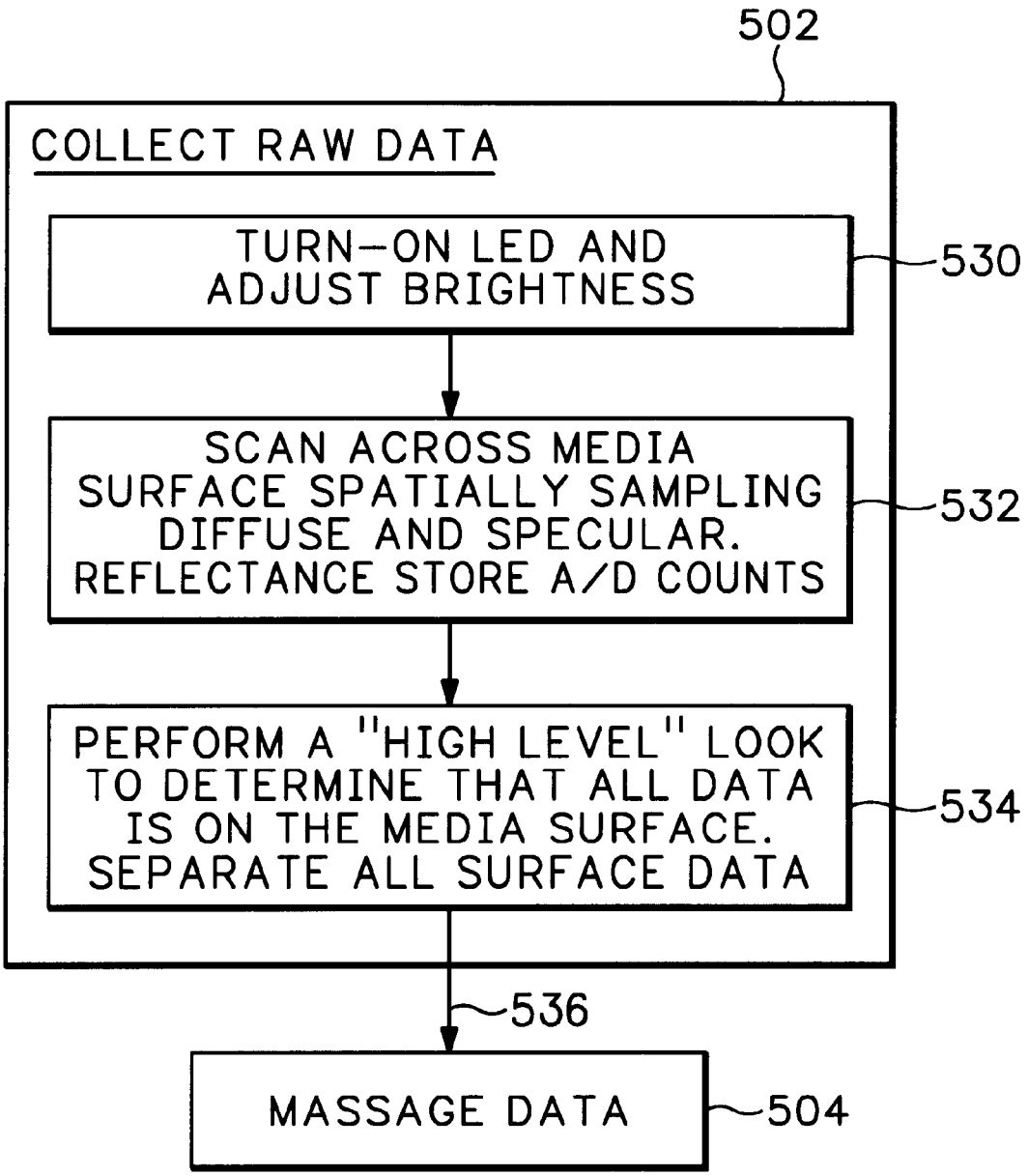
FIG. 25 is a flow chart of the "collect raw data" portion of the method of FIG. 20.

Now that the construction of the media sensor 515 is understood, its use will be described with respect to the collection of raw data routine 502, which is illustrated in detail in FIG. 25. In a first step 530 of routine 502, the blue-violet LED 520 is turned on, and the brightness of the LED 520 is adjusted. Following step 530, in a scanning step 532, the printhead carriage 40 transports the media sensor 515 across the printzone 25, parallel to the scanning axis 38. During the scanning step 532, the media surface is spatially sampled and both the diffuse reflected light components 200, and the specular reflected light components 200' are collected at every state transition as the carriage optical encoder reads markings along the encoder strip 45. These diffuse and specular reflectance values are stored as analog-to-digital (A/D) counts to generate a set of values for the reflectances at each encoder position along the media. In some implementations, it may be desirable to scan the media several times and produce and average the data set, although typically only one scan of the media is required to produce good results.

During this scanning step 532, the sheet of media 170 is placed under the media sensor 515 at the "top of form" position. For a HP transparency media with a tape header 456, as shown in FIG. 18, the tape 456 is within the field of view, even though at this point the tape is located along the undersurface of the media. Indeed, even though the tape header 456 is facing away from the sensor 515, as well as from sensor 100 in the basic media type determination method 400 (FIG. 13), the markings 458, 460 on the tape header 456 are viewable to both sensors 100 and 515, and may be used to identify this media as described above in method 400.

In a final checking step 534 of the raw data collection routine 502, a high level look or check is performed to determine whether all of the data collected during step 532 is actually data which lies on the media surface. For instance, if a narrower sheet of media is used (e.g. A-4 sized media or custom-sized greeting card media) than the standard letter-size media for which printer 20 is designed, some of the data points collected during the scanning step 532 will be of light reflected from the media support member, also known as a platen or "pivot," which forms a portion of the media handling system 24. Thus, any data corresponding to the pivot is separated in step 534 from the data corresponding to the sheet of media, which is then sent on as a collected raw data signal 536 to the massage data routine 504.

During the analog to digital conversion portion of the scanning step 532, the A-to-D conversion is triggered at each state transition of the carriage positional encoder which monitors the optical encoder strip 45. In this manner, the data is collected with a spatial reference, that is, spatial as in "space," so the data corresponds to a particular location in space as the carriage 40 moves sensor 515 across the printzone 25. For the illustrated printer 20 the sampling rate typically occurs at the rate of 600 samples per inch (1524 samples per centimeter). During this scanning step 532, preferably the speed of the carriage 40 is between two and thirty inches per second (5.08 to 76.2 centimeters per second). One preferred analog-to-digital conversion is over a 0–5 volt range, with a 9-bit resolution.

4. Massage Data Routine

Figure 26:
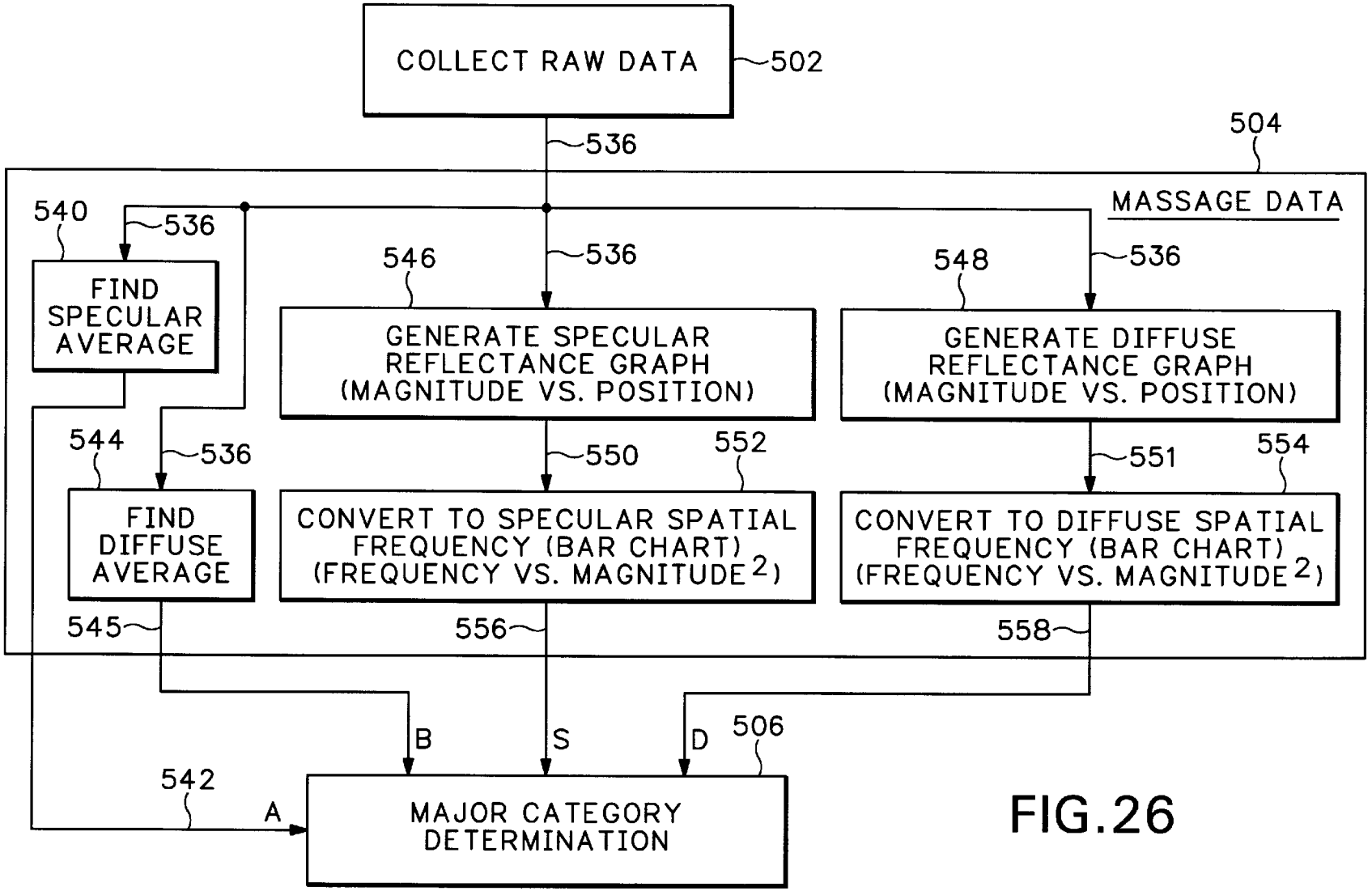
FIG. 26 is a flow chart of the "massage data" portion of the method of FIG. 20.

FIG. 26 illustrates the details of the massage data routine 504, which generates a set of four signals as outputs which are sent to the major category determination routine 506. In two steps, averages of the incoming data are found. Specifically, in a "find specular average" step 540, and a "find diffuse average" step 544, the averages for all of the incoming specular raw data and diffuse raw data, respectively, are found. The specular average step 540 produces a specular average signal 542, also indicated by the letter "A" in FIG. 26, which is provided as an input to the major category determination routine 506. The diffuse average step 544 produces a specular average signal 545, also indicated by the letter "B" in FIG. 26, which is provided as an input to the major category determination routine 506.

The other major operations performed by the massage data routine 504 are preformed in a "generate specular reflectance graph" step 546, and in a "generate diffuse reflectance graph" step 548. In step 548, the collected raw data is arranged with the diffuse and specular reflectance values referenced to the same spatial position with respect to the pivot or platen.

The steps of generating the specular and diffuse reflectance graphs 546, 548 each produce an output signal, 550 and 551, which are received by two conversion steps 552 and 554, respectively. In step 552, the aligned data 550 is passed through a Hanning or Welch's fourth power windowing function. Following this manipulation, a discrete fast Fourier transform may be performed on the windowed data to produce the frequency components for the sheet of media entering the printzone 25. In each of steps 546 and 548, the graphs are produced in terms of magnitude versus ("vs.") position, such as the graphs illustrated in FIGS. 39–45, discussed further below. The specular spatial frequency, shown as a bar chart of frequency versus the magnitude$^2$ (magnitude squared), which is an output signal 556, also labeled as letter "S," which is supplied to the major category determination routine 506. In step 554, the incoming data 551 is converted to a diffuse spatial frequency, shown as a bar chart of frequency versus the magnitude$^2$, to produce an output signal 558, also labeled as letter "D," which is supplied to the major category determination routine 506. Examples of the graphical data provided by the conversion steps 552 and 554 are shown in FIGS. 46–51, discussed further below.

Thus, during the massage data routine 504, a Fourier transform is performed on the collected raw data to determine the magnitude and phase of each of the discrete spatial frequency components of the recorded data for each channel, that is, channels for the specular and diffuse photodiodes 130', 130. Typically this data consists of a record of 1000–4000 samples. The Fourier components of interest are limited by the response of the photodiodes 130, 130' to typically less than 100 cycles per inch. The magnitude of the first order component is the DC (direct current) level of the data. This DC level is then used to normalize the data to a predetermined value that was used in characterizing signatures of known media which has been studied. A known media signature is a pre-stored Fourier spectrum, typically in magnitude values, for both the specular and diffuse channels for each of the media types which are supported by a given inkjet printing mechanism, such as printer 20.

5. Verification and Selection of Print Mode Routines

Figure 27:
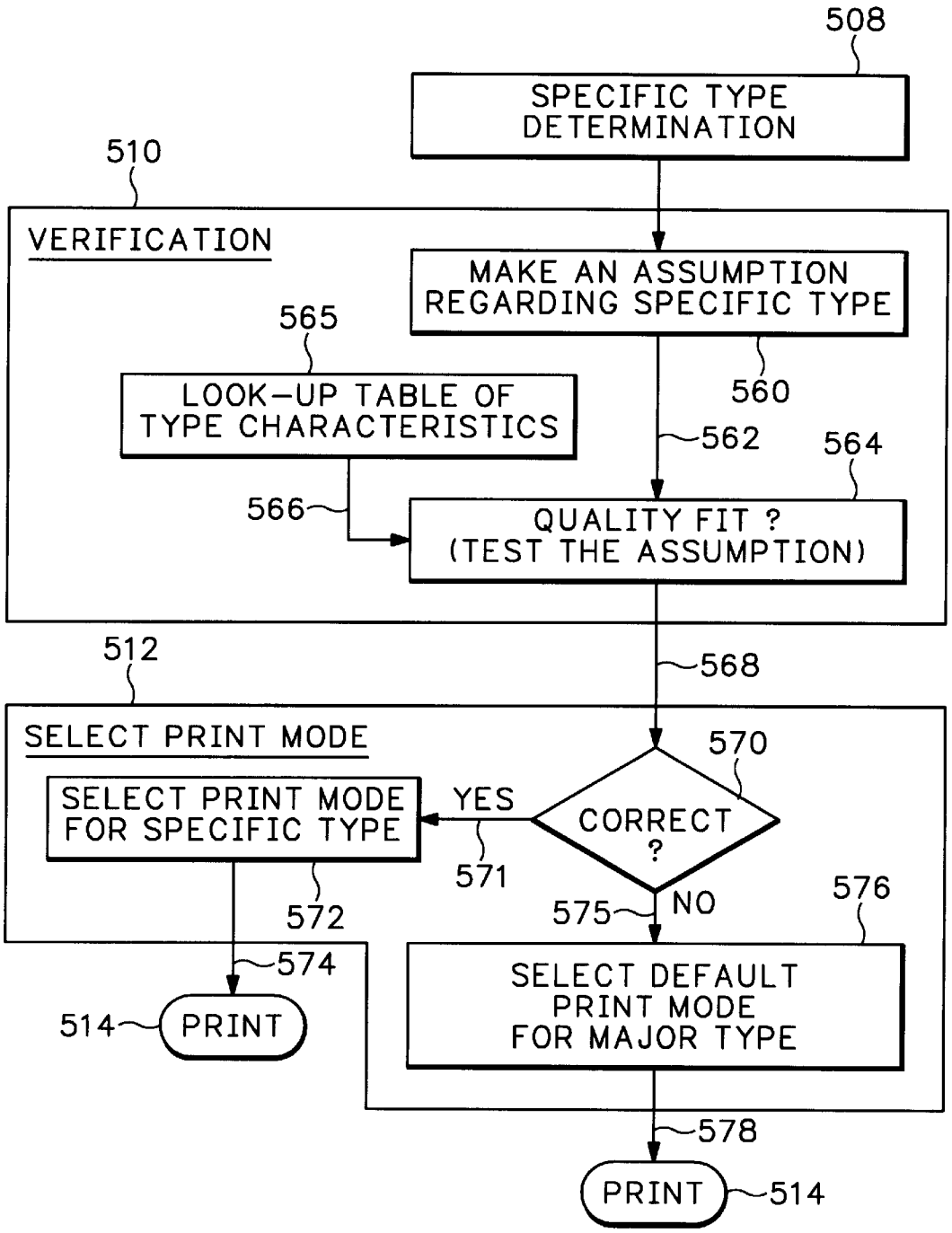
FIG. 27 is a flow chart of the "verification" and "select print mode" portions of the method of FIG. 20.

FIG. 27 illustrates the details of the verification and select print mode steps 510, 512 of the media determination system 500. Here we see the verification step 510 receiving incoming data from the specific type determination step 508. This incoming data is first received by a "make assumption" step 560, with this assumption regarding the specific media type. Step 560 yields an assumed specific type signal 562, which is received by a "determine the quality fit" step 564. The determine the quality fit step 564 is used to test the correctness of the assumption made in step 560. In a look-up step 565, a table of the various type characteristics for each specific type of media is consulted, and data corresponding to the assumed media type of signal 562 is provided to the quality fit step 564 as a reference data signal 566. The quality fit step 564 processes the reference values 566 and the assumed media type signal 562 and provides an output signal 568 to the select print mode routine 512.

The output signal 568 from the verification step 510 is received by a comparison step 570, where it is determined whether the assumption data 562 matches the reference data 566. If this data does indeed match, a YES signal 571 is issued by the comparison step 570 to a "select print mode" step 572. Step 572 then selects the correct print mode for the specific type of media and issues a specific print mode signal 574 to the print step 514. However, if the comparison step 570 determines that the media type assumed step 560 does not have characteristics which match the reference data 566, then a NO signal 575 is issued. The NO signal 575 is then sent to a "select default print mode" step 576. The default print mode selection step 576 then issues a default print mode signal 578, corresponding to the major type of media initially determined, and then the incoming sheet is printed in step 514 according to this default determination.

6. Types of Media

At this point, it may be helpful to describe the various major types of media which may be determined using system 500, along with giving specific examples of media which falls into the major type categories. It must be noted that only a few of the more popular medias have been studied, and their identification incorporated into the specifics of the illustrated determination system 500. Indeed, this is a new frontier for printing, and research is continuing to determine new ways to optically distinguish one type of media from another. The progress of this development routine is evidenced by the current patent application, which has progressed from a basic media determination routine 400 described in the parent application, to this more advanced routine 500 which we are now describing. Indeed, other medias remain yet to be studied, and further continuing patent applications are expected to cover these determination methods which are so far undeveloped.

Table 2 shows the print modes assigned by media type:

TABLE 2

Print Modes By Media Type

| Print Mode | PM = 0 Plain | PM = 2 Premium | PM = 3 Photo | PM = 4 Transp. |
|---|---|---|---|---|
| Default | Default (0,0) | Default (2,0) | Default (3,0) | Default (4,0) |
| Specific A | Plain A (0,1) | Matte Photo (2,1) | Gossimer (3,0) | HP (Tape) (4,1) |
| Specific B | | Clay Coated (2,2) | Combined (3,1) | |
| Specific C | | Slight Gloss (2,3) | Very Glossy (3,2) | |
| Specific D | | Greeting Card (2,4) | | |

In the first major type category of plain paper, a variety of different plain papers have been listed previously with respect to Table 1, with the specific type of plain paper shown in graphs 42, 49 and 50 being a Gilbert® Bond media, as a representative of these various types of plain paper.

Several different types of media fall within the premium category, and several of these premium papers have coatings placed over an underlying substrate layer. The coatings applied over premium medias, as well as transparency medias and glossy photo medias, whether they are of a swellable variety or a porous variety, are known in the art as an ink retention layer ("IRL"). The premium coatings typically have porosities which allow the liquid ink to pool inside these porosities until the water or other volatile components within the ink evaporate, leaving the pigment or dye remaining clinging to the inside of each cavity. One group of premium papers having such porosities are formed by coating a heavy plain paper with a fine layer of clay. Premium papers with these clay coatings are printed using the "2,2" print mode.

Another type of premium paper has a slightly glossy appearance and is formed by coating a plain paper with a swellable polymer layer. Upon receiving ink, the coating layer swells. After the water or other volatile components in the ink composition have evaporated, the coating layer then retracts to its original conformation, retaining the ink dyes and pigments which are the colorant portions of the ink composition. This swellable type of media is printed with a "2,3" print mode. Another type of media which falls into the premium category is pre-scored greeting card stock, which is a heavy smooth paper without a coating. However, the heavy nature of the greeting card media allows it to hold more ink than plain paper before the greeting card stock begins to cockle (referring to the phenomenon where media buckles as the paper fibers become saturated, which can lead to printhead damage if the media buckles high enough to contact the printhead). Thus, greeting card stock may be printed with a heavier saturation of ink for more rich colors in the resulting image, than possible with plain paper. The print mode selected for greeting card stock is designated as "2,4".

The third major category used by the determination system 500 is photographic media. The various photo medias studied this far typically have a polymer coating which is hydroscopic, that is, the coating has an affinity for water. These hydroscopic coatings absorb water in the ink, and as these coating absorb the ink they swell and hold the water until it evaporates, as described above with respect to the slightly glossy premium media. The Gossimer paper which has a print mode selection of "3,0" is a glossy media, having a swellable polymer coating which is applied over a polymer photobase substrate, which feels like a thick plastic base. Another common type of photo media is a combination media, which has a print mode of "3,1" . This combination media has the same swellable polymer coating as the Gossimer media, but instead, the combination media has this coating applied over a photo paper, rather than the polymer substrate used for Gossimer. Thus, this combination photo media has a shiny polymer side which should be printed as a photo type media, and a plain or dull side, which should be printed under a premium print mode to achieve the best image.

The very glossy photo media which is printed according to print mode "3,2" is similar to the Gossimer media. The very shiny media uses a plastic backing layer or substrate like the Gossimer, but instead applies two layers of the swellable polymer over the substrate, yielding a surface finish which is much more glossy than that of the Gossimer media.

The final major media type studied were transparencies, which have not been studied beyond the two major categories described with respect to the basic media determination system 400, specifically, HP transparencies or non-HP transparencies. Further research may study additional transparencies to determine their characteristics and methods of distinguishing such transparencies from one another but this study has yet to be undertaken.

Before returning to discussion of the determination method 500, it should be noted that the various print modes selected by this system do not affect the normal quality settings, e.g., Best, Normal, Draft, which a user may select. These Best/Normal/Draft quality choices affect the speed with which the printer operates, not the print mode or color map which is used to place the dots on the media. The Best/Normal/Draft selections are a balance between print quality versus speed, with lower quality and higher speed being obtained for draft mode, and higher quality at a lower speed being obtained for the Best mode. Indeed, one of the inventors herein prefers to leave his prototype printer set in draft mode for speed, and allow the media determination system 500 to operate to select the best print mode for the type of media being used.

For example, when preparing for a presentation and making last minute changes to a combination of transparencies for overhead projection, premium or photo media for handouts, and plain paper for notes which the presenter is using during a speech, all of these images on their varying media may be quickly generated at a high quality, without requiring the user to interrupt the printing sequence and adjust for each different type of media used. Indeed, the last statement assumes that the user may have the sophistication to go into the software driver program screen and manually select which type of media has been placed in the printer's supply tray 26. Unfortunately, the vast majority of users do not have this sophistication, and typically print with the default plain paper print mode on all types of media, yielding images of acceptable, but certainly not optimum print quality which the printer is fully capable of achieving if the printer has information input as to which type of media is to be printed upon. Thus, to allow all users to obtain optimum print quality matched to the specific type of media being used, the advanced media determination system 500 is the solution, at least with respect to the major types of media and the most popular specific types which have thus far been studied.

7. Weighting and Ranking Routine

Figure 28:
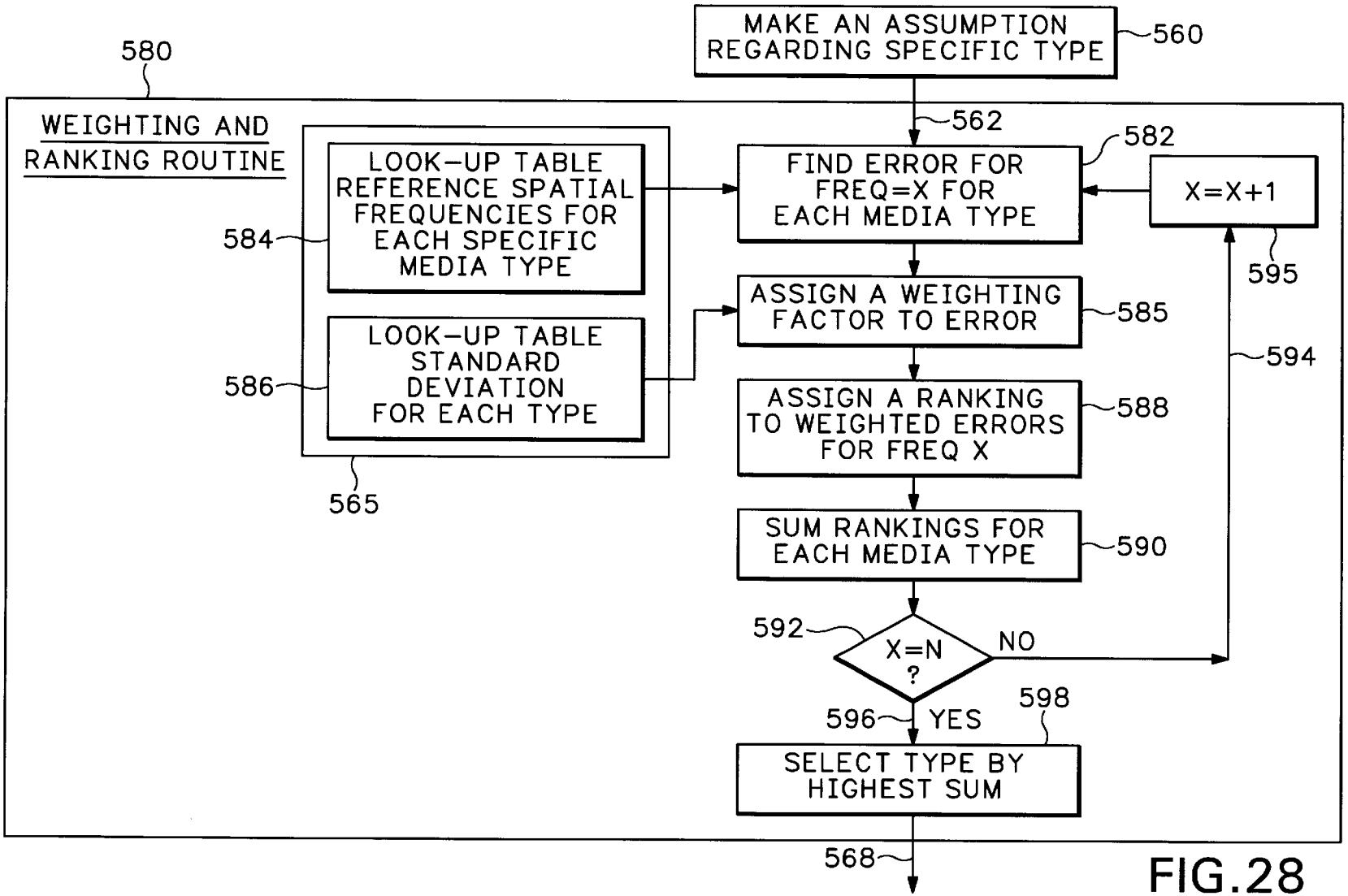
FIG. 28 is a flow chart of a data weighting and ranking routine used in both the "verification" and "select print mode" portions of the method of FIG. 20.

Before delving into the depths of the major and specific media type determination routines 506, 508 a weighting and ranking routine 580 will be described with respect to FIG. 28. This weighting and ranking routine 580 is performed during the quality fit step 564 of the verification routine 510. The specific type of assumption signal 562 is first received by a find error step 582. The find error step 582 refers to a subtable 584 of the type characteristics table 565. The subtable 584 contains the average or reference values for each spatial frequency, for each specific media type that has been studied. The find error step 582 then compares the value of the spatial frequency measured with the reference value of that spatial frequency with each of the values for a corresponding frequency stored in table 584 for each media type, and during this comparison generates an error value, that is, the difference between the frequency value measured versus the value of the corresponding frequency for each media type. The resulting error signals are sent to a weight assigning step 585.

The weight assigning step 585 then refers to another subtable 586 of the look-up table 565. The subtable 586 stores the standard deviation which has been found during study at each spatial frequency for each type of media. The assigning step 585 then uses the corresponding standard deviation stored in table 586 to each of the errors produced by step 582. Then all of the weighted errors produced by step 585 are ranked in a ranking step 588. After the ranking as been assigned by step 588, the ranking for each media type are summed in the summing step 590. Of course, on this first pass through the routine, no previous values have been accumulated by step 590.

Following the summing step 590, comes a counting step 592, or the particular frequency X under study is compared to the final frequency value n. If the particular frequency X under study has not yet reached the final frequency value n, the counting step 592 issues a NO signal 594. The NO signal 594 has been received by an incrementing step 595, where the frequency under study X is incremented by one ("X=X+1"). Following step 595, steps 582 through 592 are repeated until each of the frequencies for both the spatial reflectance and the diffuse reflectance have been compared with each media type by step 582, then assigned a weighting factor according to the standard deviation for each frequency and media type by step 585, ranked by step 588, and then having the ranking summed in step 590.

Upon reaching the final spatial frequency N, the counting step 592 finds that the last frequency N has been reached (X=N) and a YES signal 596 is issued. Upon receiving this YES signal 596, a selection step 598 then selects the specific type of media by selecting the highest number from the summed ranking step 590. This specific type is then output as signal 568 from the verification block 510. It is apparent that this weighting and ranking routine 580 may be used in conjunction with various portions of the determination method 500 to provide a more accurate guess as to the type of media entering the printzone 25.

During the weighting and ranking routine 580, for a standard letter-size sheet of media analyzing both the specular and diffuse readings for a given sheet of media, a total of 84 events are compared for both the specular and diffuse waveforms for each media type. It is apparent that, while the subject media entering the printzone has been compared to each media type by incrementing the frequency, other ways could be used to generate this data, for instance by looking at each media type separately, and then comparing the resulting ranking for each type of media rather than incrementing by frequency through each type of media. However, the illustrated method is preferred because it more readily lends itself to the addition of new classifications of media as their characteristics are studied and compiled.

Each component of the pre-stored Fourier spectrum for each media type has an associated deviation which was determined during the media study. The standard deviations stored in the look-up table 586 of FIG. 28 are preferably arrived at by analyzing the spectra over many hundreds of data scans for many hundreds of pages of each specific type of media studied. The difference between each component of the fresh sheet of media entering the printzone 25 and each component of the stored signatures is computed in the find error step 582 of FIG. 28. The ratio ("x") of the error to the standard deviation is then determined. If this ratio is found to be less than two ($x<2$), the error is then weighted by a factor of one (1). If this ratio is found to be between two and three ($2<x<3$), then the error is weighted by a factor of two (2). If this ratio is found to be greater then three ($x>3$), then the error is weighted by a factor of four (4). This "weighting" of step 585 then takes into account the statistical set for each of the characterized media types which have been studied. In the illustrated embodiment, the media type with the lowest weighted error is assigned a ranking of three (3) points. The media type with the second lowest error is assigned a ranking of two (2) points, and the media type with the third lowest error is given a ranking of one (1) point, as shown in FIG. 28.

The media type having the highest sum of the ranking points across all of the specular and diffuse frequency components is then selected as the best fit for characterizing the fresh sheet of media entering the printzone 25. The select print mode routine 512 then selects the best print mode, which is delivered to the printing routine 514 where the corresponding rendering and color mapping is performed to generate an optimum quality image on the particular type of media being used.

8. Major Category & Specific Type

Media Type Determination Routines

Having dispensed with preliminary matters, our discussion will now turn to the major category determination and the specific type determination routines 506 and 508. This discussion will cover how the routines 506 and 508 are interwoven to provide information to multiple verification and select print mode steps, ultimately resulting in printing an image on the incoming sheet of media according to a print mode selected by routine 500 to produce an optimum image on the sheet, in light of the available information known. FIGS. 29–32 together describe the major category and specific type determination routines 506 and 508.

Figure 29:
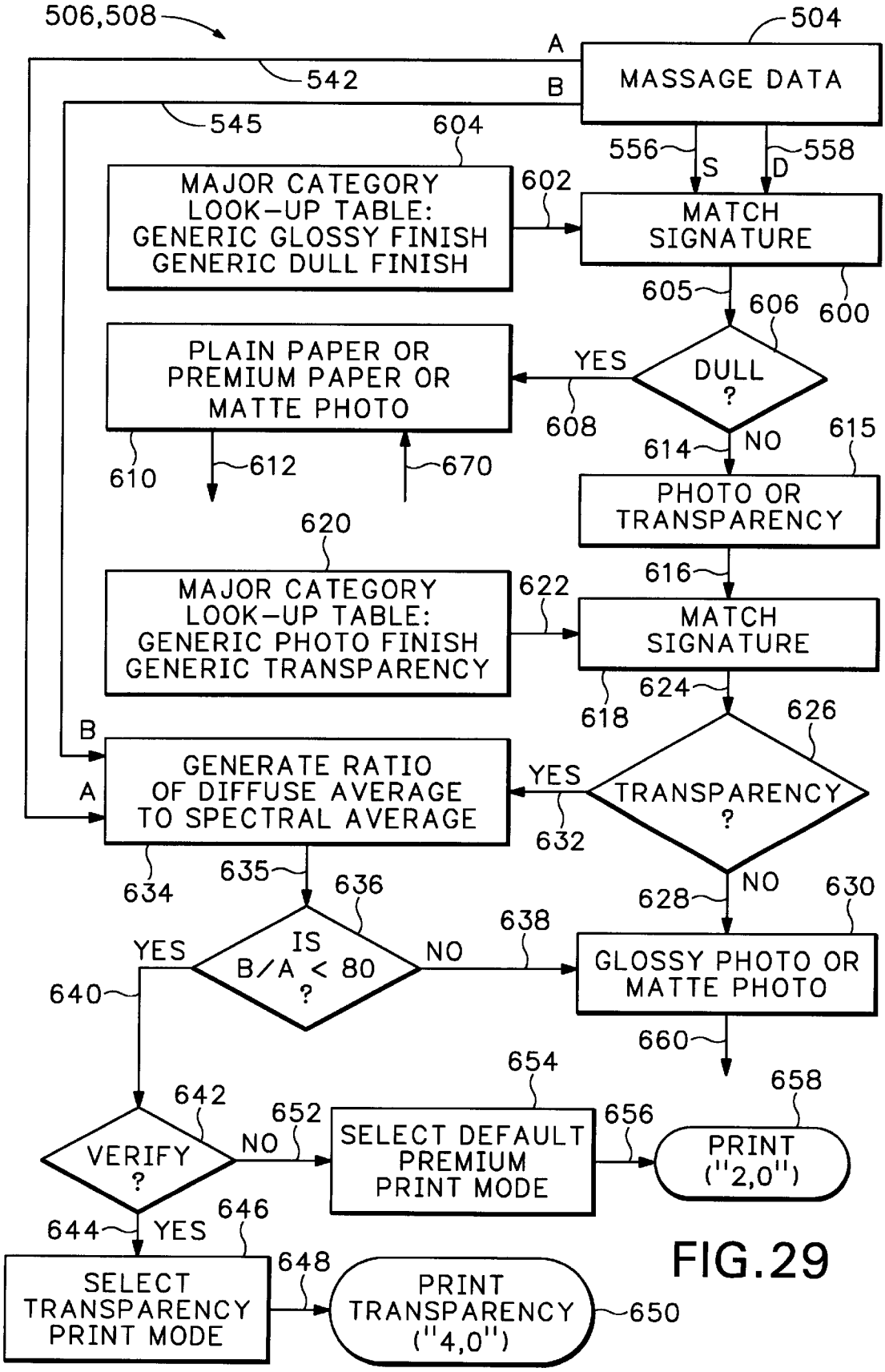

Referring first to FIG. 29, the massage data routine 504 is shown as first supplying the specular and diffuse spatial frequency data 556 and 558 to a match signature step 600. Step 600 receives an input signal 602 from a major category look-up table 604. Table 604 contains both specular and diffuse spatial frequency information for a generic glossy finish media and a generic dull finish media. The term "generic" here means an average or a general category of information, basically corresponding to a gross sorting routine. The match signature routine 600 then compares the incoming massaged data for both the specular and diffuse reflectances 556 and 558 with the reference values 602 from table 604, and then produces a match signal 605. In a comparison step 606, the question is asked whether the incoming matched data 605 corresponds to media having a dull finish. If it does, a YES signal 608 is issued to a plain paper, premium paper, or a matte photo branch routine 610. The photo branch routine 610 issues an output signal 612, which is further processed as described with respect to FIG. 31 below. However, if the dulled determination step 606 determines that the match signature output signal 605 is not dull, a NO signal 614 is issued to a photo or transparency decision branch 615.

The photo or transparency branch 615 sends a data signal 616 carrying the massaged specular and diffuse spatial frequency data 556 and 558 to another match signature step 618. A second major category look-up table 620 supplies an input 622 to the second match signature step 618. The data supplied by table 620 is specular and diffuse spatial frequency information for two types of media, specifically a generic photo finish media, and a generic transparency media. The match signature step 618 then determines whether the incoming data 616 corresponds more closely to a generic photo finish data, or a generic transparency data according to a gross sorting routine. An output 624 of the match signature step 618 is supplied to a comparison step 626, which asks whether the match signature output signal 624 corresponds to a transparency. If not, a NO signal 628 is issued to a glossy photo or a matte photo branch 630.

However, if the match signature output 624 corresponds to a transparency, then the comparison step 626 issues a YES signal 632. For the yes transparency signal 632 is received by a ratio generation step 634. In response to receiving the YES signal 632, the ratio generation step 634 receives the average specular (A) signal 542, and the average diffuse (B) signal 545 from the massage data routine 504. From these incoming signals 542 and 545, the ratio generation step 634 then generates a ratio of the diffuse average to the specular average (B/A) multiplied by 100 to convert the ratio to a percentage, which is supplied as a ratio output signal 635. In a comparison step 636, the value of the ratio signal 635 is compared to determine if the ratio B/A as a percentage is less than a value of 80 per cent (with the "%" sign being omitted in FIG. 29 for brevity). If not, the comparison step 636 issues a NO signal 638 to the glossy photo or matte photo branch 630.

Thus, the average specular and diffuse data are used as a check to determine whether the transparency determination was correct or not. If the ratio that the diffuse averaged to the specular average is determined by step 636 to be less than 80, a YES signal 640 is then supplied to a verification step 642. The verified step 642 may be performed as described above with respect to FIG. 27. During this verification routine, an assumption is made according to step 560 that the media in the print zone is a transparency, and if the verification routine 642 determines that it indeed is, a YES signal 644 is issued. The YES signal 644 is received by a select transparency mode step 646, which issues a transparency print signal 648 to initiate a transparency step 650. The print mode selected by step 646 corresponds to a "4,0" print mode, here selecting the default value for a transparency.

If a Hewlett-Packard transparency is identified, as described above with respect to FIG. 18, then a custom print mode may be employed for the specific HP transparency media, as described above with respect to the basic media determination system 400, resulting in a "4,1" print mode. If the verification step 642 determines that the media in the printzone is not a transparency, then a NO signal 652 is issued. Upon receiving the NO signal 652, a select default step 654 chooses the default premium print mode, and issues a print signal 656. Upon receiving signal 656, a print step 658 then prints upon the media according to the generic premium media print mode "2,0".

Figure 30:
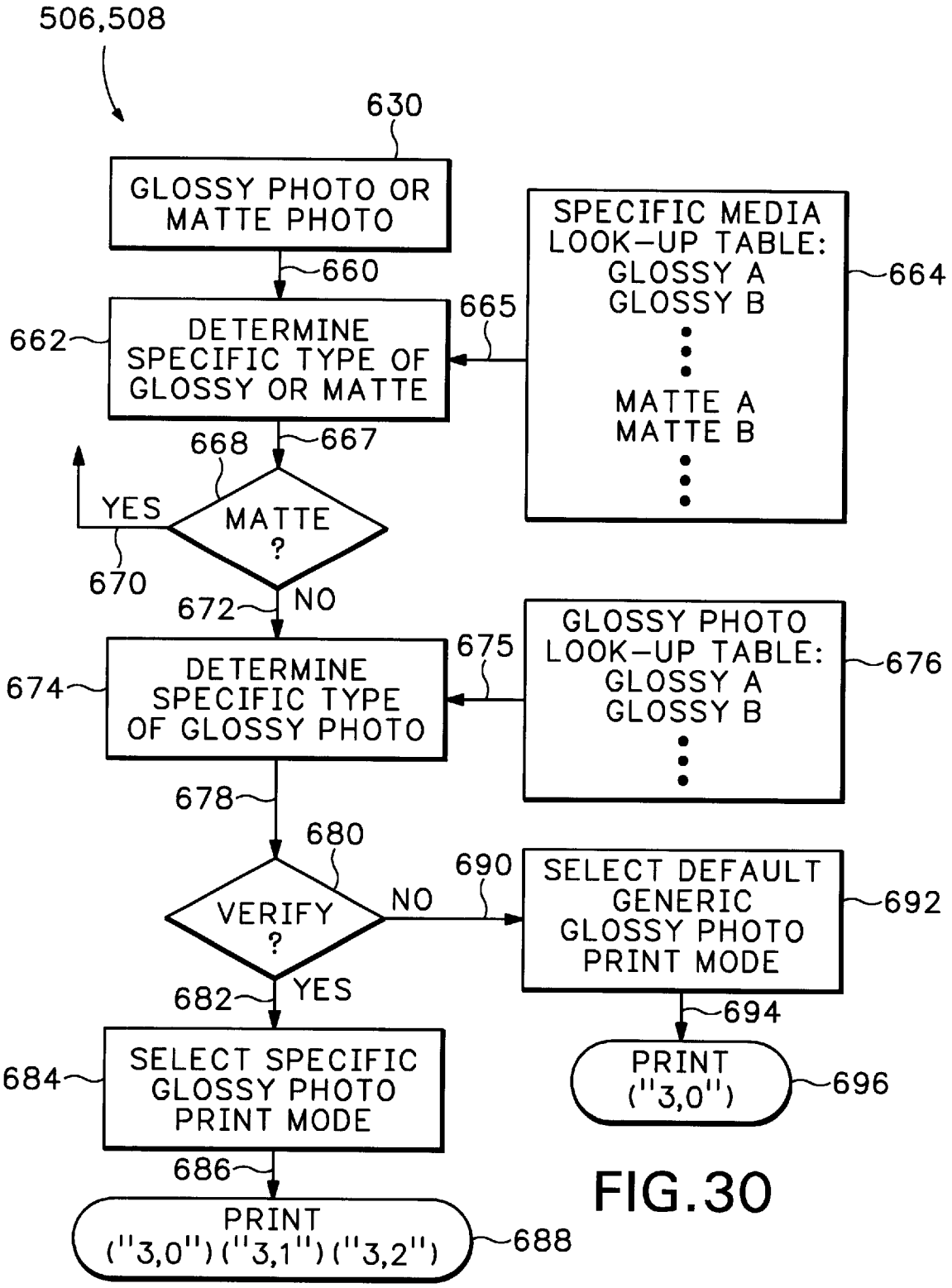

FIG. 30 begins with the glossy photo or matte photo branch 630 from FIG. 29, which issued an output signal 660, carrying through the massaged specular and diffuse spatial frequency data (S and D) signals 556 and 558. This input signal 660 is received by a determination step 662 which determines whether the incoming data 660 corresponds to a specific type of glossy media or a specific type of matte photo media. To accomplish this, a specific media look-up table 664 provides an input signal 665 to the determination step 662. Table 664 contains reference data corresponding to the specular and diffuse spatial frequencies corresponding to various types of glossy photo media and matte photo media, illustrated in table 664 as "glossy A", "glossy B", and so on through "matte A", "matte B", and so on. Several types of glossy photo media and matte photo media were described above with respect to Table 2.

Figure 31:
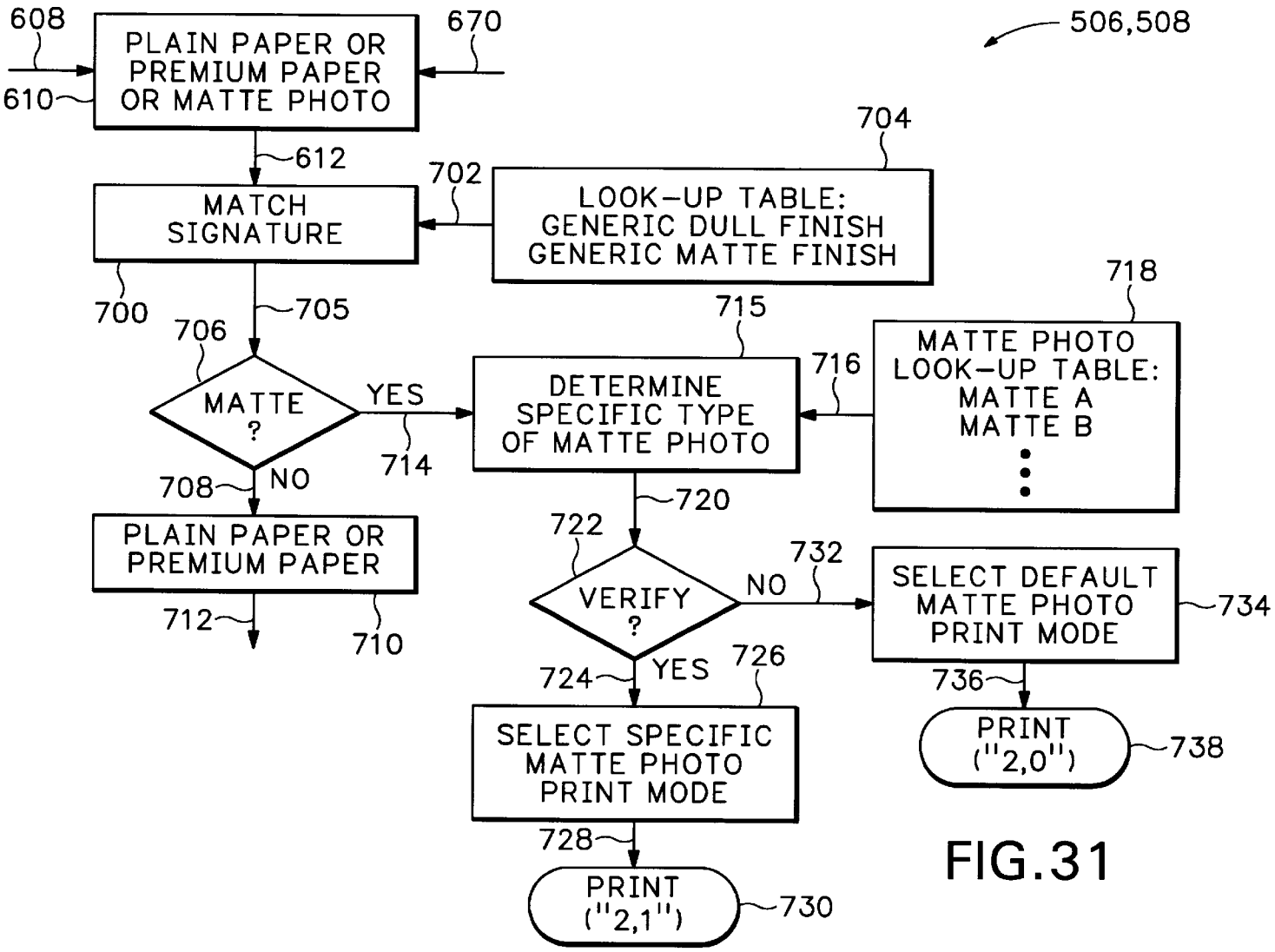

Once the determination step 662 finds a suitable match from the values stored in table 664, an output signal 667 is issued to a comparison step 668. The comparison step 668 asks whether the incoming signal 667 is for a matte photo media. If so, a YES signal 670 is issued. The YES signal 670 is then delivered to the plain paper/premium paper/matte photo branch 610, as shown in FIGS. 29 and 31. If the comparison step 668 finds that the output of determination step 662 does not correspond to a matte photo, then a NO signal 672 is issued. The NO signal 672 delivers the specular and diffuse spatial frequency data to another determination step 674. Step 674 determines which specific type of glossy photo media is entering the printzone 25 using data received via signal 675 from a glossy photo look-up table 676. While tables 664 and 676 are illustrated in the drawings as two separate tables, it is apparent that the determination step 674 could also query table 664 to obtain glossy photo data for each specific type.

After step 674 determines which specific type of glossy photo media is in the printzone 25, a signal 678 is issued to a verification routine 680 which proceeds to verify the assumption as described above with respect to FIGS. 27 and 28. If the verification routine 680 finds that the determination step 674 is correct, a YES signal 682 is issued to a select specific glossy photo print mode step 684. The selection step 684 generates a print mode signal 686 which initiates a print step 688. The printing step 688 then prints upon the sheet of glossy photo media using the print mode corresponding to the selected media, here according to "3,0" print mode for Gossimer media, a "3,1 " print mode for the combination media, and a "3,2" print mode for the very glossy photo media.

If the verification routine 680 finds that the determination step 674 was wrong regarding the specific type of glossy photo selected, a NO signal 690 is issued. In response to receiving the NO signal 690, a select default step 692 selects a generic glossy photo print mode and issues signal 694 to a print step 696. The print step 696 then prints upon the media according to a generic print mode, here selected as "3,0" print mode.

Travelling now to FIG. 31, we see the plain paper/premium paper/matte photo branch 610 receiving an input signal 608 from FIG. 29, and another input signal 670 from FIG. 30. Both signals 608 and 670 carry the specular and diffuse spatial frequency data for the media entering printzone 25. In response to receiving either signal 608 or 670, the branch 610 issues an output signal 612 carrying the spatial frequency data to a match signature routine 700. The match signature routine 700 reviews reference data 702 received from a look-up table 704 where data is stored for a generic dull finish media and a generic matte photo finish media. When the matching step 700 has completed analyzing the incoming data 612 with respect to the data 702 stored in table 704, an output signal 705 is issued.

A comparison step 706 reviews the output signal 705 to determine whether the matching step 700 found the incoming media to have a matte finish. If not, the comparison step 706 issues a NO signal 708 which is delivered to a plain paper/premium paper branch 710. In response to receiving the NO signal 708, branch 710 issues an output signal 712 which transitions to the last portion of the major and specific type determination routines 506, 508 shown in FIG. 32. Before leaving FIG. 31 we will discuss the remainder of the steps shown there.

If the comparison step 706 determines that the matching step 700 found the incoming media to have a matte finish, a YES signal 714 is issued. A determination step 715 receives the YES signal 714, and then determines which specific type of matte photo media is entering the printzone 25. The determining step 715 receives a reference data signal 716 from a matte photo look-up table 718, which may store data for a variety of different matte photo medias. Note that while table 718 is shown as a separate table, the determination step 715 could also consult the specific media look-up table 664 of FIG. 30 to obtain this data. Note that for the purposes of illustration, data is shown in both tables 664 and 718 for a "Matte A" and "Matte B" media, to date the characteristics for only a single matte photo media has been identified, and further research is required to generate reference data to allow identification of other types of matte photo media.

Following the completion of the determination step 715, an output signal 720 is issued to a verification routine 722. If the verification routine 722 determines that the correct type of matte photo media has been identified, a YES signal 724 is issued. In response to the YES signal 724, a selecting step 726 chooses which specific matte photo print mode to use, and then issues a signal 728 to a printing step 730. The printing step 730 then uses a "2,1" print mode when printing on the incoming sheet. If the verification routine 722 finds that the determination step 715 was in error, a NO signal 732 is issued. A selecting step 734 responds to the incoming NO signal 732 by selecting a default matte photo print mode. After the selection is made, step 734 issues an output signal 736 to a printing step 738. In the printing step 738, the media is then printed upon using the default print mode, here a "2,0" print mode which corresponds to the default print mode for premium paper in the illustrated embodiment.

Figure 32:
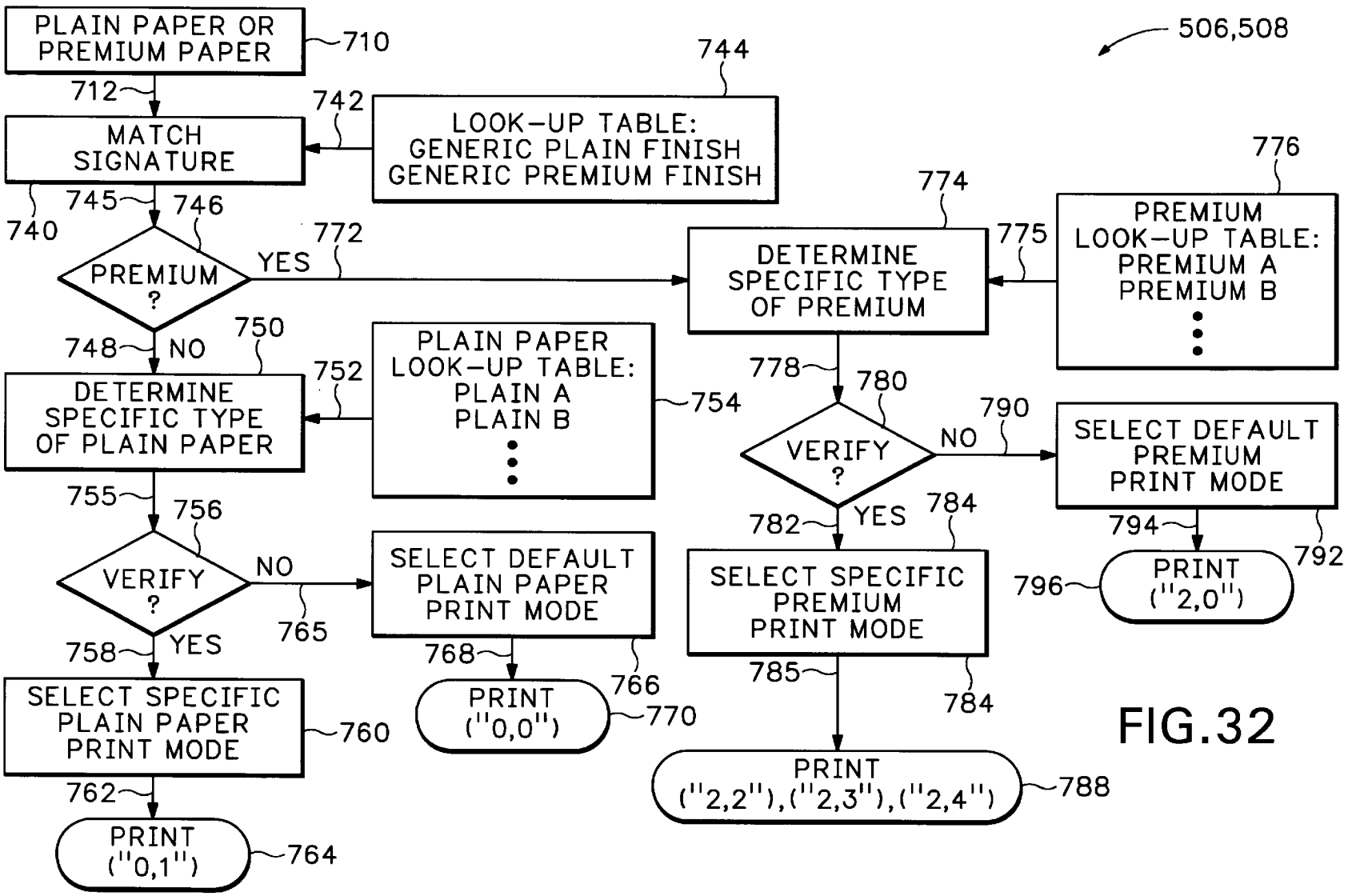

Turning now to FIG. 32, the plain paper/premium paper branch 710 is shown issuing an output signal 712 which includes data for both the specular and diffuse spatial frequency of the media entering the printzone 25. In response to receiving signal 712, a matching step 740 compares the incoming data with reference data received via a signal 724 from a look-up table 744. The look-up table 744 stores data corresponding to a generic plain finish media, and a generic premium finish media. The matching step 740 then decides whether the incoming data 712 more closely corresponds to a plain paper media, or a premium paper and issues an output signal 745. In a comparison step 746, the question is asked whether the output of the matching step 740 corresponds to a premium paper. If not, then a NO signal 748 is issued to a determination step 750.

The determination step 750 uses reference data received via a signal 752 from a plain paper look-up table 754. The look-up table 754 may store data corresponding to different types of plain paper media which have been previously studied. Once the determination step 750 decides which type of plain paper is entering the printzone, an output signal 755 is issued. A verification routine 756 receives the output signal 755 and then verifies whether or not the sheet of media entering the printzone 25 actually corresponds to the type of plain paper selected in the determination step 750. If the verification step 756 finds that a correct selection was made, a YES signal 758 is issued to a selecting step 760. In the selecting step 760, a print mode corresponding to the specific type of plain paper media identified is chosen, and an output signal 762 is issued to a printing step 764. The printing step 764 then prints on the incoming media sheet according to a "0,1 " print mode.

If the verification step 756 finds that the determination step 750 was in error, a NO signal 765 is issued to a selecting step 766. In the selecting step 766, a default plain paper print mode is selected, and an output signal 768 is issued to a printing step 770. In the printing step 770, the incoming sheet of media is printed upon according to a "0," default print mode for plain paper.

Returning to the premium comparison step 746, if the media identified in the match signature step 740 is found to be a premium paper, a YES signal 772 is issued. In response to receiving the YES signal 772, a determination step 774 then determines which specific type of premium media is in the printzone 25. To do this, the determination step 774 consults reference data received via signal 775 from a premium look-up table 776. Upon determining which type of specific premium media is entering the printzone 25, the determination step 774 issues an output signal 778. Upon receiving signal 778, a verification step 780 is initiated to determine the correctness of the selection made by step 774. If the verification step 780 determines that yes indeed a correct determination was made by 774, a YES signal 782 is issued to a selecting step 784. The selecting step 784 then selects the specific premium print mode corresponding to the specific type of premium media identified in step 774. After the selection is made, an output signal 785 is issued to a printing step 788. The printing step 788 then prints upon the incoming sheet of media according to the specific premium print mode established by step 784, which may be a "2,2" print mode corresponding to premium media having a clay coating, a "2,3" print mode corresponding to a plain paper having a swellable polymer layer, or "2,4" print mode corresponding to a heavy greeting card stock, in the illustrated embodiments.

If the verification step 780 finds that the determination step 774 was in error, a NO signal 790 is issued to a selecting step 792. In the selecting step 792, a default premium print mode is selected and an output signal 794 is issued to another printing step 796. In the printing step 796, the incoming sheet of media is printed upon according to a default print mode of "2,0".

9. Operation of the Media Sensor

The next portion of our discussion delves into one preferred construction of the media sensor 515 (FIG. 21) and the differences between the advanced media type detection system 500 and the earlier basic media type determination system 400.

Figure 33:
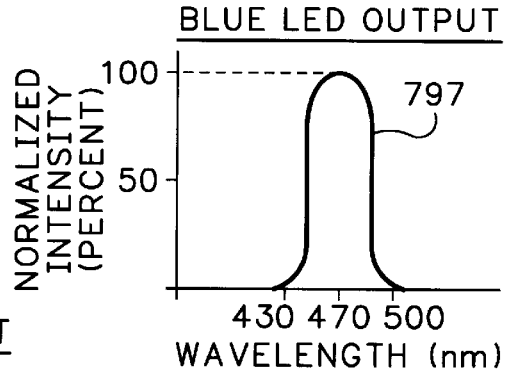
FIG. 33 is a graph illustrating the spectrum light output of the monochromatic optical sensor of FIGS. 2–8, which uses a blue colored light emitting diode ("LED").

The basic media determination system 400 only uses the diffuse reflectance information, as can be seen in FIG. 7. The basic system 400 extracted more information regarding the unique reflectance properties of media by performing a Fourier transform on the diffuse data. The spatial frequency components generated by the basic method 400 characterized the media adequately enough to group media into generic categories of (1) transparency media, (2) photo media, and (3) plain paper. One of the main advantages of the basic method 400 was that it used an existing sensor which was already supplied in a commercially available printer for ink droplet sensing. FIG. 33 shows the output amplitude graph 797 of the monochromatic optical sensor LED 120, used in the basic media determination system 400. As described previously, the blue LED 120 has a peak wavelength of 470 nanometers, with the photodiode 130 measuring reflectances at approximately 470 to 500 nanometers, which falls within the blue spectrum.

A more advanced media type determination was desired, using the spatial frequencies of only the diffuse reflectance with sensor 100 was not adequate to uniquely identify the specific types of media within the larger categories of transparency, photo media and plain paper. The basic determination system 400 simply could not distinguish between specialty media, such as matte photo media, and glossy photo media like Gossimer. To make these specific type distinctions, more properties needed to be measured, and in particular properties which related to the coatings on the media surface. The manner chosen to gather information about these additional properties was to collect the specular reflectance light 200', as well as the diffuse reflectance light 200.

Figure 34:
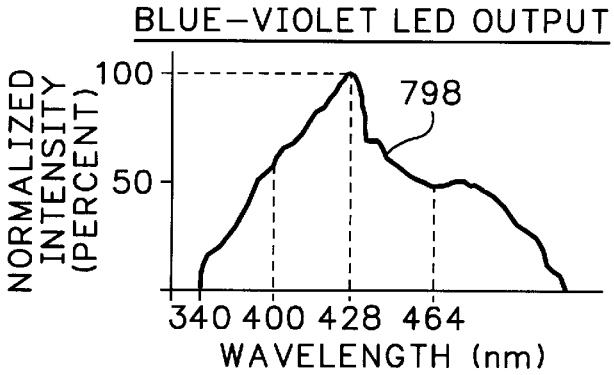
FIG. 34 is a graph of the specular light output of the media type determination of sensor FIG. 21, which uses a blue-violet colored LED.

In the advanced media sensor 515, the blue LED 120 was replaced by a blue-violet LED 520 which has an output shown in FIG. 34 as graph 798. In graph 798, we see the blue-violet LED 520 as a peak amplitude output at about 428 nanometers. The output also extends down to approximately 340 nanometers, into the ultraviolet range past the end of the visible range, which is around 400 nanometers. A comparison of the blue LED output graph 797 and the blue-violet LED output graph 798 shows that the blue-violet LED 520 covers a much broader spectrum than the blue LED 120. Indeed, the additional shift toward the larger wavelengths, yields a dominant wavelength of 464 nanometers for the blue-violet LED 520, which gives the LED 520 a more violet-colored hue than the blue LED 120. While the illustrated peak wavelength of 428 nanometers is shown, it is believed that suitable results may be obtained with an LED having a peak wavelength of 400–430 nanometers.

The short wavelength of the blue-violet LED 520 serves two important purposes in the collecting raw data routine 502. First, the blue-violet LED 520 produces an adequate signal from all colors of ink including cyan ink, so the sensor 515 may be used for ink detection, as described with respect to FIG. 11 as a substitute for the monochromatic optical sensor 100. Thus, the diffuse reflection measured by LED 130 of sensor 515 may still be used for performing pen alignment, as described above with respect sensor 100. The second purpose served by the blue-violet LED 520 is that the shorter wavelengths, as opposed to a 700–1100 nanometer infrared LED, is superior for detecting subtleties in the media coding, as described above with respect to Table 2.

Figure 35:
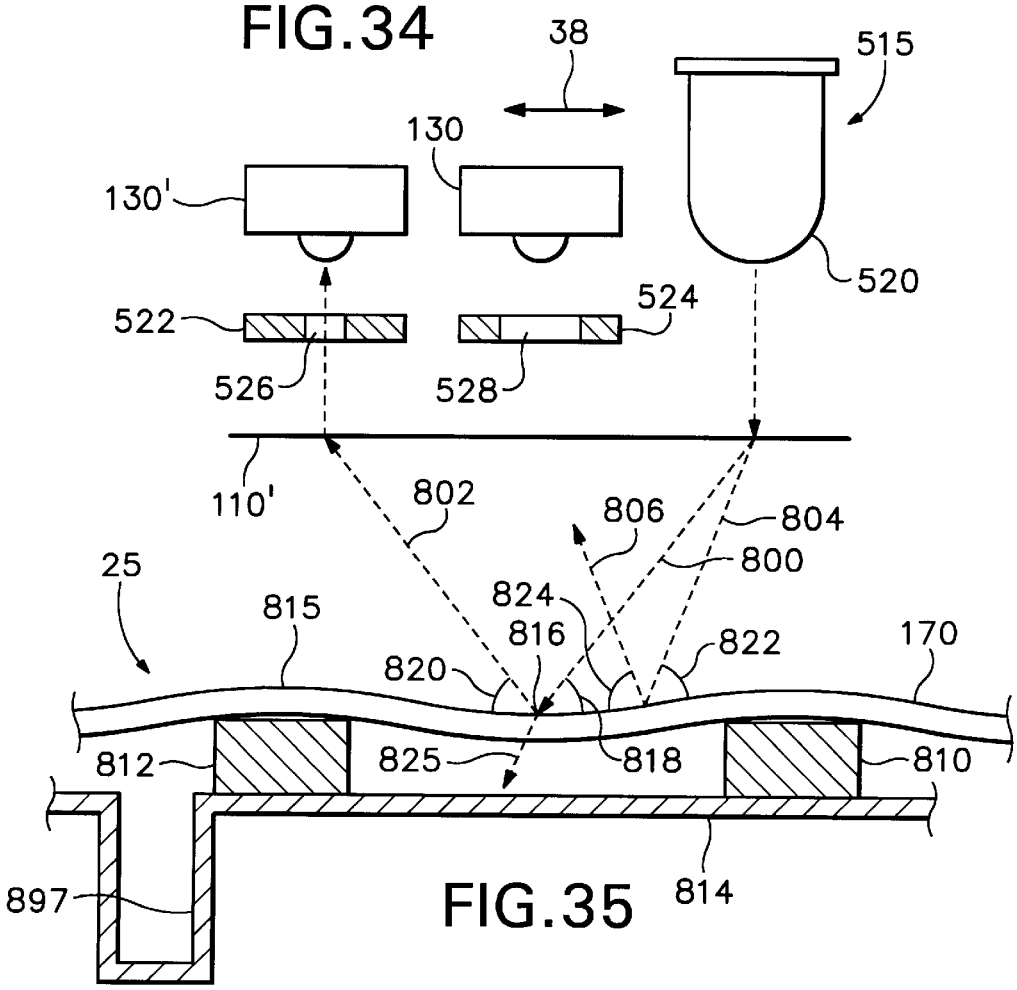
FIG. 35 is an enlarged schematic side elevational view of the media type optical sensor of FIG. 21, shown monitoring a sheet of plain paper or transparency media entering the printzone of the printer of FIG. 1.

FIG. 35 shows the media sensor 515 scanning over the top two millimeters of a sheet of media 170 entering the printzone 25. Here we see an incoming beam 800 generating a specular reflectance beam 802 which passes through the field stop window 526 to be received by the specular photodiode 130'. A second illuminating beam of light 804 is also shown in FIG. 35, along with its specular reflectance beam 806. As mentioned above, recall that the specular beam has an angle of reflection which is equal to the angle of incidence of the illuminating beam, with respect to a tangential surface of the media at the point of illumination. The sheet of media 170 is shown in FIG. 35 as being supported by a pair of cockle ribs 810 and 812, which project upwardly from a table-like portion of the platen or pivot 814. The cockle ribs 810, 812 support the media in the printzone 25, and provide a space for printed media which is saturated with ink to expand downwardly between the ribs, instead of upwardly where the saturated media might inadvertently contact and damage the printhead.

Figure 36:
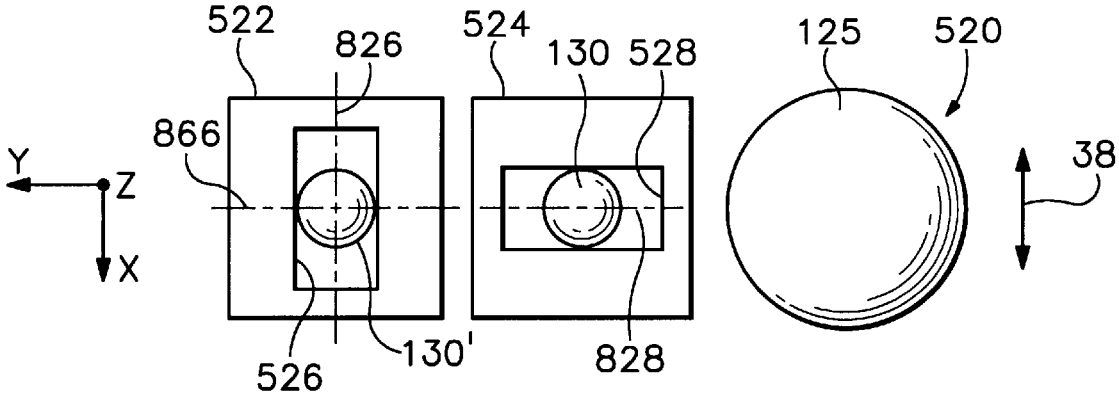
FIG. 36 is a bottom plan view of the media type optical sensor of FIG. 21, taken along lines 36—36 thereof.
Figure 37:
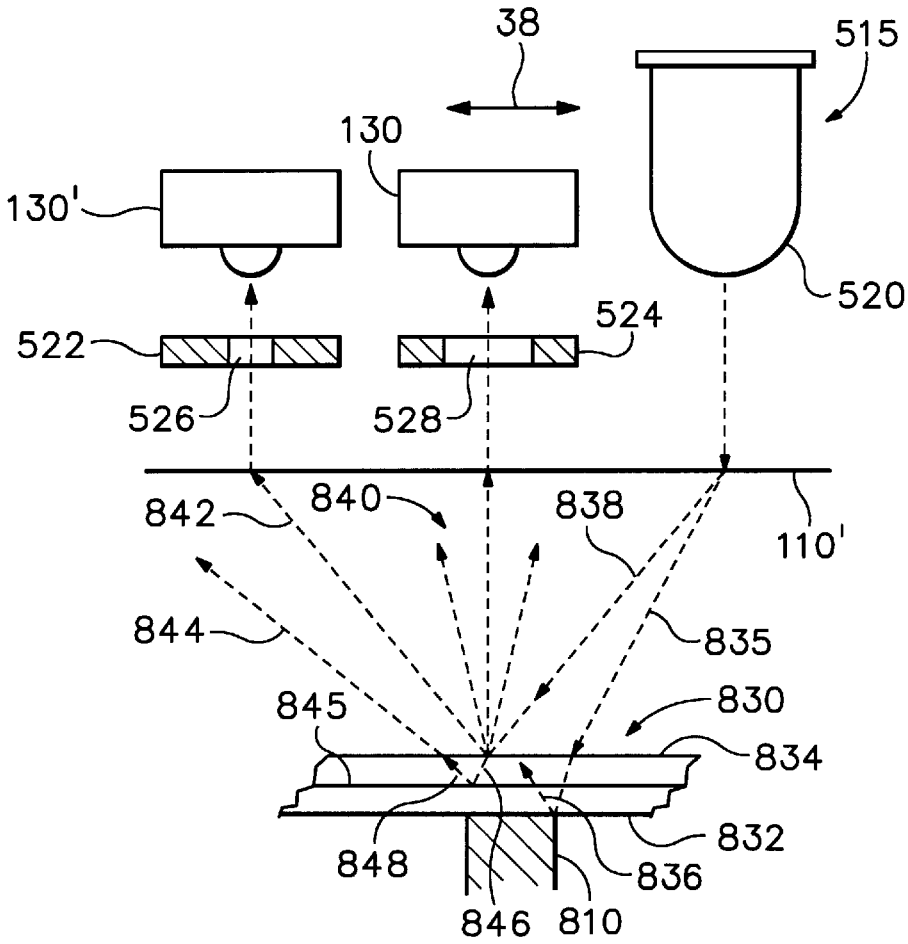
FIG. 37 is an enlarged schematic side-elevational view of the media type sensor of FIG. 21, shown monitoring a sheet of premium media entering the printzone of the printer of FIG. 1.
Figure 38:
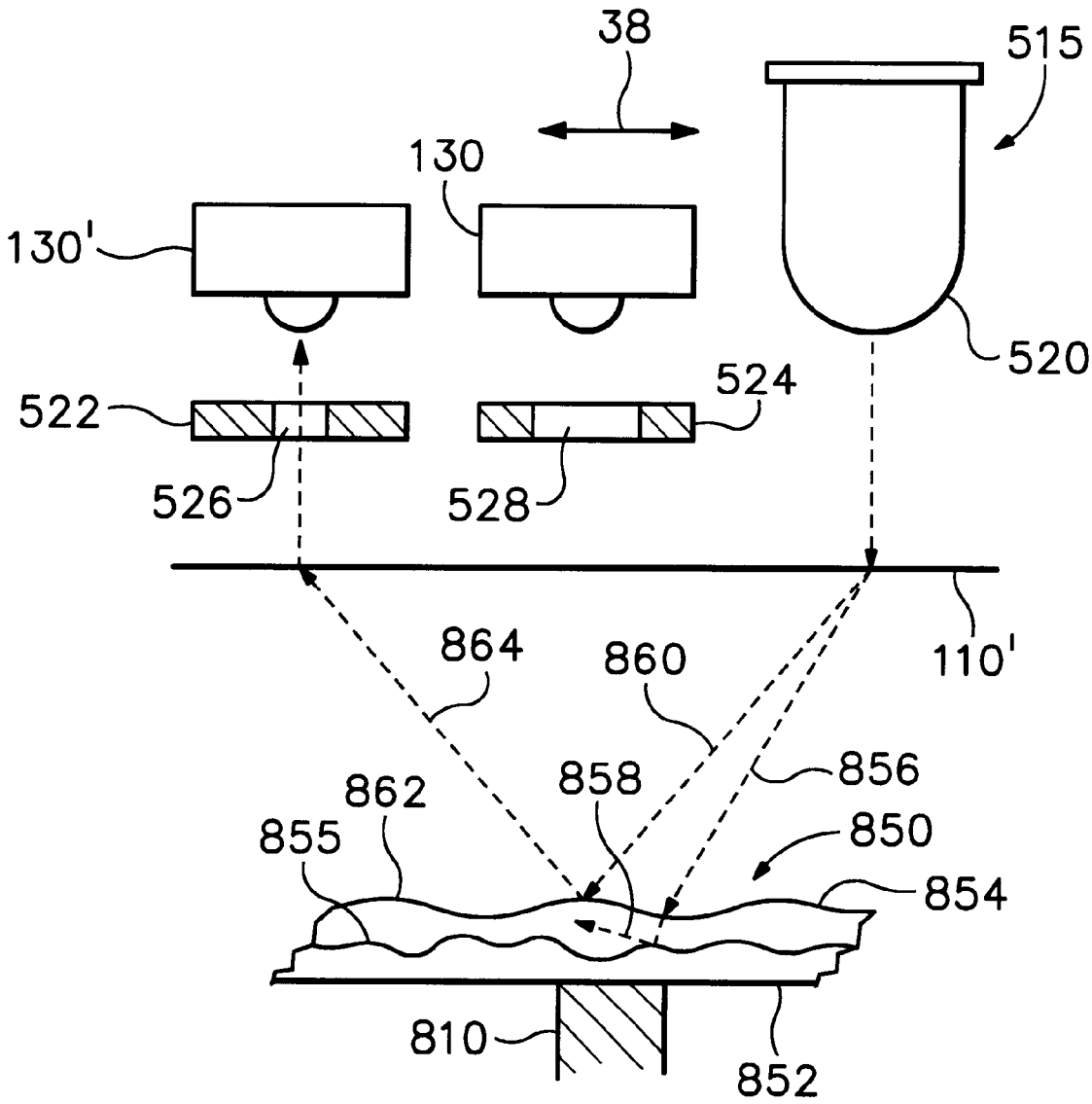
FIG. 38 is an enlarged schematic side-elevational view of the media type sensor of FIG. 21, shown monitoring a sheet of photo media entering the printzone of the printer of FIG. 1.

Some artistic license has been taken in configuring the views of FIGS. 35, 37 and 38 with respect to the orientation of the media sensor 515. The cockle ribs 810 and 812 are orientated correctly to be perpendicular to the scan axis 38; however, the LED 520 and sensors 130, 130' are oriented perpendicular to their orientation in the illustrated embodiment of printer 20. FIG. 36 shows the desired orientation of the media sensor 515 in printer 20 with respect to the XYZ coordinated axis system.

As the incoming sheet of media 170 rests on the ribs 810, 812 peaks are formed in the media over the ribs, such as peak 815, and valleys are also formed between the ribs, such as valley 816. The incoming beam 800 impacting along the valley 816 has an angle of incidence 818, and the specular reflected beam 802 has an angle of reflection 820, with angles 818 and 820 being equal. Similarly, the incoming beam 804 has an angle of incidence 822, and its specular reflected beam 806 has an angle of reflection 824, with angles 822 and 824 being equal. Thus, as the incoming light beams 800, 804 are moved across the media as the carriage 40 moves the media sensor 515 across the media in the direction of the scanning axis 38, the light beams 800, 804 traverse over the peaks 815, and through the valleys 816 which causes the specular reflectance beams 802 and 806 to modulate with respect to the specular photodiode 130'. Thus, this interaction of the media 170 with the cockle ribs 810, 812 on the media support platen 814 generates a modulating set of information which may be used by the advanced determination method 500 to learn more about the sheet of media 170 entering the printzone 25.

FIG. 36 shows the orientation of the field stop windows 526 and 528 with respect to the scanning axis 38. In the illustrated embodiment, the field stop windows 526 and 528 are rectangular in shape, with the specular window 526 having a major axis 826 which is approximately parallel to the scanning axis, and the diffuse field stop window 528 having a major axis 828 which is substantially perpendicular to the scanning axis 38. This orientation of the field stop windows 526, 528 allows the diffuse photodiode 130 to collect data which may further distinguished from that collected by the specular photodiode 130'.

10. Energy Information

Information to identify an incoming sheet of media may be gleaned by knowing the amount of energy supplied by the LED 520 and the amount of energy which is received by the specular and diffuse photodiodes 130', 130. For example, assume that the media 170 in FIG. 35 is a transparency. In this case, some of the incoming light from beam 800 passes through the transparency 170 as a transmissive beam 825. Thus, the amount of energy left to be received by the diodes 130 and 130' is less than for the case of plain paper for instance. In between the plain paper and the transparency paper is the reflectance of the glossy photo media, which has a shinier surface that yields more specular energy to be received by diode 130', than a diffuse energy to be received by photodiode 130. These differences in energy are shown in Table 3 below and provide one way to do a gross sorting of the media into three major categories.

TABLE 3

Energy Received by Sensors 130 and 130'

| Media Category | Diffuse Sensor 130 | Specular Sensor 130' |
|---|---|---|
| Plain & Premium Papers | 1/2 | 1/2 |
| Glossy Photo | 1/3 | 2/3 |
| Transparency (w/o Tape) | 1/5 | 4/5 |

Furthermore, by knowing the input energy supplied by the blue-violet LED 520, and the output energy received by the specular and diffuse sensors 130 and 130', the value of the transmittance property of the media may be determined, that is the amount of energy within light beam 825 which passes through media sheet 170 (see FIG. 35). The magnitude of the transmittance is equal to the input energy of the incoming beam 800, minus the energy of the specular reflected beam 802 and the diffuse reflected beam, such as light 200 in FIG. 21. After assembly of the printer 20, during initial factory calibration, a sheet of plain paper is fed into the printzone 25, and the amount of input light energy from the LED 520 is measured, along with the levels of energy received by the specular and diffuse sensors 130' and 130. Given these known values for plain paper, the transmittance for photo paper and transparency media may then be determined as needed. However, rather than calculating the transmissivity of photo papers and transparency media, the preferred method of distinction between plain or premium paper, photo paper and transparency media is accomplished using the information shown in Table 3.

Thus in the case of a transparency, the majority of the diffuse energy travels directly through the transparency, with any ink retention layer coating over the transparency serving to reflect a small amount of diffuse light toward the photodiode 130. The shiny surface of the transparency is a good reflector of light, and thus the specular energy received by photodiode 130' is far greater than the energy received by the diffuse photodiode 130. This energy signature left by these broad categories of media shown in Table 3 may be used in steps 552 and 554 of the determination system 500. The energy ratios effectively dictate the magnitude of the frequency components. For a given diffuse and specular frequency, the energy balance may be seen by comparing their relative magnitudes.

11. Media Support Interaction Information

As mentioned above with respect to FIG. 35, interaction of the media with the printer's media support structure, here the pivot, may be used to gather information about the incoming sheet of media. In other implementations, this information may be gathered in other locations by supporting the media sensor 515 with another printing mechanism component, and backing the media opposite the sensor with a component having a known surface irregularity which imparts a degree of bending to the media, as well as changing the apparent transmissivity of the media. For instance, in plotters using media supplied in a continuous roll, a cutter traverses across the media following a print job to sever the printed sheet from the remainder of the supply roll. The sensor 515 may be mounted on the cutter carriage to traverse the media, although such a system may require the leading edge of the incoming sheet to be moved rearwardly into a top-of-form position under the printheads following scanning. Indeed, in other implementations, it may be desirable to locate the media scanner 515 remote from the printzone 25, such as adjacent the media supply tray, or along the media path between the supply tray and the printzone 25, provided that the media was located between the sensor and a backing or support member having a known surface irregularity opposite the media sensor 515.

In the illustrated printer 20, the cockle ribs 810 and 812 generate a modulating signature as the sensor 515 passes over peaks 815 and valleys 816 on the media sheet 170. The degree of bending of the media sheet 170 over the ribs 810 and 812 is a function of the modulus of elasticity (Young's Modulus), as well as the thickness of the media. Thus, the degree of bowing in the media sheet 170 may be used to gather additional information about a sheet entering the printzone 25.

For example, some premium media has the same surface properties as plain paper media, such as the greeting card media and adhesive-backed sticker media. However, both the sticker media and the greeting card media are thicker than convention plain paper media so the bending signatures of these premium medias are different than the bending signature of plain paper. In particular, the spatial frequency signatures are different at the lower end of the spatial frequency spectrum, particularly in the range of 1.4 to 0.1 cycles per inch. In this lower portion of the spatial frequency spectrum, lower amplitudes are seen for the thicker premium media as well as for glossy photo and matte photo medias. Thus, the signature imparted by the effect of the cockle ribs 810, 812 may be used to distinguish premium media and plain paper, such as in steps 710 of the determination system 500. It is apparent that other printing mechanisms using different media support strategies in the printzone 25, other than ribs 810 and 812 or other configurations of media support members may generate their own unique set of properties which may be analyzed to impart a curvature to the media at a known location (S) and this known information then used to study the degree of bending imparted to the different media types.

12. Surface Coating Information

While the effect of the cockle ribs 810, 812 is manifested in the lower spatial frequencies, such as those lower than approximately 10 cycles per inch, the effect of the surface coatings is seen by analyzing the higher spatial frequencies, such as those in the range of 10–40 cycles per inch. FIG. 37 illustrates a coated sheet of media 830, having a backing sheet or substrate 832 and a coating 834, such as an ink retention layer of a swellable material, or of a porous material, several examples of which are discussed above with respect to Table 2. In FIG. 37, we see one incoming light beam 835 which travels through the coating layer 834 and the substrate 832, and is reflected off of the rib 810 as a specular reflected beam 836. Another incoming beam 838 from the blue-violet LED 520 is shown generating three different types of reflected beams: (1) a group of diffuse beams 840 which are received by the diffuse sensor 130, (2) an upper surface reflected specular beam 842 which is received by the specular sensor 130', and (3) a boundary layer specular reflected beam 844 which is formed when a portion of the incoming beam 838 goes through the coating layer 834 and reflects off a boundary 845 defined between the substrate 832 and the coating layer 834. This boundary 845 may also be considered to be the upper surface of the substrate layer 832.

The characteristics provided by the boundary reflected beam 844 may be used to find information about the type of coating 834 which has been applied over the substrate layer 832. For example, the swellable coatings used on the glossy photo media and the slightly glossy premium media described above with respect to Table 2 are typically plastic polymer layers which are clear, to allow one to see the ink droplets trapped inside the ink retention layer 834. Different types of light transmissive solids and liquids have different indices of refraction, which is a basic principle in the study of optics. The index of refraction for a particular material, such as glass, water, quartz, and so forth is determined by the ratio of the speed of light in air versus the speed of light in the particular media. That is, light passing through glass moves at a slower rate than when moving through air. The slowing of the light beam entering a solid or liquid is manifested as a bending of the light beam at the boundary where the beam enters the media, and again at the boundary where the light beam exits the optic media. This change can be seen for a portion 846 of the incoming light beam 838. Rather than continuing on the same trajectory as the incoming beam 838, beam 846 is slowed by travel through the coating layer 834 and thus progresses at a more steep angle toward the boundary layer 845 than the angle at which the incoming beam 838 encountered the exterior surface of coating layer 834. The angle of incidence of the incoming beam 846 is then equal to the angle of reflection of the reflected beam 848 with respect to the boundary layer 845. As the reflected beam 848 exits the coating layer 834, it progresses at a faster rate in the surrounding air, as indicated by the angle of the remainder of the reflected beam 844.

Now that the index of refraction is better understood, as the ratio of the speed of light in air versus the speed of light in a particular medium, this information can be used to discover properties of the coating layer 834. As mentioned above, "dispersion" is the change in the index of refraction with changes in the wavelength of light. In plastics, such as the polymer coatings used in the glossy photo media and some premium medias, this dispersion increases in the ultra-violet light range. Thus, the use of the blue-violet LED 520 instead of the blue LED 120 advantageously accentuates this dispersion effect. Thus, this dispersion effect introduces another level of modulation which may be used to distinguish between the various types of glossy photo media as the short wavelength ultra-violet light (FIG. 34) accentuates the change in the angle of the exiting beam 844, and this information is then used to distinguish specific photo glossy medias. This modulation of the dispersion may be used in step 574 of the media determination system 500.

Note in FIG. 35, that the transmissive beam 825 has been drawn with a bit of artistic license, in the fact that the angle of incidence has been ignored as the transmissive beam 825 is shown going straight through the sheet 170, although it is now better understood that a more correct illustration which show a steeper path through the sheet of media than through the surrounding air. Before moving on, one further point should be noted concerning the effect of the ribs 810, 812 on the information collected by the media sensor 515. FIG. 35 shows the transmissive beam 825 travelling through the sheet of media 170 between ribs 810 and 812, whereas FIG. 37 shows an incoming beam 835 being reflected off of rib 810 as the specular reflected beam 836. While the media shown in FIG. 37 is a coated substrate, even plain paper will reflect light off of the ribs 810 as shown for beam 836. Thus, more light is seen by the specular sensor 130' when the sensor 515 passes over a rib 810, 812 then the amount of light received when the sensor 515 passes through a valley 816 between the ribs. The lower energy received when traversing a valley 816 is due to the fact that not all of the energy supplied by the incoming beam 800 is reflected to sensor 130' at 802, because some of the incoming energy passes through the media 170 in the form of the transmissive beam 825. Thus, the variations in energy levels received by the specular sensor 130' varies with respect to the presence or absence of ribs 810, 812. FIG. 38 illustrates two other methods by which the various types of media may be classified using the determination system 500. In FIG. 38 we see a multi-layered sheet of media 850, which has a backing or substrate layer 852 and a clear swellable coating layer 854. Here we see a substrate layer 852 which has a rough surface, forming a rough boundary 855 between the coating layer 854 and the substrate 852. Depending upon at which point an incoming beam of light 856 impacts the boundary layer 855, the resulting reflected specular beam 858 has a high modulation as the beam traverses over the rough boundary layer 855 or moved by carriage 40 parallel to the scanning axis 38. The media 850 in FIG. 38 has a rough backing layer, whereas the illustrated media 830 in FIG. 37 has a backing layer which performs a smooth internal boundary 845. As described above with respect to Table 2, Gossimer media has a swellable polymer coating which is applied over a polymer photo substrate, with the substrate having a smooth surface more resembling media 830 of FIG. 37. The very glossy media which has two layers of a polymer coating over a plastic backing substrate also has a smooth boundary layer 845 as shown in FIG. 37. However, the combination photo media has the same polymer coating as the Gossimer media, but this coating is applied over a photo paper, which may have rougher boundary more closely resembling boundary layer 855 in FIG. 38. Thus, this information about the boundary layer 855 may be used to distinguish between specific types of photo media, such as in step 674 (FIG. 30) of the determination system 500.

The other phenomenon that may be studied with respect to FIG. 38 is the characteristics of the specular beam reflecting off of the upper surface of the coating layer 854. In FIG. 38, an incoming light beam 860 is shown reflecting off of an upper surface 862 of the coating layer 854, to produce a specular reflected beam 864. As mentioned above, the ink retention layers formed by coatings, such as coating 854 are clear layers, which are typically applied using rollers to spread the coating 854 over the substrate 852. In the medias under study thus far, it has been found that different manufacturers use different types of rollers to apply these coating layers 854. The uniqueness of each manufacturer's rollers imparts a unique signature to the upper surface 862 of the coating layer 854. That is, during this coating application process, the rollers create waves or ripples on the surface 862, as shown in FIG. 38. These ripples along the coating upper surface 862 have low magnitude, high frequency signatures which may be used to distinguish the various glossy photo media types.

Alternatively, rather than looking for specific modulation signatures in the specular spatial frequency graph, the ripples formed in the upper surface 862 also impart a varying thickness to the ink retention layer 854. This varying thickness in the coating layer 854 produces changes in the boundary reflected beam 858, as the incoming beam 856 and the reflected beam 858 traverse through varying thicknesses of the ink retention layer 854. It should be noted here, that the swellable coatings on the photo medias, such as the Gossimer media, the combination media, and the very glossy photo media experience this rippling effect along the coating upper surface 862. In contrast, the porous coatings used on the premium medias, such as the matte photo media, or the clay coated media are very uniform coatings, having substantially no ripple along their upper surfaces, as shown for the media sheet 830 in FIG. 37. Thus, the surface properties of the coatings may be used to distinguish the swellable coatings which have a rippled or rough upper surface from the porous premium coatings which have very smooth surface characteristics. The one exception in the premium category of Table 2 is the slightly glossy media which has a swellable ink retention layer like coating 854 of FIG. 38, but which is applied over a plain paper. This slightly glossy media having a swellable ink retention layer (IRL) applied over plain paper may be distinguished from media having a swellable IRL over photo paper by comparing the rough nature of the plain paper and with the smoother surface of the photo paper at the boundary layer 855 in FIG. 38. Alternatively, the peaks 815 and valleys 816 formed by ribs 810 and 812 may be used to make this distinction, knowing that the photo paper substrate is stiffer and bends less than the plain paper substrate when traveling through the printzone 25, yielding different reflectance signatures.

Another advantage of using the ultra-violet LED 520, is that refraction through the polymer coating layers 834, 854 increases as the wavelength of the incoming light beams decreases. Thus, by using the shorter wavelength ultra-violet LED 520 (FIG. 34), the refraction is increased. As the thickness of the coating 854 thickens, or the index of the refraction varies, for instance due to composition imperfections in the coating, the short wavelength ultra-violet light refracts through a sufficient angle to move in and out of the field of view of the specular sensor 130'. As shown in FIGS. 34, 35 and 37–38, the specular field stop 522 has the window 526 oriented with a minor axis 866 aligned along a central axis of the sensor 515. Thus, the specular field stop 552 provides a very small field of view in the axis of illumination, which is shown parallel to the page in FIGS. 35, 37 and 38. Thus, this modulation of the specular reflected beams 802, 858 and 864 is more acutely sensed by the specular photodiode 130' as these beams move in and out of the field stop window 526.

13. Raw Data Analysis

Now it is better understood how the advanced media determination system 500 uses the data collected by the media sensor 515, several examples of raw data collected for various media types will be discussed with respect to FIGS. 39–45. The next section will discuss the resulting Fourier spectrum components which are generated from this raw data in the massaging data routine 504.

Figure 39:
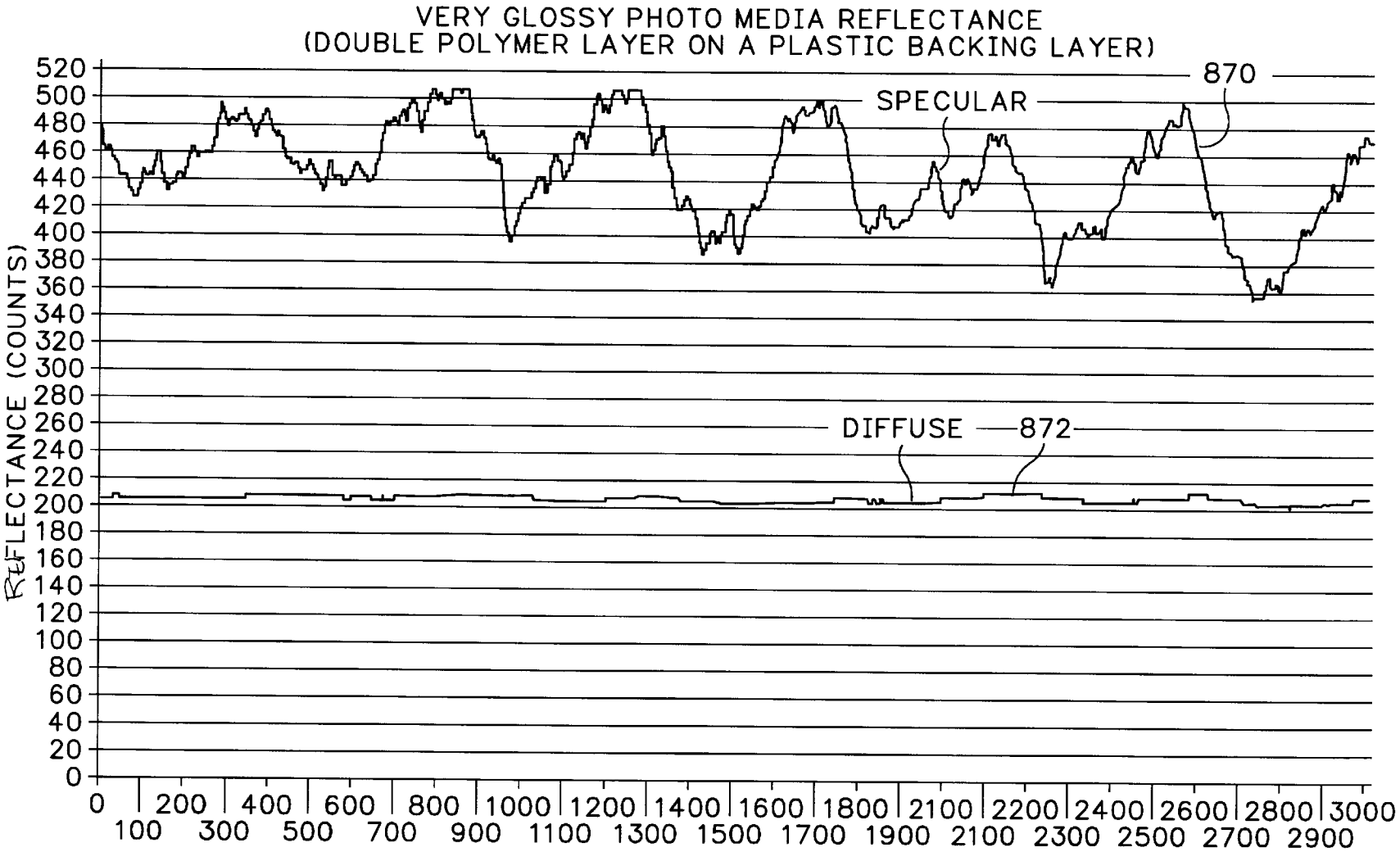
Figure 40:
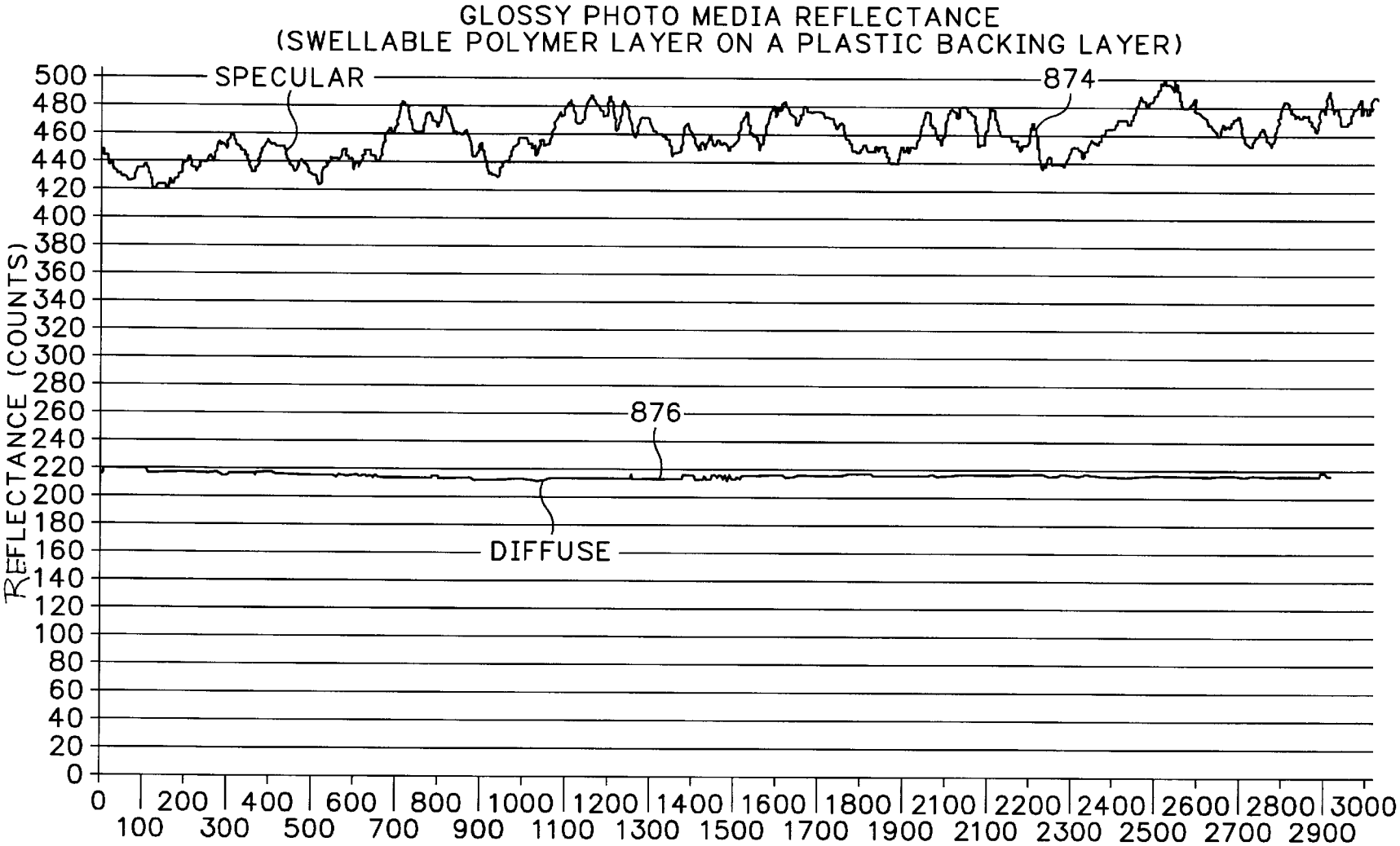
Figure 41:
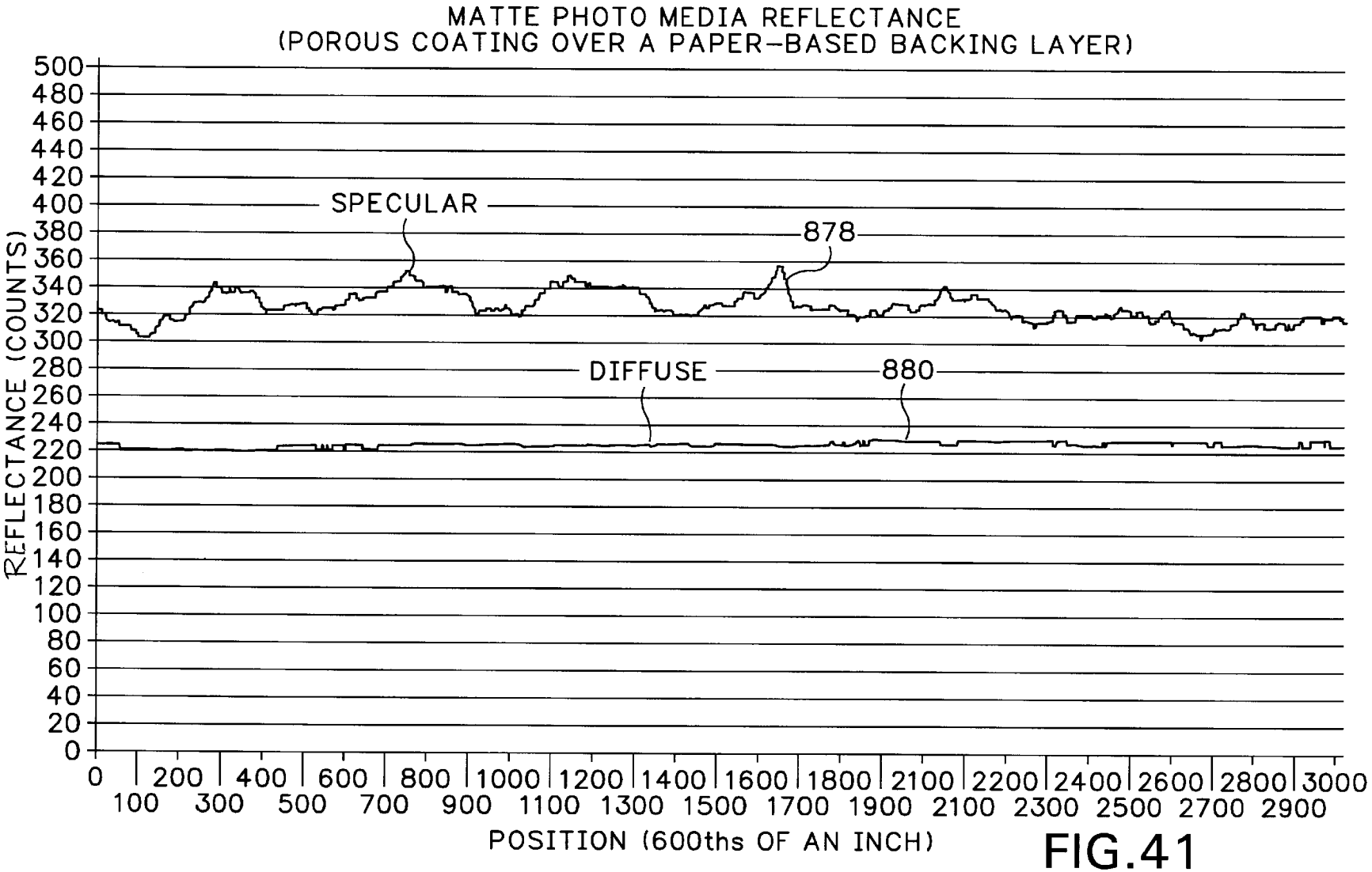
Figure 42:
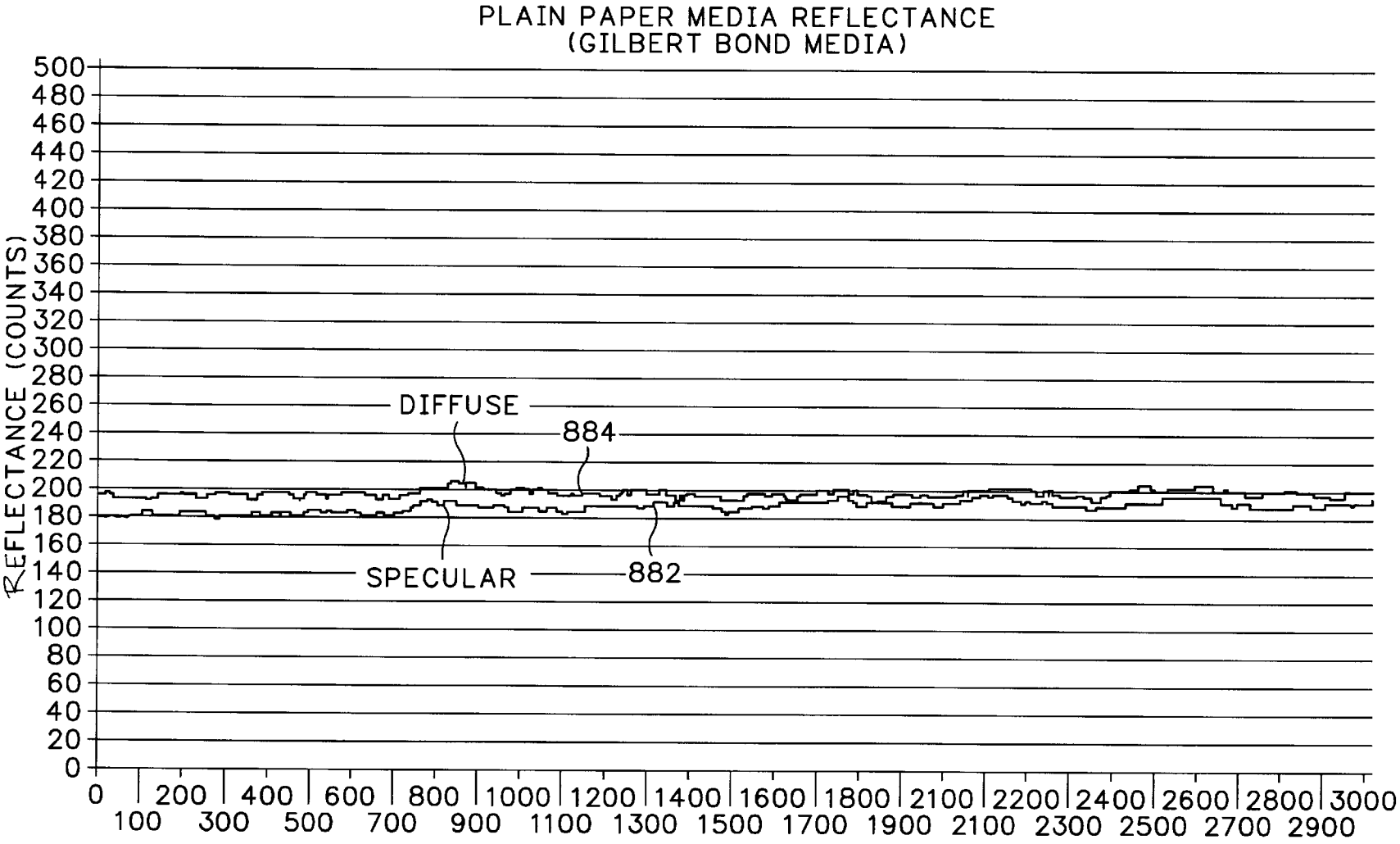
Figure 43:
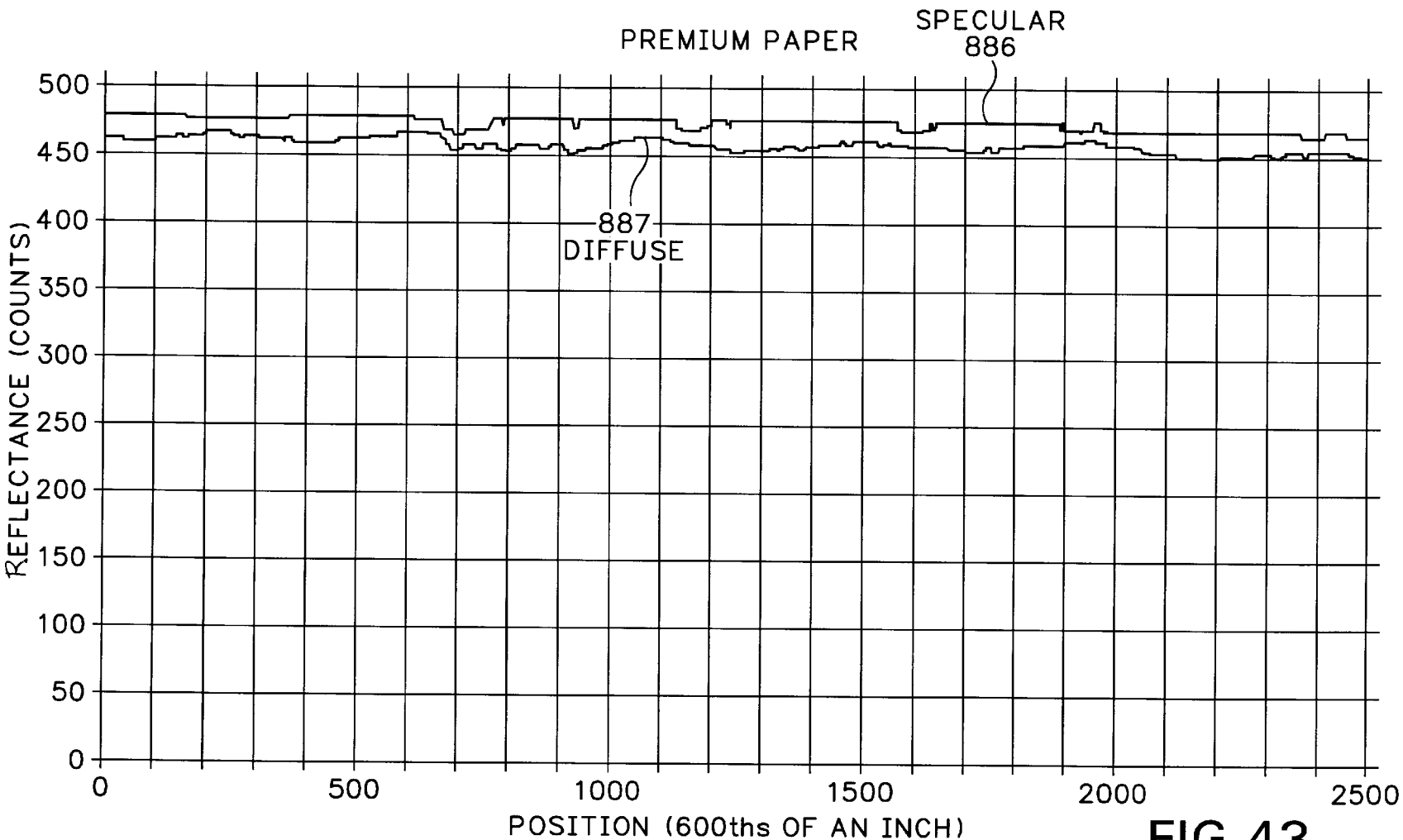
Figure 44:
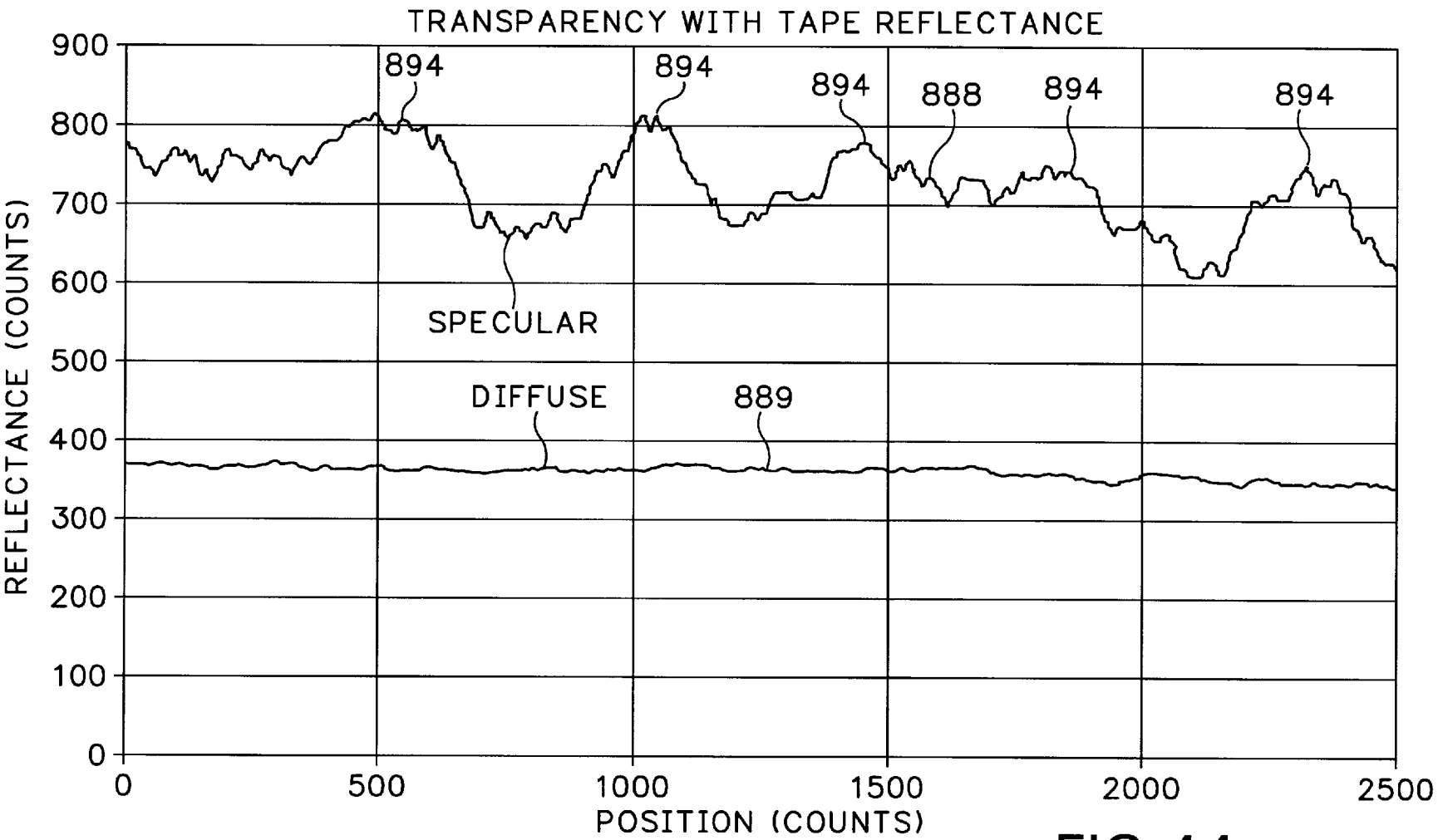
Figure 45:
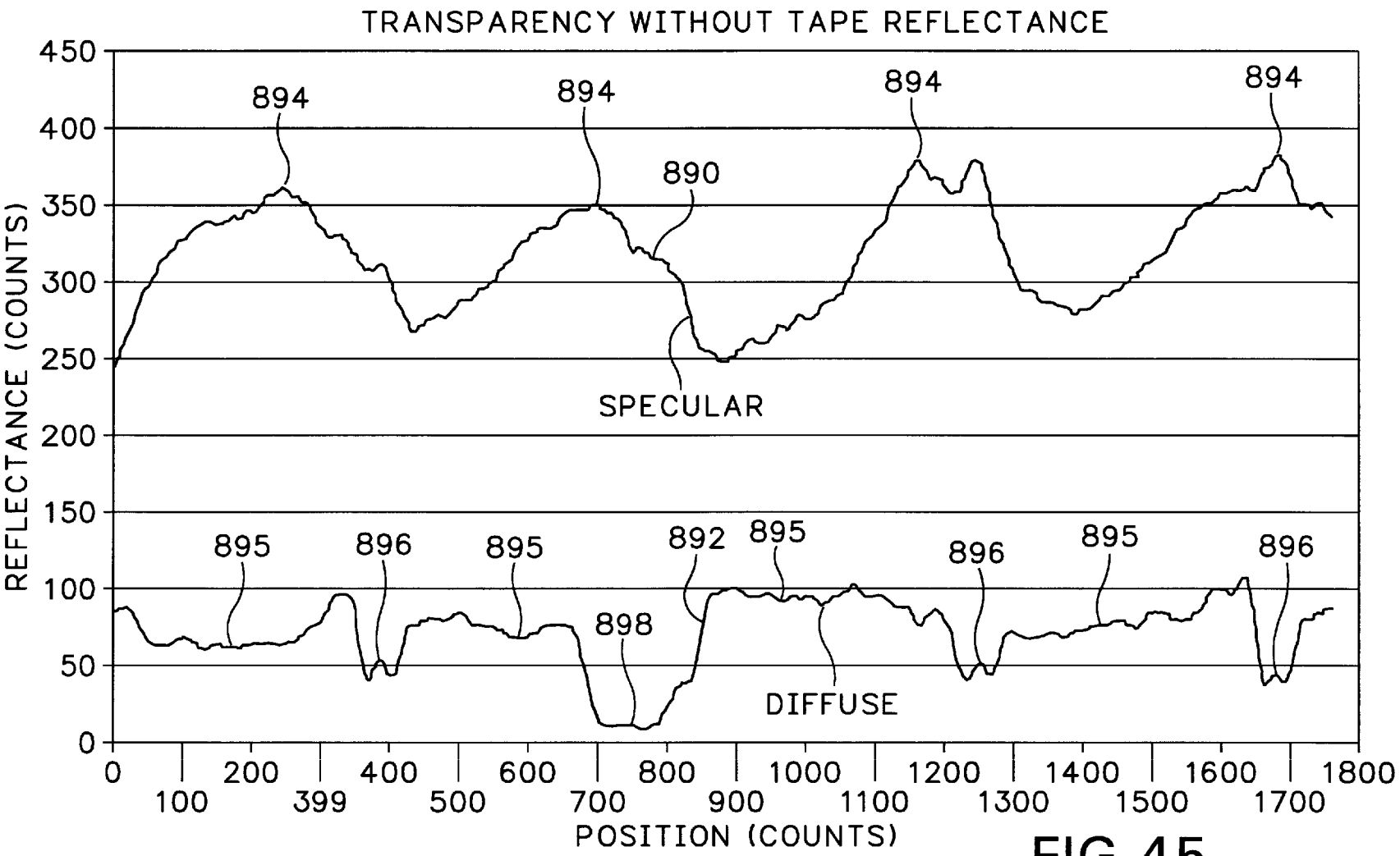
FIG. 45 showing data for transparency media without a tape header.

FIG. 39 shows the raw data collected during routine 502 for the very glossy photo media. Here we see the specular data curve 870. FIG. 39 also shows a diffuse curve 872. FIG. 40 shows the raw data for a glossy photo media, and in particular Gossimer, with a specular data being shown by curve 874, and the diffuse data being shown by curve 876. FIG. 41 shows the raw data for a matte photo media, with the specular data being shown as curve 878, and the diffuse data shown as curve 880. FIG. 42 shows the raw data for a plain paper media, specifically Gilbert® bond media, with the specular data being shown as curve 882, and the diffuse data being shown as curve 884. FIG. 43 shows the raw data for a premium media, with the specular data being shown as curve 886, and the diffuse data being shown as curve 887. FIG. 44 shows the raw data for HP transparency media, with the specular data being shown as curve 888, and the diffuse data being shown as curve 889. FIG. 45 shows the raw data for a generic transparency media, with the specular data being shown as curve 890, and the diffuse data being shown as curve 892.

As described above with respect to Table 2, the very glossy photo media has two layers of a swellable polymer applied over a plastic backing substrate layer, resembling the media 850 in FIG. 38. The specular curve 870 of the very glossy photo media (FIG. 39) has much greater swings in amplitude than the specular curve 874 for the glossy (Gossimer) photo media of FIG. 40 due to the double polymer coating layer on the very glossy media. Thus, the specular curves 870 and 874 may be used to distinguish the very glossy photo media from glossy photo media, while the diffuse 872 and 876 are roughly the same magnitude and shape, although the very glossy photo media curve 872 has a slightly greater amplitude than the glossy photo media diffuse curve 876.

In comparing the curves of FIGS. 39 and 40 with the matte photo curves of FIG. 41, it can be seen that the specular reflectance curve 878 for the photo media resides at a much lower amplitude than either of the photo media specular curves 870 and 874. Moreover, there is less variation or amplitude change within the matte photo specular curve 878, which is to be expected because the porous coating over the matte photo substrate, which is a paper substrate, has a much smoother surface than the swellable coatings applied over the glossy and very glossy photo media, as discussed above with respect to FIGS. 37 and 38. The diffuse curve 880 for the matte photo media is of similar shape to the diffuse curves 872 and 876 for the very glossy and glossy photo medias, although the amplitude of the matte photo diffuse curve 880 is closer to the amplitude of the very glossy diffuse curve 872.

FIG. 42 has curves 882 and 884 which are very different from the curves shown in FIGS. 39–41. One of the major differences in the curves of FIG. 42 versus the curves of FIGS. 39–41 is that the specular curve 882 is lower in magnitude than the diffuse curve 884, which is the opposite of the orientations shown in FIGS. 39–41 where the specular curves 870, 874 and 878 are of greater amplitude than the diffuse curves 872, 876 and 880, respectively. Indeed, use of the relative magnitudes of the specular and diffuse curves of FIGS. 39–42 has been described above with respect to Table 3. Another significant difference in the plain paper curves 882–884 is the similarity in wave form shapes of the specular and diffuse curves 882, 884. In FIGS. 39–41, there is a vast difference in the shapes of the specular curves 870, 874 and 878 versus the diffuse curves 872, 876 and 880.

FIG. 43 shows the reflectances for a premium media. While the premium specular and diffuse curves 886 and 887 most closely resemble the plain paper curves 882 and 884 of FIG. 42, they can be distinguished from one another, and indeed they are in the match signature step 740 of FIG. 32. A close examination of the specular curves 882 and 886 shows that the premium specular curve 886 is much smoother than the plain paper specular curve 882. This smoother curve 886 is to be expected due to the smoother IRL surface coating on the premium media versus the rougher non-coated plain paper.

At this point it should be noted that the relative magnitudes of the specular and diffuse curves may be adjusted to desired ranges by modifying the media sensor 515. For instance, by changing the size of the field stop windows 526 and 528, more or less light will reach the photodiode sensors 130' and 130, so the magnitude of the resulting reflectance curves will shift up or down on the reflectance graphs 39–45, although the relative shape of the curves will remain basically the same. This magnitude shift may also be accomplished through other means, such as by adjusting the gain of the amplifier circuitry. Indeed, the magnitude of the curves may be adjusted to the point where the specular and diffuse curves actually switch places on the graphs. For instance in FIG. 43, by downsizing the specular field stop window 526, the magnitude of the specular curve 886 may be dropped from the illustrated 475-count range to a position closer to the 225-count range. Such a change in the field stop size or the amplifier gain would of course also affect the other reflectance curves in FIGS. 39–42 and 44–45.

FIGS. 44 and 45 show the reflectances of an HP transparency media with a tape header 456, and a transparency media without a tape header, respectively. FIG. 44 shows a specular curve 888 and a diffuse curve 889. FIG. 45 shows a specular curve 890, and a diffuse curve 892. In both FIGS. 44 and 45, the specular curves 888 and 890 lie above the diffuse curves 889 and 892. However, the magnitude of the signals received by the transparency with reflective tape in FIG. 44 are much greater than the magnitudes of the transparency without the reflective tape in FIG. 45, which is to be expected due to the transmissive loss through the transparency without tape, leaving less light to be received by sensors 130 and 130' when viewing a plain transparency.

Besides the relative magnitudes between the graphs of FIGS. 44 and 45 there is a vast difference in the diffuse waveform 889 and 892, although the specular waveforms have roughly the same shape, with the location of ribs 810, 812 being shown at wave crest 894 in FIGS. 44 and 45. Regarding the diffuse waveforms 889 and 892, the HP transparency media with the tape header has a relatively level curve 889 because the undersurface of the tape is reflecting the incoming beams back up toward the diffuse sensor 130. The diffuse waveform of FIG. 45 is more interesting due to the transmissive loss experienced by the incoming beam, such as beam 800 in FIG. 35, losing energy in the form of the transmissive beam 825 leaving less energy available to reflect off the media surface upwardly into the diffuse sensor 130. Indeed, the locations of the valleys 816 between ribs 810 and 812 are shown at point 895 in FIG. 45, and the ribs are shown at point 896.

Another interesting feature of the media support structure of printer 20 is the inclusion of one or more kicker members in the paper handling system 24. These kickers are used to push an exiting sheet of media onto the media drying wings 28. To allow these kicker members to engage the media and push an exiting sheet out of the printzone, the platen 814 is constructed with a kicker slot, such as slot 897 shown in FIG. 35. As the optical sensor 515 transitions over slot 897, the transmissive loss caused by beam 825 increases, leaving even less light available to be received by the diffuse sensor 130, resulting in a very large valley or canyon appearing in the diffuse waveform 892 at location 898.

Thus, from a comparison of the graphs of FIGS. 39–45, a variety of distinctions may be easily made to separate the various major categories of media by merely analyzing the raw data collected by sensor 515.

14. Spatial Frequency Analysis

Figure 46:
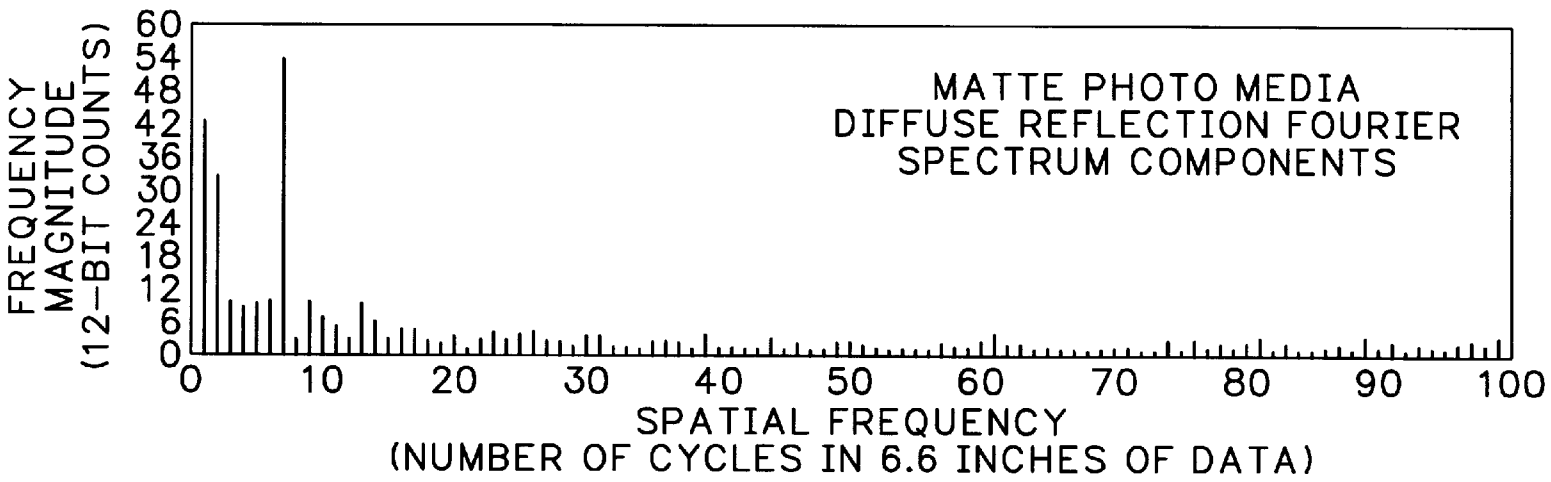
Figure 47:
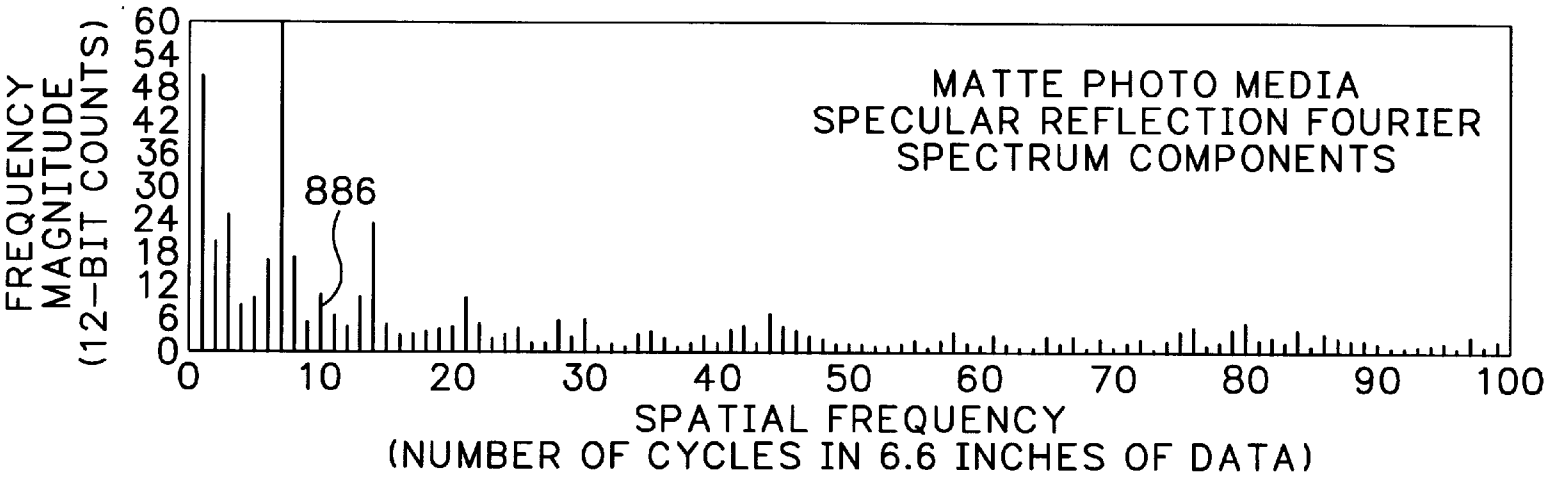
Figure 48:
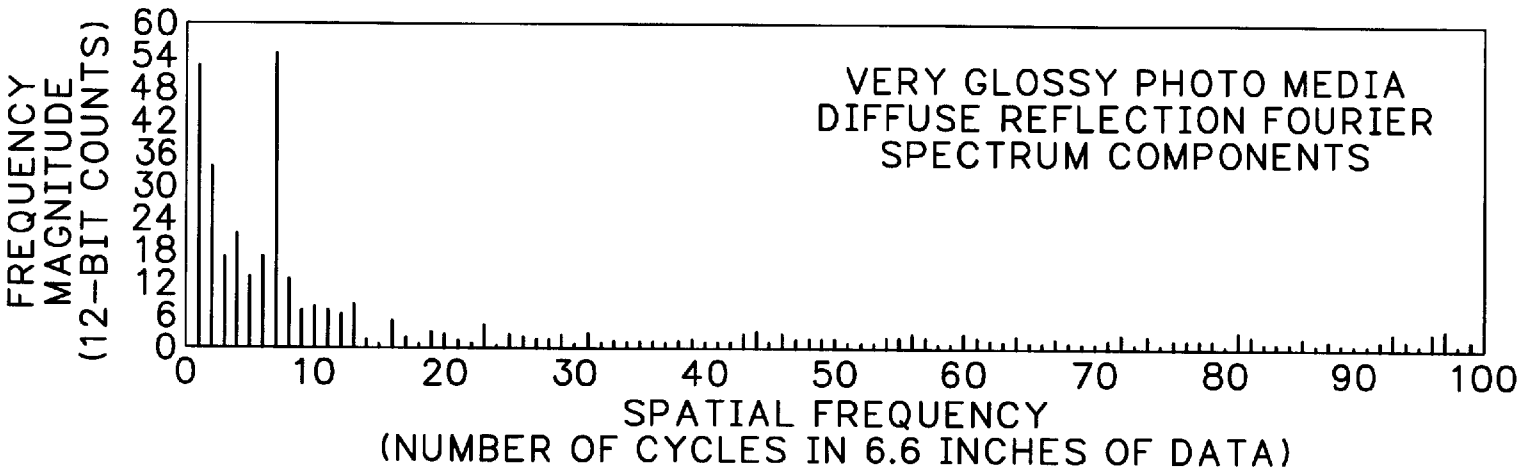
Figure 49:
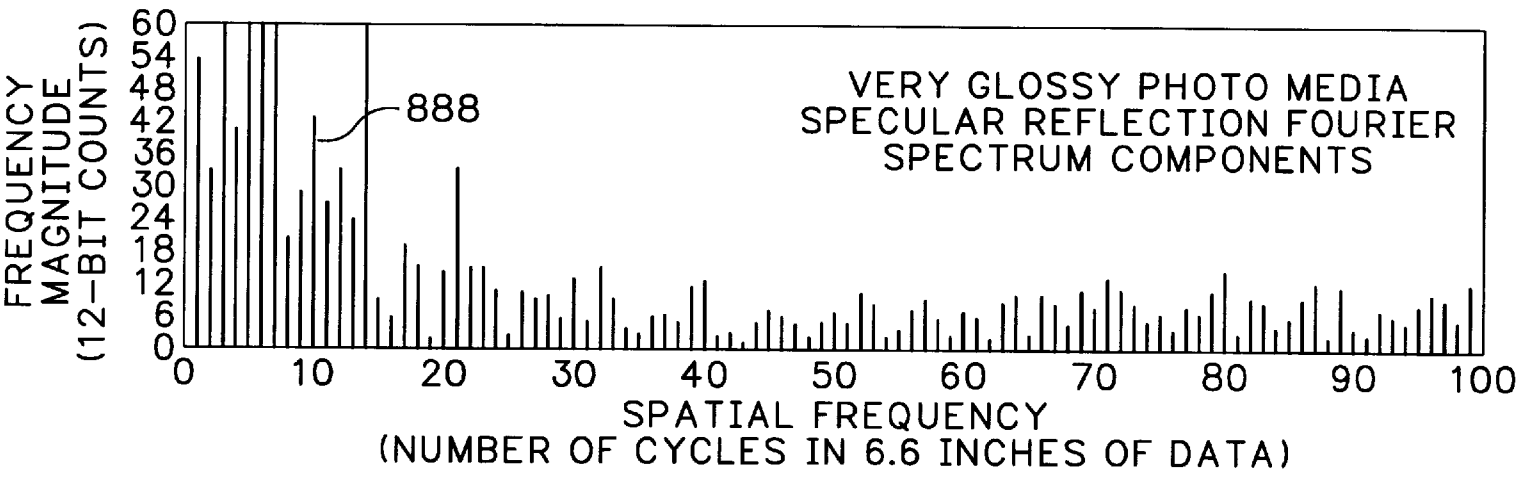
Figure 50:
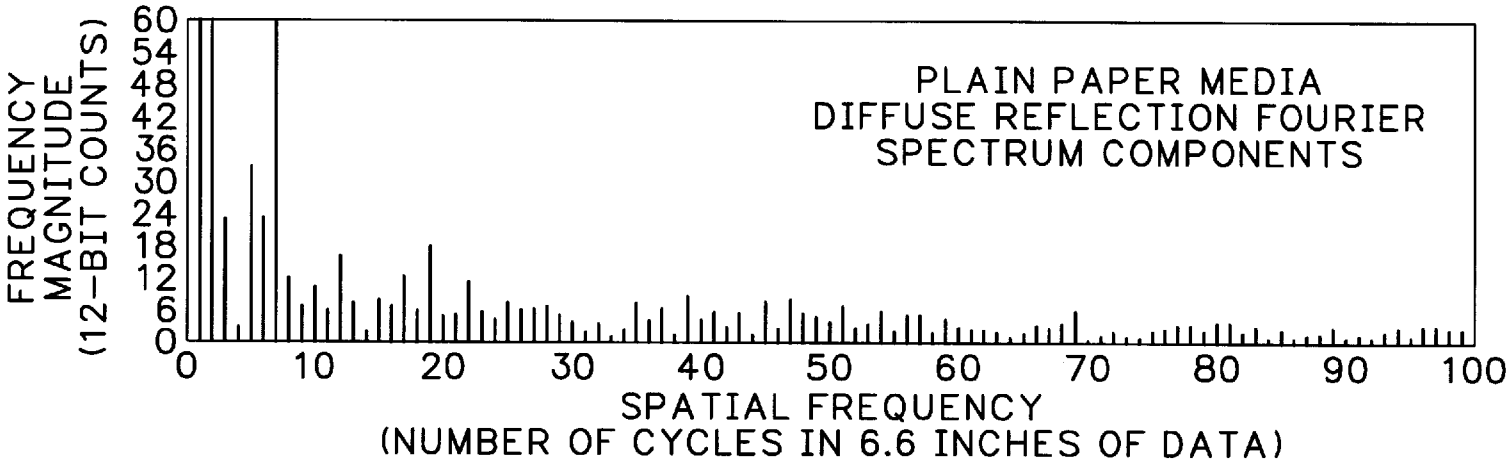
Figure 51:
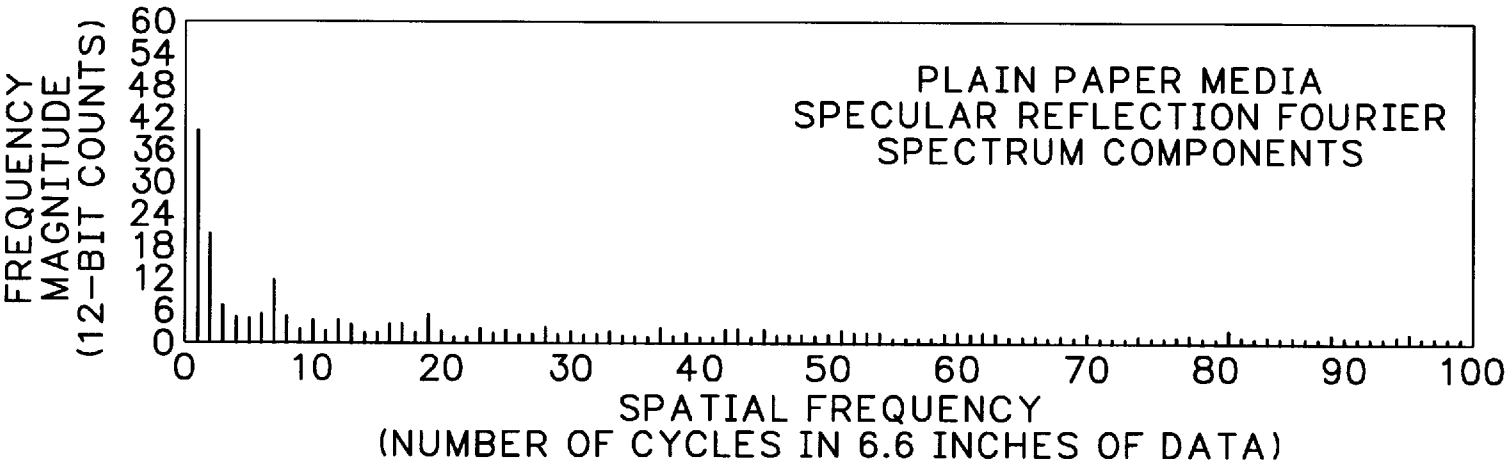

To find out more information about the media, the massage data routine 504 uses the raw data of FIGS. 39–45 in steps 552 and 554 to generate the Fourier spectrum components, such as those illustrated in FIGS. 46–51. In steps 546 and 548, the massage data routine 504 generated the curves shown in FIGS. 39–45. FIGS. 46 and 47 show the Fourier spectrum components for the diffuse reflection and the specular reflection, respectively, of a premium media, here the matte photo media. FIGS. 48 and 49 show the Fourier spectrum components for the diffuse reflection and the specular reflection, respectively, of a premium media, here the very glossy photo media. FIGS. 50 and 51 show the Fourier spectrum components for the diffuse reflection and the specular reflection, respectively, of a premium media, here the plain paper media, specifically, Gilbert® bond.

In comparing the graphs of FIGS. 46–51, remember to compare the values for the diffuse reflection with the other diffuse reflection curves (FIGS. 46, 48 and 50) and to compare the specular reflection curves with other specular reflection curves (FIGS. 47, 49 and 51). For instance, to distinguish between the matte photo media and the very glossy photo media, the frequency of 10 cycles per inch for the specular curves of FIGS. 47 and 49 may be compared. In FIG. 47, the matte photo has a frequency magnitude of around 10 counts as shown at item number 888 in FIG. 47. In comparison, in FIG. 49 for the very glossy photo media, the frequency magnitude at a spatial frequency of 10 cycles per inch is nearly a magnitude of 42 counts, as indicated by item number 889 in FIG. 49.

Figure 52:
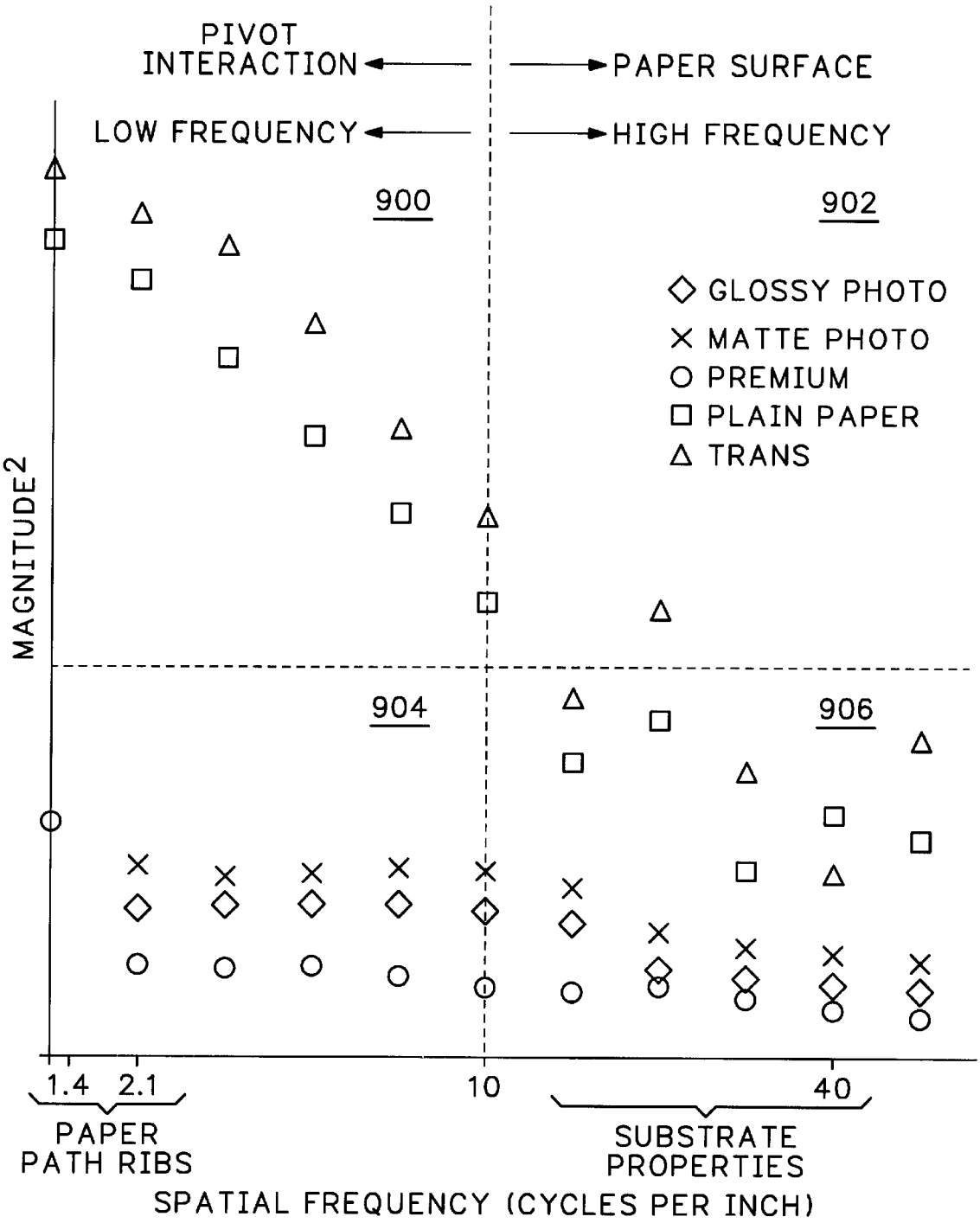
FIG. 52 is a graph of the diffuse spatial frequencies of several generic medias, including plain paper media, premium paper media, matte photo media, glossy photo media, and transparency media.
Figure 53:
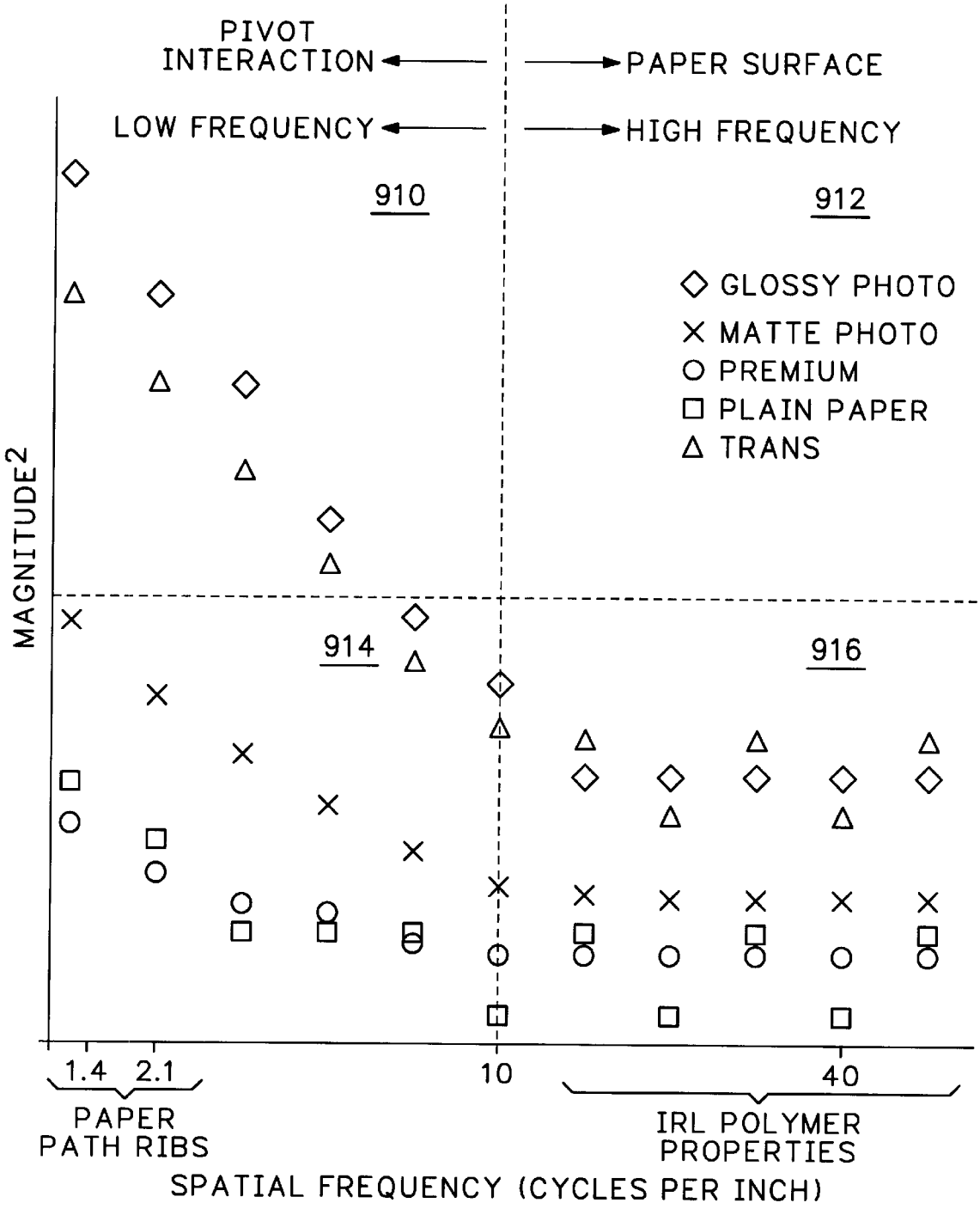
FIG. 53 is a graph of the specular spatial frequencies of several generic medias, including plain paper media, premium paper media, matte photo media, glossy photo media, and transparency media.

A better representation of the Fourier spectrum components for five basic media types is shown by the graphs of FIGS. 52 and 53. In the graphs of FIGS. 52 and 53, the various data points shown correspond to selected frequency magnitude peaks taken from generic bar graphs like those shown in FIGS. 46–51 for the Fourier spectrum components. Thus, the points shown in the graphs of FIGS. 52 and 53 represent maximum frequency magnitudes corresponding to selected spatial frequencies up to 40 cycles per inch, which comprises the useful data employed by the advanced determination system 500. In FIGS. 52 and 53, selected spectrum components are shown for five generic types of media: plain paper media, premium media, matte photo media, glossy photo media, transparency media, each of the graphs in FIGS. 52 and 53 has a left half corresponding to low spatial frequency values, toward the left, and high frequency spatial values toward the right, with the border between the low frequency and high frequency portions of each graph occurring around 10 or 20 cycles per inch Now that the roadmap of the media determination method 500 has been laid out with respect to FIGS. 20 and 25–32, as well as the intricacies of the manner in which information is extracted from the media with respect to FIGS. 33–51, the interrelation between the roadmap and these intricacies will be described. Indeed, to draw on the roadmap analogy, the various branches in the major category determinations and specific type determinations of FIGS. 29–32 may be considered as branches or forks in the road, with the various schemes used to make these determinations considered to be points of interest along our journey.

Table 4 below lists some of our various points of interest and destinations where our journey may end, that is ending by selecting a specific type of media.

TABLE 4

Media Determinations

| # | Medias Compared | FIG. No. - Step No. | Result |
|---|---|---|---|
| 1 | Transparency (Tape or Not) | 13–426, 430 | No Tape Transp. |
| 2 | Photo vs. Transparency | 29–626, 636 | Tape Transparency |

TABLE 4-continued

Media Determinations

| # | Medias Compared | FIG. No. - Step No. | Result |
|---|---|---|---|
| 3 | Glossy Photo vs. Matte Photo | 30–668 | Glossy Photo |
| 4 | Plain vs. Premium vs. Matte | 31–706 | Matte Photo |
| 5 | Plain vs. Premium | 32–746, 772 | Premium Paper |
| 6 | Plain vs. Premium | 32–746, 748 | Plain Paper |
| 7 | Matte Swellable vs. Matte Porous | 31–715 | Swellable IRL Matte |
| 8 | Matte Swellable vs. Matte Porous | 31–715 | Porous IRL Matte |
| 9 | Very Glossy vs. Glossy Photo | 30–674 | Very Glossy Photo |
| 10 | Very Glossy vs. Glossy Photo | 30–674 | Glossy Photo |

Figure 54:
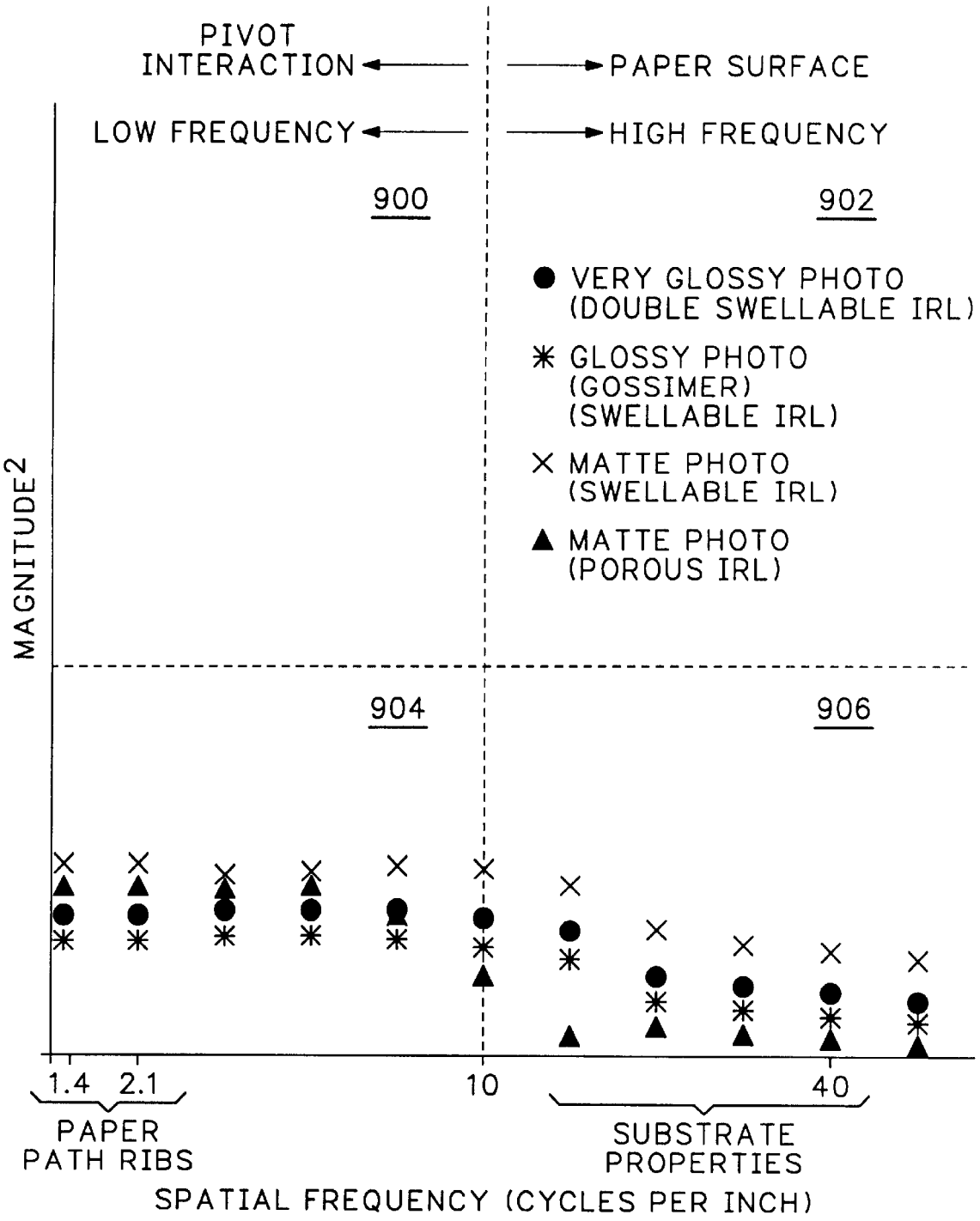
FIG. 54 is a graph of the diffuse spatial frequencies of several specific medias, including plain paper media, premium paper media, matte photo media, glossy photo media, and transparency media.

The graphs of FIGS. 51–54 have been broken down into four quadrants, with the generic diffuse spatial frequency graphs of FIGS. 52 and 54 having: (1) a first quadrant 900 which has a low frequency and high magnitude, (2) a second quadrant 902 which has a high frequency and high magnitude, (3) a third quadrant 904 which has a low frequency and low magnitude, and a fourth quadrant 906 which has a high frequency and low magnitude. The graphs of FIGS. 52–55 have been broken down into four quadrants, with the generic specular spatial frequency graphs of FIGS. 53 and 55 having: (1) a first quadrant 910 which has a low frequency and a low magnitude, (2) a second quadrant 912 which has a high frequency and high magnitude, (3) a third quadrant 914 which has a low frequency and high magnitude, and a fourth quadrant 916 which has a high frequency and low magnitude.

By comparing the data for the various types of media shown in the graphs of FIGS. 52–55, the determinations made in operations #3–10 of Table 4 may be determined. Other more basic data as described earlier is used to determine whether an incoming sheet of media is a transparency (Δ), with or without a tape header as described earlier, according to operations #1 and #2 of Table 4. Table 5 below shows which quadrant of which graph is used to determine the media types of operations #3–10 of Table 4.

TABLE 5

Media Categorization Steps by Region of Spatial Frequency Graphs (FIGS. 52–55)

| Graph | Low Frequency | High Frequency |
|---|---|---|
| Diffuse | High Magnitude (Region #900) 5 | High Magnitude (Region #902) — |
| Diffuse | Low Magnitude (Region #904) 6 (maybe 3) | Low Magnitude (Region #906) 7 and 8 |
| Specular | High Magnitude (Region #910) 3, 9 and 10 | High Magnitude (Region #912) — |
| Specular | Low Magnitude (Region #914) 4 | Low Magnitude (Region #916) — |

In the third operation (#3) of Table 4, the distinction between glossy photo media and matte photo media may be made by examining the data in quadrant 904 of FIG. 52, or in quadrants 910 and 914 of FIG. 53. In FIG. 52, the magnitude of the matte photo spatial frequencies (X) are greater than the magnitude of the glossy photo spatial frequencies (◇). Perhaps even better than FIG. 52, the difference is shown in FIG. 53 for the specular spatial frequencies, where we find the matte photo spatial frequencies (X) falling within quadrant 914, and the glossy photo (◇) spatial frequencies falling in quadrant 910. Thus, while the information supplied by the diffuse sensor 130 may be used to make a determination between glossy and matte photos, as shown in FIG. 52, a much clearer distinction is made using the data collected by the specular sensor 130', as shown with respect to FIG. 53.

In operation #4 of Table 4, the method distinguishes between plain paper versus premium paper versus matte photo. This distinction may be accomplished again using the data in quadrant 914 of FIG. 53. In quadrant 914, we see the matte photo (X) spatial frequencies are far greater in magnitude than the plain paper (≡) spatial frequencies, and the premium paper (○) spatial frequencies. Thus, the selection of matte media in operation #4 is quite simple.

In operations #5 and #6 of Table 4, the characteristics of plain paper and premium paper are compared. Referring to the diffuse spatial frequency graph of FIG. 52, the premium paper (○) spatial frequencies appear in quadrant 904, whereas the plain paper (≡) spatial frequencies appear in quadrant 900.

Following operation #6 of Table 4, a sheet of media entering the printzone 25 has been classified according to its major category type: transparency (with or without a header tape), glossy photo media, matte photo media, premium paper, or plain paper. Note that in the original Table 2 above, matte photo was discussed as a sub-category of premium medias, but to the various characteristics of matte photo media more readily lend themselves to a separate analysis when working through the major category and specific type determination routines 506 and 508, as illustrated in detail with respect to FIGS. 29–32.

Following determination of these major categories, to provide even better results in terms of the image ultimately printed on a sheet of media, it would be desirable to make at least two specific type determinations. While other distinctions may be made between specific types of media, such as between specific types of plain paper (FIG. 32, table 754) in practice so far, no particular advantage has been found which would encourage different printing routines for the different types of plain paper media because basically, of the plain paper medias studied thus far, they all provide comparable results when printed upon according to a plain paper default print mode ("0,0"), as shown in step 770 of FIG. 32. However, if in the future it becomes desirable to tailor print routines for different types of plain paper, the method 500 has been designed to allow for this option, by including steps 760 and 764 to allow for tailored plain paper print modes (FIG. 32). Two of the major categories, specifically matte photo and glossy photo lend themselves better to specific type media determinations, allowing for different print modes.

Figure 55:
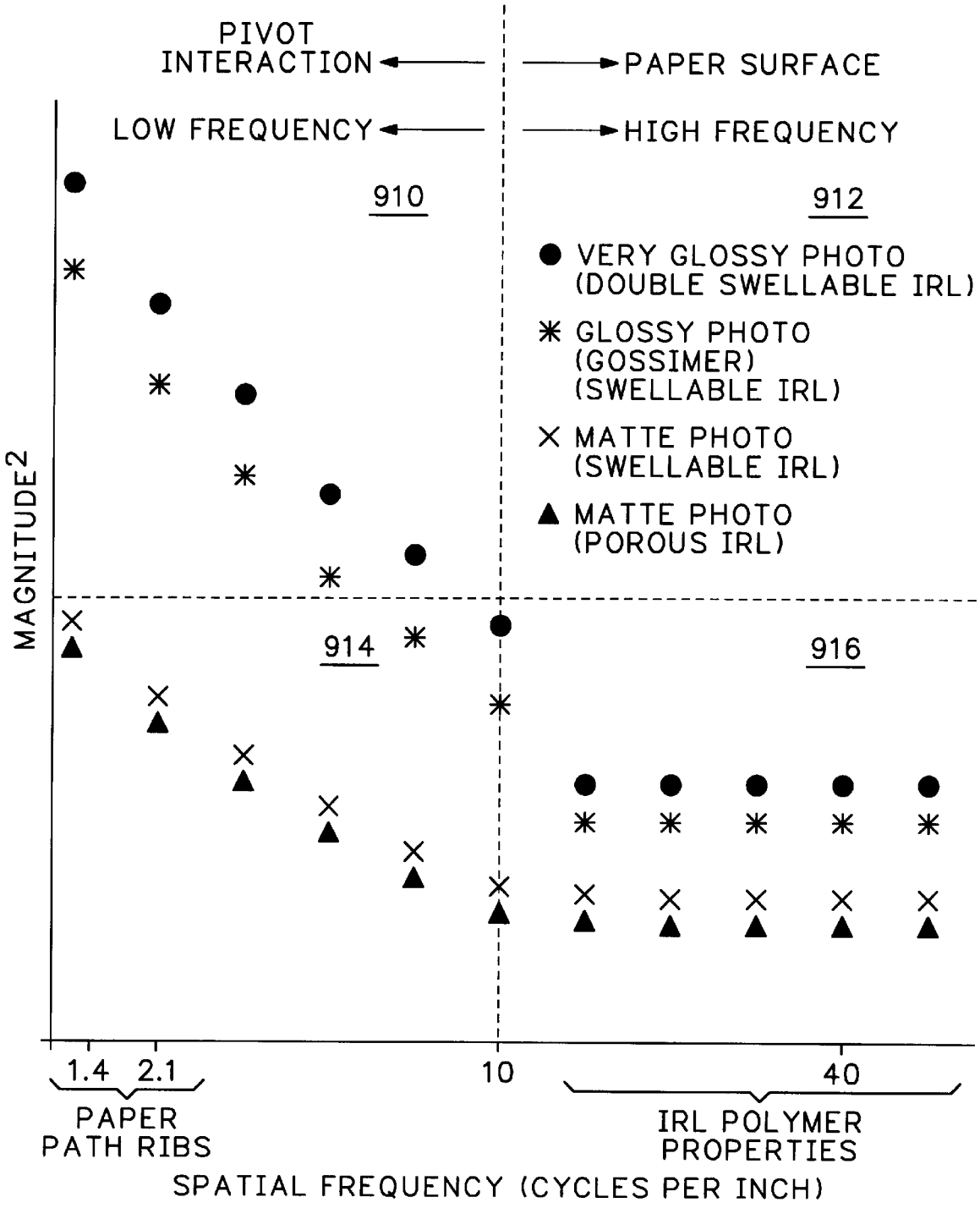
FIG. 55 is a graph of the specular spatial frequencies of several specific medias, including plain paper media, premium paper media, matte photo media, glossy photo media, and transparency media.

The specific type determinations will be made according to the data shown in FIGS. 54 and 55. Thus, operations #7 and #8 of Table 4 are used to distinguish matte photo medias having swellable coatings from those having porous coatings. The matte photo (X) data from FIGS. 52 and 53 has been carried over into FIGS. 54 and 55. The matte photo data depicted with the X's in FIGS. 52–55 is for a swellable coating, or ink retention layer ("IRL"). The specular frequencies for a matte photo media with a porous coating or IRL is shown in FIGS. 54 and 55 as ▼. While the specular data of FIG. 55 could be used to distinguish the matte photo swellable coatings (X) from the porous coatings (▼), the diffuse data shown in quadrant 906 lends itself to an easier distinction. In quadrant 906, we see the swellable coating matte photo (X) spatial frequencies as having a magnitude greater than the matte photo porous coated media (◆). Thus, the information in quadrant 906 best lends itself for making the determination of operations #7 and #8 in Table 4.

The other desired specific type media distinction is between glossy photo media (Gossimer) and very glossy photo media (double polymer IRL coatings). While the diffuse data of FIG. 54 could be used to determine the distinction between the very glossy media (●) and the glossy Gossimer media (*), an easier distinction is made with respect to the specular data shown in FIG. 55. As shown in quadrant 910, the very glossy (●) specular frequencies have a greater magnitude than the glossy Gossimer (*) spatial frequencies. Thus, the data shown in quadrant 910 allows for the distinctions made in the ninth and tenth operations #9 and #10 of Table 4.

Conclusion

Thus, a variety of advantages are realized using the advanced media determination system 500 of FIGS. 20 and 25–32, as well as the advantages realized using the more simple basic determination method 400 of FIG. 13. Indeed, preferably portions of the basic method of FIG. 13 are incorporated into and used in the advanced detection system 500, specifically, the identification of a transparency without a header tape. While the basic media determination system 400 was able to sort out photo media from plain paper and able to distinguish transparencies with and without a tape header, a more advanced media determination system was desired to distinguish between various types of premium paper and various types of photo medias. This desire to identify the various types of premium and photo medias was spurred on by a desire to provide users with photographic quality images. While the current printer drivers due allow users to go into the program and select a specific type of media, it has been found that most users lack the sophistication to enter the program and make these determinations. Often though it is not a matter of lack of sophistication, but users may also suffer from a lack of time to make such a selection, as well as simply not knowing which type of photo media or premium media which they have in their hand to print upon. Whatever the reason, for simplicity of use, an automatic media determination system which selects the optimum print modes for the type of media entering the printzone is desired, and the advance determination system 500 accomplishes these objectives.

Furthermore, use of the media sensor 515 advantageously is both a small compact unit, which is economical, lightweight, and easily integrated into existing printer architectures. Another advantage of the advanced media determination system 500, and the use of the media sensor 515, is that the system does not require any special markings to be made on a sheet of media. Earlier systems required the media suppliers to place special markings on the media which were then interpreted by a sensor, but unfortunately these markings would often run into the printed image, resulting in undesirable print artifact defects.

Additionally, the media sensor 515 may also be used for detecting printed ink droplets, to assist in pen alignment routine as described above with respect to the monochromatic sensor 100. Furthermore, the advanced determination system 500 having any type of absolute calibration at the factory, because the measurements made by the sensor 515 are relative measurements, with factory calibration revolving around the use of plain paper media, as mentioned above. Thus, a variety of advantages are realized using the advanced media determination system 500, in conjunction with the illustrated media sensor 550, to provide consumers with an economical, easy to use printing unit, which provides outstanding print quality outputs without user intervention.

We claim:

1. A method of classifying incoming media entering a printing mechanism, the method comprising:

optically scanning a portion of the incoming media to generate diffuse reflectance data and specular reflectance data;

determining spatial frequencies of the diffuse reflectance data and the specular reflectance data;

calculating an average of the diffuse reflectance data;

calculating an average of the specular reflectance data;

analyzing the diffuse reflectance data and the specular reflectance data and the spatial frequencies thereof through comparison with known values for different types of media to classify the incoming media as one of said different types, including generating a ratio of the average of the diffuse reflectance data to the average of the specular reflectance data and comparing said ratio with a known value to determine whether the incoming media is of a first category of media or a second category of media and not of a third category of media or a fourth category of media.

2. A method according to claim 1 wherein the determining comprises performing a Fourier transform on the diffuse reflectance data and the specular reflectance data to determine the frequency magnitudes thereof, and using said frequency magnitudes to generate said spatial frequencies.

3. A method according to claim 1 wherein:

the first category of media comprises a transparency media;

the second category of media comprises a premium media;

the third category of media comprises a glossy photo media; and the fourth category of media comprises a matte photo media.

4. A method according to claim 3 wherein the analyzing comprises:

comparing the diffuse reflectance data and the specular reflectance data with known values for media having a glossy finish and media having a dull finish; and in response to the comparing, classifying the incoming media into either a dull media group or a glossy media group.

5. A method according to claim 4 wherein in the classifying step:

the glossy media group comprises transparency media and glossy photo media; and the dull media group comprises plain paper media, premium media and matte photo media.

6. A method according to claim 4 wherein following classification of the incoming media into the glossy media group in the classifying step, the analyzing step further comprises the steps of comparing the diffuse reflectance data and the specular reflectance data with known values for media having a glossy photo finish and media comprising transparency media, and determining therefrom whether the incoming media is a transparency media.

7. A method according to claim 6 further including the steps of:

calculating an average of the diffuse reflectance data;

calculating an average of the specular reflectance data;

generating a ratio of the average of the diffuse reflectance data to the average of the specular reflectance data; and comparing said ratio with a known value to determine whether the incoming media is a transparency media.

8. A method according to claim 7 further including the steps of:

verifying whether the incoming media is a transparency media using a weighting and ranking routine;

if the verifying step determines the incoming media is a transparency media, selecting a transparency media print mode and printing an image on the incoming media using the transparency media print mode; and if the verifying step determines the incoming media is not a transparency media, selecting a default print mode and printing an image on the incoming media using the default print mode.

9. A method according to claim 8 wherein said default print mode comprises a premium media print mode.

10. A method according to claim 3 wherein the analyzing comprises deciding whether the incoming media is a glossy photo media or a matte photo media.

11. A method according to claim 10 wherein the deciding step comprises the step of comparing the diffuse reflectance data and the specular reflectance data with known values for media having a glossy photo finish and media having a matte photo finish.

12. A method according to claim 10 wherein when the deciding step decides the incoming media is a glossy photo media, the method further includes the step of identifying a specific type of glossy photo media corresponding to the incoming media.

13. A method according to claim 12 wherein when the identifying step comprises the step of comparing the spatial frequencies of the specular reflectance data with known values for plural specific types of glossy photo media, and matching the incoming media with one specific type of glossy photo media.

14. A method according to claim 13 further including the step of verifying whether the incoming media is said one specific type of glossy photo media using a weighting and ranking routine.

15. A method according to claim 14 further including the steps of:

if the verifying step determines the incoming media is said one specific type of glossy photo media, selecting a specific print mode corresponding to said one specific type, and printing an image on the incoming media using said specific print mode; and if the verifying step determines the incoming media is not said one specific type of glossy photo media, selecting a default print mode and printing an image on the incoming media using the default print mode.

16. A method according to claim 3 wherein the analyzing comprises deciding whether the incoming media is a plain paper media, a premium media, or a matte photo media.

17. A method according to claim 16 wherein the deciding step comprises the step of comparing the diffuse reflectance data and the specular reflectance data with known values for media having a dull finish and media having a matte photo finish.

18. A method according to claim 17 wherein when the deciding step decides the incoming media is a matte photo media, the method further includes the step of identifying a specific type of matte photo media corresponding to the incoming media.

19. A method according to claim 18 wherein when the identifying step comprises the step of comparing the spatial frequencies of the diffuse reflectance data with known values for plural specific types of matte photo media, and matching the incoming media with one specific type of matte photo media.

20. A method according to claim 19 further including the step of verifying whether the incoming media is said one specific type of matte photo media using a weighting and ranking routine.

21. A method according to claim 20 further including the steps of:

if the verifying step determines the incoming media is said one specific type of matte photo media, selecting a specific print mode corresponding to said one specific type, and printing an image on the incoming media using said specific print mode; and if the verifying step determines the incoming media is not said one specific type of matte photo media, selecting a default print mode and printing an image on the incoming media using the default print mode.

22. A method according to claim 3 wherein the analyzing comprises deciding whether the incoming media is a plain paper media or a premium media.

23. A method according to claim 22 wherein the deciding step comprises the step of comparing the diffuse reflectance data and the specular reflectance data with known values for media having a plain paper finish and media having a premium media finish.

24. A method according to claim 22 wherein when the deciding step decides the incoming media is a premium media, the method further includes the step of identifying a specific type of premium media corresponding to the incoming media.

25. A method according to claim 24 wherein when the identifying step comprises the step of comparing the spatial frequencies of the diffuse reflectance data and the specular reflectance data with known values for plural specific types of premium media, and matching the incoming media with one specific type of premium media.

26. A method according to claim 25 further including the step of verifying whether the incoming media is said one specific type of premium media using a weighting and ranking routine.

27. A method according to claim 26 further including the steps of:

if the verifying step determines the incoming media is said one specific type of premium media, selecting a specific print mode corresponding to said one specific type, and printing an image on the incoming media using said specific print mode; and if the verifying step determines the incoming media is not said one specific type of premium media, selecting a default print mode and printing an image on the incoming media using the default print mode.

28. A method according to claim 22 wherein when the deciding step decides the incoming media is a plain paper media, the method further includes the step of identifying a specific type of plain paper media corresponding to the incoming media.

29. A method according to claim 28 wherein when the identifying step comprises the step of comparing the spatial frequencies of the diffuse reflectance data and the specular reflectance data with known values for plural specific types of plain paper media, and matching the incoming media with one specific type of plain paper media.

30. A method according to claim 29 further including the steps of:

verifying whether the incoming media is said one specific type of plain paper media using a weighting and ranking routine;

if the verifying step determines the incoming media is said one specific type of plain paper media, selecting a specific print mode corresponding to said one specific type, and printing an image on the incoming media using said specific print mode; and if the verifying step determines the incoming media is not said one specific type of plain paper media, selecting a default print mode and printing an image on the incoming media using the default print mode.

31. A method according to claim 3 wherein the scanning further comprises:

illuminating a light source;

adjusting a brightness level of the light source;

thereafter, moving the light source across the incoming media; and spatially sampling diffuse reflectance values and specular reflectance values during the moving.

32. A method according to claim 31, the sampling further including:

storing sampled diffuse reflectance values and specular reflectance values as stored values; and discarding erroneous diffuse reflectance values and specular reflectance values from said stored values.

33. A method according to claim 3 wherein the determining further comprises:

generating a diffuse reflectance graph from the diffuse reflectance data; and generating a specular reflectance graph from the specular reflectance data.

34. A method according to claim 33 wherein the determining step includes the steps of:

generating the spatial frequencies of the diffuse reflectance data from the diffuse reflectance graph; and generating the spatial frequencies of the specular reflectance data from the specular reflectance graph.

35. A method according to claim 33 further including the steps of:

calculating an average of the diffuse reflectance data; and calculating an average of the specular reflectance data.

36. A method according to claim 3 wherein the analyzing further comprises:

making an assumption that the incoming media is a specific media type; and verifying correctness of the assumption.

37. A method according to claim 36 wherein the verifying further comprises:

looking-up characteristics corresponding to the specific media type; and comparing characteristics of the incoming media with the looked-up said characteristics corresponding to the specific media type.

38. A method according to claim 37 further including the steps of:

if the comparing step determines the incoming media is said specific media type, selecting a print mode corresponding to said specific media type and printing an image on the incoming media using the selected print mode; and if the comparing step determines the incoming media is not said specific media type, selecting a default print mode and printing an image on the incoming media using the default print mode.

39. A method according to claim 36 wherein the verifying step further includes the steps of:

comparing the assumption with known values for plural specific media types;

weighting the assumption in response to the comparing step for each of the plural specific media types; and ranking each weighted assumption for each plural specific media type.

40. A method according to claim 39 wherein the verifying step further includes the steps of:

summing the rankings for each plural specific media type; and choosing a fitted specific media type from said plural specific media types by choosing the highest sum of the summing step.

41. A method according to claim 36 wherein the verifying further comprises:

first looking-up reference spatial frequencies corresponding to plural specific media types;

finding error between the spatial frequencies of the incoming media with corresponding reference spatial frequencies from the first looking-up;

second looking-up a standard deviation for each spatial frequency for each of said plural specific media types;

weighting the error according to a corresponding standard deviation from the second looking-up step and generating a weighted error;

ranking each weighted error for each plural specific media type;

summing ranked weighted errors for each plural specific media type; and choosing a fitted specific media type from said plural specific media types by choosing a highest sum found in the summing.

42. A method according to claim 41 further including the steps of:

if the assumption matches the fitted specific media type, selecting a print mode corresponding to said specific media type and printing an image on the incoming media using the selected print mode; and if the assumption does not match the fitted specific media type, selecting a default print mode and printing an image on the incoming media using the default print mode.

43. A method according to claim 3 wherein:

the printing mechanism has a printzone where an image is formed on the incoming media; and the optically scanning step is conducted in the printzone prior to image formation.

44. A method according to claim 3 wherein the analyzing includes sorting the incoming media into one of the plural major media category groups.

45. A method according to claim 44 wherein the analyzing further comprises:

matching the incoming media with a specific media type within said one of plural major media category groups or matching the incoming media with a default media type of said one of plural major media category groups.

46. A method according to claim 44 wherein the sorting step includes the step of deciding whether the incoming media is of a first major category group or of a second major category group.

47. A method according to claim 46 wherein:

the first major category group comprises photo media and transparency media; and the second major category group comprises plain paper media, premium media and matte photo media.

48. A method according to claim 47 wherein:

the sorting step further includes the step of determining the incoming media is a transparency media; and the method further includes the steps of selecting a transparency media print mode and printing an image on the incoming media using the transparency media print mode.

49. A method according to claim 47 wherein:

the sorting step further includes the step of determining the incoming media is a glossy photo media;

the analyzing step further includes the step of matching the incoming media with a specific media type of glossy photo media; and the method further includes the steps of selecting a glossy photo media print mode and printing an image on the incoming media using the glossy photo media print mode.

50. A method according to claim 47 wherein:

the sorting step further includes the step of determining the incoming media is a matte photo media;

the analyzing step further includes the step of matching the incoming media with a specific media type of matte photo media; and the method further includes the steps of selecting a matte photo media print mode and printing an image on the incoming media using the matte photo media print mode.

51. A method according to claim 50 wherein:

the sorting step further includes the step of determining the incoming media is a premium media;

the analyzing step further includes the step of matching the incoming media with a specific media type of premium media; and the method further includes the steps of selecting a premium media print mode and printing an image on the incoming media using the premium media print mode.

52. A method according to claim 47 wherein:

the sorting step further includes the step of determining the incoming media is a plain paper media;

the analyzing step further includes the step of matching the incoming media with a specific media type of plain paper media; and the method further includes the steps of selecting a plain paper media print mode and printing an image on the incoming media using the plain paper media print mode.

53. A method of classifying incoming media entering a printing mechanism, the method comprising:

optically scanning a portion of the incoming media;

collecting raw data during the scanning step;

massaging the raw data;

determining a major category corresponding to the incoming media;

determining a specific type of media within the major category corresponding to the incoming media;

verifying the specific type of media corresponds to the incoming media;

selecting a print mode in response to the verifying step;

a printing an image on the incoming media using the selected print mode, and wherein the collecting raw data further includes illuminating a light source; adjusting a brightness level of the illuminated light source;

thereafter, moving the light source across the incoming media; spatially sampling diffuse reflectance values and specular reflectance values during the moving step; storing the sampled diffuse reflectance values and specular reflectance values as stored values; and discarding erroneous diffuse reflectance values and specular reflectance values from said stored values.

54. A method according to claim 53 wherein:

the printing mechanism has a printzone where an image is formed on the incoming sheet; and the optically scanning step is conducted in the printzone prior to image formation.

55. A method of classifying incoming media entering a printing mechanism, the method comprising:

optically scanning a portion of the incoming media;

collecting raw data during the scanning step;

massaging the raw data;

determining a major category corresponding to the incoming media;

determining a specific type of media within the major category corresponding to the incoming media;

verifying the specific type of media corresponds to the incoming media;

selecting a print mode in response to the verifying step;

printing an image on the incoming media using the selected print mode, and wherein the massaging further includes generating a diffuse reflectance graph from the diffuse reflectance data; generating a specular reflectance graph from the specular reflectance data; generating spatial frequencies of the diffuse reflectance data from the diffuse reflectance graph; and generating spatial frequencies of the specular reflectance data from the specular reflectance graph.

56. A method according to claim 55 wherein the massaging step comprises the steps of:

calculating an average of the diffuse reflectance data; and calculating an average of the specular reflectance data.

57. A method of classifying incoming media entering a printing mechanism, the method comprising:

optically scanning a portion of the incoming media;

collecting raw data during the scanning step;

massaging the raw data;

determining a major category corresponding to the incoming media;

determining a specific type of media within the major category corresponding to the incoming media;

verifying the specific type of media corresponds to the incoming media;

selecting a print mode in response to the verifying step;

printing an image on the incoming media using the selected print mode, and wherein the optically scanning further includes illuminating the incoming media with a blue-violet light having a peak wavelength of about 428 nanometers, and a dominant wave length of about 464 nanometers.

58. A method of classifying incoming media entering a printing mechanism, the method comprising:

optically scanning a portion of the incoming media to generate diffuse reflectance data and specular reflectance data;

determining the spatial frequencies of the diffuse reflectance data and the specular reflectance data;

sorting the incoming media into one of plural major media category groups; and matching the incoming media with a specific media type or a default media type both within said one of plural major media category groups.

59. A method according to claim 58 wherein the plural major media category groups comprise photo media, transparency media, plain paper media, premium media, and matte photo media.

60. A method according to claim 58 further including:

selecting a specific print mode corresponding to said specific media type if matched in the matching, or a default print mode corresponding to a default media type if matched in the matching; and printing an image on the incoming media using the specific print mode.

61. A method according to claim 58 further including filtering light received by the diffuse sensor and the specular sensor to wavelengths emitted by the illuminating element.

62. A method according to claim 58 wherein the matching further comprises:

making an assumption that the incoming media is a specific media type; and verifying correctness of the assumption by:

looking-up characteristics corresponding to the specific media type;

comparing characteristics of the incoming media with looked-up characteristics corresponding to the specific media type;

weighting the assumption in response to the comparing for each of the plural specific media types;

ranking each weighted assumption for each plural specific media type;

summing rankings for each plural specific media type; and choosing a fitted specific media type from said plural specific media types by choosing a highest sum of the summing;

selecting a specific print mode corresponding to said specific media type if matched in the matching step, or a default print mode corresponding to said default media type if matched in the matching step; and printing an image on the incoming media using the specific print mode.

63. A method according to claim 58 wherein the optically scanning step comprises the step of illuminating the incoming media with a blue-violet light emitting wavelengths between 340–500 nanometers.

64. A method according to claim 58 wherein the optically scanning step comprises the step of illuminating the incoming media with a blue-violet light having a peak wavelength of about 428 nanometers, and a dominant wave length of about 464 nanometers.

65. An optical sensing system for an inkjet printing mechanism having a printzone, comprising:

a single illuminating element directed to illuminate incoming media entering the printzone;

a diffuse sensor which receives diffuse light reflected from an element-illuminated media and generates a diffuse signal having an amplitude proportional to diffuse reflectance of the element-illuminated media; and a specular sensor which receives specular light reflected from the element-illuminated media and generates a specular signal having an amplitude proportional to specular reflectance of the element-media, wherein the illuminating element emits a blue-violet light having a wavelength selected from an approximate range of 340–500 nanometers, wherein the illuminating element emits a blue-violet light having a dominant wave length of about 464 nanometers.

66. An optical sensing system according to claim 65 wherein the illuminating element comprises a light emitting diode and the diffuse sensor and the specular sensor each comprise a photodiode.

67. An optical sensing system according to claim 65 wherein the illuminating element emits a blue-violet light at a peak wavelength selected from a range of approximately 400–430 nanometers.

68. An optical sensing system according to claim 67 wherein the illuminating element emits a blue-violet light having a peak wavelength of about 428 nanometers, and a dominant wave length of about 464 nanometers.

69. An optical sensing system according to claim 65 further including:

a diffuse field stop which limits light received by the diffuse sensor; and a specular field stop which limits light received by the specular sensor.

70. An optical sensing system according to claim 69 wherein:

the system further includes a carriage which scans the illuminating element, the diffuse sensor, and the specular sensor across the media along a scanning axis;

the diffuse field stop includes a rectangular window having a major axis aligned substantially parallel to the scanning axis; and the specular field stop includes a rectangular window having a major axis aligned substantially perpendicular to the scanning axis.

71. An optical sensing system according to claim 65 further including:

a diffuse filter which limits light received by the diffuse sensor; and a specular filter which limits light received by the specular sensor.

72. An optical sensing system according to claim 71 wherein the diffuse filter and the specular filter limits the light received by the specular sensor to a range of wavelengths which encompasses wavelengths emitted by the illuminating element.

73. An optical sensing system according to claim 72 wherein the diffuse filter and the specular filter limit the light passing therethrough to wavelengths of 360–510 nanometers.

74. An optical sensing system according to claim 71 wherein the diffuse filter and the specular filter are each constructed using conventional thin film deposition techniques.

75. An optical sensing system according to claim 71 further including:

a diffuse field stop which limits the filtered light received by the diffuse sensor; and a specular field stop which limits the filtered light received by the specular sensor.

76. An optical sensing system according to claim 65 further including:

a carriage which scans the illuminating element, the diffuse sensor, and the specular sensor across the incoming media;

a carriage position detector which generates a carriage position signal in response to position of the carriage while scanning; and a controller which pulses the illuminating element in response to the carriage position signal.

77. An optical sensing system according to claim 76 wherein the controller receives and processes the diffuse signal and the specular signal, and in response thereto, generates a print signal having a print mode selected to match type of media entering the printzone.

78. An inkjet printing mechanism, including a printzone, comprising:

a carriage that reciprocates an inkjet printhead along a scanning axis across the printzone to selectively deposit ink droplets on media in response to a print signal generated to print a selected image on incoming media entering the printzone;

a media sensor supported by the carriage for scanning across the printzone, with the media sensor including (1) a single illuminating element directed to illuminate incoming media, (2) a diffuse sensor which receives diffuse light reflected from a so illuminated media and generates a diffuse signal having an amplitude proportional to diffuse reflectance of the illuminated media, and (3) a specular sensor which receives specular light reflected from the illuminated media and generates a specular signal having an amplitude proportional to specular reflectance of the illuminated media; and a controller which compares the diffuse signal and the specular signal to a set of reference values and therefrom determines type of the illuminated media and generates a print signal having a print mode selected to match the type of media entering the printzone, wherein the illuminating element emits a blue-violet light at wavelengths between 340–500 nanometers and having a peak wavelength of about 428 nanometers and a dominant wave length of about 464 nanometers.

79. An inkjet printing mechanism according to claim 78 wherein the illuminating element comprises a light emitting diode and the diffuse sensor and the specular sensor each comprise a photodiode.

80. An inkjet printing mechanism according to claim 78 further including:

a diffuse field stop which limits light received by the diffuse sensor; and a specular field stop which limits light received by the specular sensor.

81. An inkjet printing mechanism according to claim 80 wherein:

the diffuse field stop includes a rectangular window having a major axis aligned substantially parallel to the scanning axis; and the specular field stop includes a rectangular window having a major axis aligned substantially perpendicular to the scanning axis.

82. An inkjet printing mechanism according to claim 78 further including:

a diffuse filter which limits light received by the diffuse sensor; and a specular filter which limits light received by the specular sensor.

83. An inkjet printing mechanism system according to claim 82 wherein the diffuse filter and the specular filter limits the light received by the specular sensor to a range of wavelengths which encompasses wavelengths emitted by the illuminating element.

84. An inkjet printing mechanism system according to claim 83 wherein the diffuse filter and the specular filter limit light passing therethrough to wavelengths of 360–510 nanometers.

85. An inkjet printing mechanism system according to claim 82 further including a diffuse field stop which limits filtered light received by the diffuse sensor, and a specular field stop which limits filtered light received by the specular sensor.

* * * * *